US012583702B2

(12) United States Patent
Iwasaki et al.

(10) Patent No.: US 12,583,702 B2
(45) Date of Patent: Mar. 24, 2026

(54) PAPER FEEDING DEVICE AND IMAGE FORMING APPARATUS

(71) Applicants: Takeshi Iwasaki, Kanagawa (JP); Daiki Satoh, Kanagawa (JP); Katsumi Okada, Kanagawa (JP)

(72) Inventors: Takeshi Iwasaki, Kanagawa (JP); Daiki Satoh, Kanagawa (JP); Katsumi Okada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 85 days.

(21) Appl. No.: 18/478,803

(22) Filed: Sep. 29, 2023

(65) Prior Publication Data

US 2024/0116729 A1 Apr. 11, 2024

(30) Foreign Application Priority Data

Oct. 11, 2022 (JP) ..... 2022-162958

(51) Int. Cl.
*B65H 23/04* (2006.01)

(52) U.S. Cl.
CPC .... *B65H 23/046* (2013.01); *B65H 2701/1311* (2013.01)

(58) Field of Classification Search
CPC ..... B65H 43/02; B65H 43/04; B65H 23/02; B65H 23/046; B65H 23/32; B65H 19/105; B65H 2701/1311; B65H 2301/4151; B65H 2301/449; B65H 2553/61; B65H 2553/81
USPC ..... 242/413, 413.2, 485.6; 271/152, 258.01, 271/265.01
See application file for complete search history.

(56) References Cited

U.S. PATENT DOCUMENTS

| | | | | |
|---|---|---|---|---|
| 6,667,753 | B2 * | 12/2003 | Kaya | B65H 19/105 400/596 |
| 10,427,431 | B2 * | 10/2019 | Masuda | B41J 15/04 |
| 11,273,654 | B2 * | 3/2022 | Eiyama | B41J 15/042 |
| 11,613,137 | B2 * | 3/2023 | Okada | B41J 11/0095 347/104 |
| 11,878,886 | B2 * | 1/2024 | Okada | G03G 15/6502 |
| 12,049,373 | B2 * | 7/2024 | Okada | B65H 23/1882 |
| 2011/0063696 | A1 | 3/2011 | Taki et al. | |

(Continued)

FOREIGN PATENT DOCUMENTS

| | | |
|---|---|---|
| JP | 2004-067327 A | 3/2004 |
| JP | 2013-116561 A | 6/2013 |

(Continued)

*Primary Examiner* — Leslie A Nicholson, III
(74) *Attorney, Agent, or Firm* — Harness, Dickey & Pierce, P.L.C.

(57) ABSTRACT

A paper feeding device includes: a bearing base to which a spool inserted into a paper roll, around which a paper is wound, is detachably attachable; a support including: a leading-end detection sensor to detect a leading end of the paper on the paper roll and output a sensor signal; and a roller disposed at a position in the support different from the leading-end detection sensor in a circumferential direction of the paper roll, to cause the leading-end detection sensor and the roller to contact a surface of the paper roll attached to the bearing base; and to cause the leading-end detection sensor and the roller to be directed toward an axial center of the spool; and a motor to rotate the spool in a feeding direction to feed the paper and in a reverse direction opposite to the feeding direction.

20 Claims, 30 Drawing Sheets

(56) References Cited

U.S. PATENT DOCUMENTS

| | | | |
|---|---|---|---|
| 2021/0370693 | A1 | 12/2021 | Okada et al. |
| 2021/0371227 | A1 | 12/2021 | Okada et al. |
| 2022/0363504 | A1 | 11/2022 | Okada |
| 2023/0264912 | A1 | 8/2023 | Okada |
| 2023/0271800 | A1 | 8/2023 | Okada et al. |

FOREIGN PATENT DOCUMENTS

| | | | |
|---|---|---|---|
| JP | 2018-150107 | A | 9/2018 |
| JP | 2021-113118 | A | 8/2021 |
| JP | 2021-187583 | A | 12/2021 |
| JP | 2023-120846 | A | 8/2023 |

* cited by examiner

RELATED-ART

RELATED-ART

RELATED-ART

RELATED-ART

RELATED-ART

FIG. 21

| CODE | MEANING |
|---|---|
| N | INDICATING NUMBER OF TIMES OF LEADING-END DETECTION OPERATIONS THAT HAVE BEEN PERFORMED |
| K1 | GRADIENT OF SENSOR SIGNAL WHEN LEADING END OF PAPER PASSES ROLLER |
| K2 | GRADIENT OF SENSOR SIGNAL WHEN LEADING END OF PAPER PASSES LEADING-END DETECTION SENSOR |
| T1 | INDICATING TIME RANGE IN WHICH K2 IS TO BE DETECTED AFTER DETECTION OF K1. T1 IS PREFERABLY CIRCUMFERENTIAL DISTANCE (mm) FROM ROLLER TO SENSOR / LINEAR VELOCITY (mm/s) OF LEADING END OF PAPER + SETTING MARGIN TIME |
| T2 | INDICATING TIME RANGE THAT IS TIME IN WHICH K1(K2) TO BE DETECTED AGAIN SUBSEQUENT TO ONE ROTATION OF PAPER ROLL AFTER DETECTION OF K1(K2) + SETTING MARGIN TIME |
| R | VALUE THAT IS SET FOR HOW MANY ROTATIONS THAT PAPER ROLL IS TO BE MADE UNTIL DETECTION OF LEADING END |
| a | TO SET NUMBER OF TIMES THAT LEADING-END DETECTION IS TO BE PERFORMED.<br>THIS IS SET IF RELIABILITY IS INTENDED TO BE ENHANCED BY MULTIPLE TIMES OF DETECTION |
| S | SETTING VALUE OF NUMBER OF ROTATIONS OF PAPER ROLL WHEN DETERMINATION OF WHETHER SPOOL ONLY OR SENSOR FAILURE IS MADE |
| NS | SETTING VALUE OF NUMBER OF OPERATIONS FOR DETERMINING WHETHER THERE IS SENSOR FAILURE BY COUNTING NUMBER OF TIMES OF OPERATIONS WITHOUT SENSOR OUTPUTS |

PAPER FEEDING DEVICE AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2022-162958, filed on Oct. 11, 2022, in the Japan Patent Office, the entire disclosure of which is hereby incorporated by reference herein.

BACKGROUND

Technical Field

Embodiments of this disclosure relate to a paper feeding device and an image forming apparatus.

Related Art

For an image forming apparatuses using a paper roll, a paper feeding operation performed by a paper feeding device is known. The paper roll is set on a spool, and the spool with the paper roll is placed in a holder of the paper feeding device. Then, the paper feeding device performs the paper feeding operation. For such a device, a technique for detecting a leading end of the paper roll is known.

SUMMARY

A paper feeding device includes: a bearing base to which a spool inserted into a paper roll, around which a paper is wound, is detachably attachable; a support including: a leading-end detection sensor to detect a leading end of the paper on the paper roll and output a sensor signal; and a roller disposed at a position in the support different from the leading-end detection sensor in a circumferential direction of the paper roll, to cause the leading-end detection sensor and the roller to contact a surface of the paper roll attached to the bearing base; and to cause the leading-end detection sensor and the roller to be directed toward an axial center of the spool; a motor to rotate the spool in a feeding direction to feed the paper and in a reverse direction opposite to the feeding direction; and circuitry to: acquire the sensor signal from the leading-end detection sensor to control a feeding of the paper; determine whether the leading-end detection sensor detects the leading end of the paper based on the sensor signal of the leading-end detection sensor; and determine whether the paper roll is on the spool based on the sensor signal of the leading-end detection sensor.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein:

FIG. 21 is a table illustrating codes that are used in the flowcharts illustrated in FIGS. 19, 20, and 27;

Figure 1:
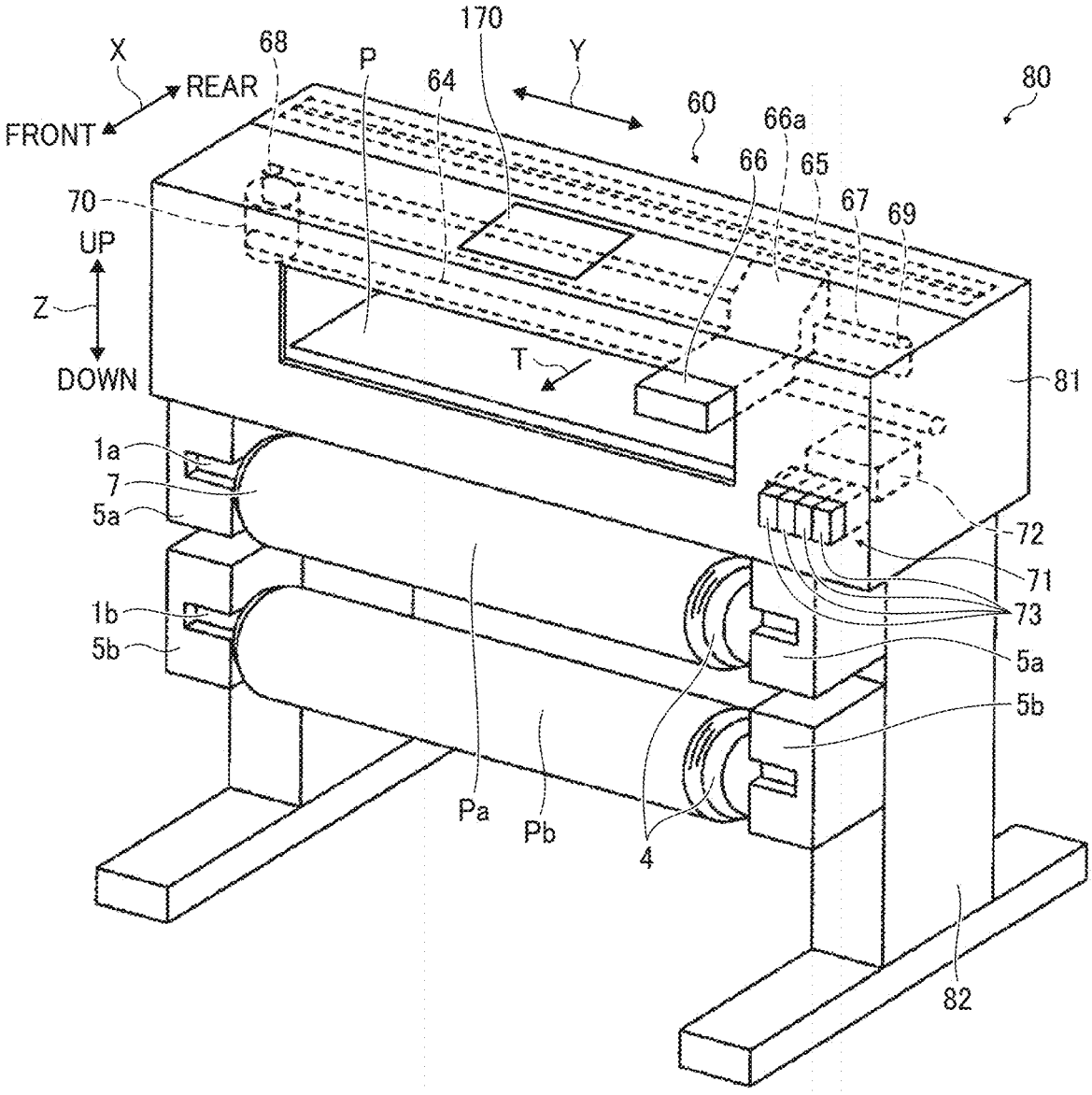
FIG. 1 is a diagram schematically illustrating a configuration example of an image forming apparatus according to one embodiment.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Hereinafter, a paper feeding device and an image forming apparatus according to the present disclosure are described with reference to the drawings. Note that the present disclosure is not limited to the embodiments described below. Other embodiments and modifications such as addition, change and deletion can be made by those skilled in the art within the scope of the present disclosure. Any of aspects can be included in the scope of the present disclosure as long as functions and effects of the present disclosure are provided.

According to the present disclosure, a paper feeding device for feeding paper from a paper roll around which long paper is wound includes a support member on which a leading-end detection sensor and a roller are disposed, and a controller. The support member supports the leading-end detection sensor and the roller to contact a surface of the paper roll. The controller comprehensively controls the paper feeding device and acquires a sensor signal from the leading-end detection sensor. The paper roll includes a paper tube inside the paper roll, and is arranged in the paper feeding device with a spool inserted into the paper tube to rotate in response to rotation of the spool. The leading-end detection sensor and the roller are disposed toward an axial center of the spool. The roller is disposed in a position different from a position of the leading-end detection sensor in a circumferential direction of the paper roll. The leading-end detection sensor detects a step of a leading end of the paper roll. The spool has a recessed portion or a raised portion in one portion of a surface. The recessed portion or the raised portion is arranged in a position to contact the leading-end detection sensor or the roller when the spool is arranged in the paper feeding device and rotated without the paper roll and the paper tube on the spool. The controller, based on a sensor signal of the leading-end detection sensor, determines the presence or absence of a leading end of the paper-roll, and determines whether the paper roll is provided on the spool.

According to the present disclosure, not only a state in which a paper roll is not set on a spool can be automatically detected with good accuracy in an efficient manner, but also a case in which a process that is performed if a paper roll is set is performed despite the absence of the paper roll can be prevented. An example of the detection in an efficient manner includes detection without an increase in the number of components.

The paper feeding device according to the present disclosure feeds paper from paper roll. The paper roll is a recording medium that is long paper (also referred to as a paper) wound in a roll shape.

Figure 2:
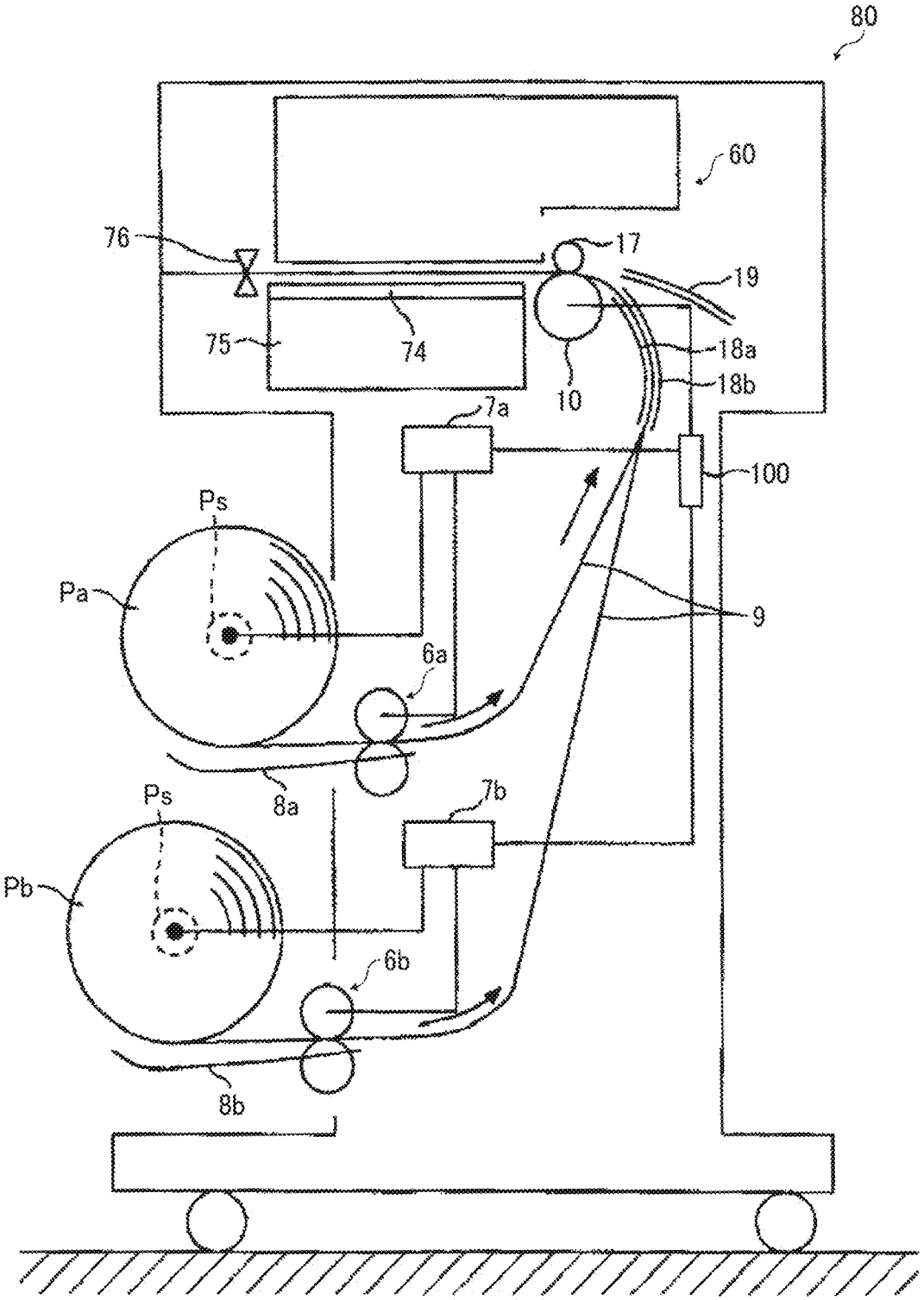
FIG. 2 is a cross-sectional view illustrating a configuration example of the image forming apparatus according to the embodiment.

A description is now given of a configuration example of an image forming apparatus 80 employing a paper feeding device 90 according to one embodiment with reference to FIGS. 1 and 2. The image forming apparatus 80 as one aspect of the present embodiment is an inkjet printer that discharges ink droplets based on image data to perform printing on a recording medium. However, the present embodiment can be applied to an apparatus such as an electrophotographic copier or printer that conveys a recording medium to perform printing on the recording medium.

FIG. 1 is a perspective view of a configuration example of the image forming apparatus 80 according to one embodiment, and FIG. 2 is a cross-sectional side view of the image forming apparatus 80. A general arrangement of the image forming apparatus 80 and operations performed by a main portion of the image forming apparatus 80 are described. In FIG. 1, a depth direction (a front-rear direction) of the image forming apparatus 80 is indicated by an arrow X, a width direction (a main-scanning direction) of the image forming apparatus 80 is indicated by an arrow Y, and a vertical direction is indicated by an arrow Z.

In FIG. 1, the image forming apparatus 80 is a serial-type image forming apparatus employing a liquid discharge method (an ink discharge method), and an apparatus body housing 81 is disposed on a body frame 82. The image forming apparatus 80 includes a main guide rod 64 and a sub-guide rod 65 inside the apparatus body housing 81. The main guide rod 64 and the sub-guide rod 65 are stretched in a main-scanning direction indicated by the arrow Y illustrated in FIG. 1. The main guide rod 64 movably supports a carriage 66, and the carriage 66 includes a connection segment 66*a*. The connection segment 66*a* engages with the sub-guide rod 65 so that a position of the carriage 66 is stabilized.

The image forming apparatus 80 includes a timing belt 67 of an endless belt along the main guide rod 64, and the timing belt 67 is stretched between a drive pulley 68 and a driven pulley 69. The drive pulley 68 is rotated by a main-scanning motor 70, and the driven pulley 69 is disposed in a state in which predetermined tension is applied to the timing belt 67. The rotation of the drive pulley 68 by the main-scanning motor 70 moves the timing belt 67 in a main-scanning direction according to a rotation direction of the drive pulley 68.

The carriage 66 is connected to the timing belt 67, and the movement of the timing belt 67 in the main-scanning direction by the drive pulley 68 causes the carriage 66 to reciprocate in the main-scanning direction along the main guide rod 64.

The image forming apparatus 80 includes a cartridge unit 71 and a maintenance unit 72 that are detachably stored at an end portion in the main-scanning direction in the apparatus body housing 81. The cartridge unit 71 includes cartridges 73 that are stored in a replaceable manner, and yellow (Y), magenta (M), cyan (C), and black (K) ink are stored in the respective cartridges 73. Each of the cartridges 73 in the cartridge unit 71 is connected to a recording head having the corresponding color by a pipe out of recording heads mounted on the carriage 66. Accordingly, ink is supplied to the recording heads for the respective colors from the cartridge unit 71 via the pipes.

The image forming apparatus 80 discharges ink to a paper of paper P while moving the carriage 66 in a main-scanning direction, thereby recording an image on the paper P. Herein, the paper P to which ink is discharged is intermittently conveyed in a sub-scanning direction (a direction indicated by the arrow X illustrated in FIG. 1) perpendicular to the main scanning direction on a platen 74 (plate) (see FIG. 2).

The paper P is not limited to a sheet, and various types of things such as a roll-shaped film can be used as paper P. However, in the following description, a sheet being conveyed is referred to as paper P, a roll around which the paper P is wound is referred to as a paper roll Pr (Pa, Pb), and a core tube (a core portion) of the paper roll Pr is referred to as a core tube Ps for the sake of clarity.

The image forming apparatus 80 includes a chamber 75 in which a fan is disposed. As illustrated in FIG. 2, the chamber 75 is disposed below the platen 74. The fan is driven, so that a paper of paper P to be conveyed on the platen 74 is conveyed in close contact with the platen 74.

The image forming apparatus 80 intermittently conveys the paper P in a sub-scanning direction, and discharges ink to the paper P on the platen 74 from a plurality of nozzles forming a nozzle row in a recording head mounted on the carriage 66 while moving the carriage 66 in a main-scanning direction during which the conveyance of the paper P in the sub-scanning direction is being stopped, thereby forming (recording) an image on the paper P.

The maintenance unit 72, for example, cleans an ink discharge surface of the recording head, performs capping, and discharges unnecessary ink to eject the unnecessary ink from the recording head or maintain reliability of the recording head.

The image forming apparatus 80 includes an encoder paper that is not only arranged parallel to the timing belt 67 and the main guide rod 64 but also across at least a movement area of the carriage 66. An encoder sensor that reads the encoder paper is attached to the carriage 66. The image forming apparatus 80 controls driving of the main-scanning motor 70 based on a result of the reading of the encoder paper by the encoder sensor to control the movement of the carriage 66 in the main-scanning direction.

A reflective sensor (an encoder, a paper-leading-end sensing sensor) mounted on the carriage 66 senses both end portions of the paper P conveyed to an image forming unit 60. At that time, a size of the paper P is detected based on a main-scanning direction position that has been read by the paper-leading-end sensing sensor. Herein, the terms "to sense" and "to detect" are used. The terms "to sense" can be used as, for example, to sense an empty spool, to sense a leading end of paper, and to sense a recessed or raised portion. Meanwhile, the term "to detect" can be used as, for example, to detect a gradient in a sensor signal, and to detect an output strength. However, the description of the present disclosure is not limited to these terms. In the following description, the term "to detect" is used for both of "to sense" and "to detect".

As illustrated in FIGS. 1 and 2, the image forming apparatus 80 includes two spool bearing bases 5*a* and 5*b* that are arranged in a vertical direction on the body frame 82 which supports the apparatus body housing 81.

Sheets of paper (roll-shaped sheets) P pulled out from leading ends of respective paper rolls Pr (Pa and Pb) that have been set in the spool bearing bases 5*a* and 5*b* are conveyed as indicated by arrows illustrated in FIG. 2 within respective conveyance paths 9 by conveyance roller pairs 6*a* and 6*b*, a registration roller 10, and a registration pressure roller 17. A controller 100 controls driving devices 7*a*, 7*b* to rotate rollers such as the conveyance roller pairs 6*a* and 6*b*, the registration roller 10, and the registration pressure roller 17. Paper-roll receiving racks 8*a* and 8*b* that prevent the paper rolls Pr (Pa, Pb) from falling are arranged below the paper rolls Pr (Pa, Pb).

The paper P passes the conveyance path 9 supported by members such as medium conveyance guide members 18*a* and 18*b*, and is then conveyed to the platen 74 in the image forming unit 60.

In the image forming unit 60, liquid recording heads discharge droplets of respective colors to the paper P based on image data, so that an image is formed on the paper P. A cutter 76 extending in a sub-scanning direction (a paper width direction) is disposed in an ejection area in a direction in which the paper P on which the image has been formed is conveyed forward. The cutter 76 is used to cut paper P formed of continuous paper in a predetermined length.

The cutter 76 is fixed to wiring or the timing belt stretched between a plurality of pulleys (one of which is connected to a drive motor) to align a leading end of the paper P of the continuous paper conveyed. The cutter 76 is moved in the main-scanning direction Y by the drive motor to cut the paper P in a predetermined length. The paper P which has been cut is ejected to an ejection area. In the configuration example illustrated in FIGS. 1 and 2, the image forming apparatus 80 includes the two spool bearing bases 5*a* and 5*b* in which the paper rolls Pa and Pb can be respectively set. However, the image forming apparatus 80 may include one spool bearing base. In the description above, identifiers a and b (e.g., spool bearing bases 5*a* and 5*b*) are used for components corresponding to the two paper rolls Pa and Pb. However, the identifiers a and b are hereinafter not mentioned unless distinction is necessary.

In the present embodiment, for example, sensor 1*a* and 1*b* can be disposed on respective spool bearing bases 5*a* and 5*b* to detect whether spools have been set. Such a sensor may be referred to as a spool detection sensor. The use of the spool detection sensor 1 can detect whether a paper roll has been set. In addition, the use of the spool detection sensor 1 enables a process such as display of a paper feed screen on a display 170 to be performed if a paper roll is set.

Figure 3A:
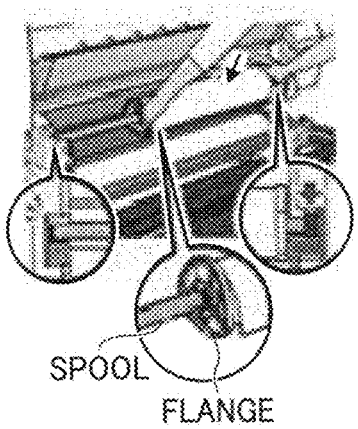
FIGS. 3A through 3E are diagrams illustrating a related-art method for setting a paper roll.
Figure 3B:
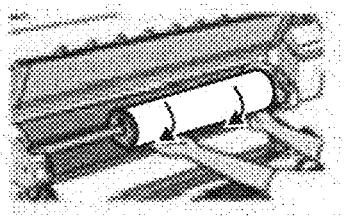
Figure 3C:
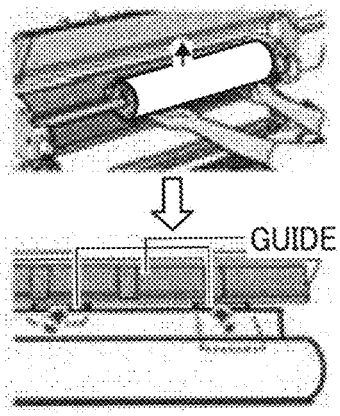

Herein, a related-art method for setting a paper roll is described with reference to FIGS. 3A through 3E. A flange (a flange member) is arranged in an end portion of a paper roll in a width direction, and a spool is set. A user sets the paper roll on which the spool has been set in a paper-feed receiving unit (a spool bearing base) in a device (FIG. 3A), and looks for a leading end of the paper roll. The user holds the leading end of the paper roll with both hands as illustrated in FIG. 3B, and rotates the paper roll such that the leading end is moved to the front while holding the leading end. Subsequently, the user causes the leading end of the paper roll to be positioned between guide plates disposed at the back of the paper roll, and inserts the leading end between the guide plates while rotating the paper roll (FIG. 3C). The guide plates include upper and lower plates of two plates, and each of the guide plates is made of a transparent member so that paper can be seen. The user rotates the paper roll toward the back such that the leading end of the paper roll is provided on an upper portion of the lower guide plate, and inserts the paper-roll leading end into a portion at the back of the guide. Accordingly, the leading end of the paper roll is fixed inside, and is then pulled into the apparatus.

As illustrated in FIG. 3C, since the guide plates between which the paper-roll leading end is to be inserted are arranged at the back of the paper roll, the guide plates are hardly seen as they are hidden by the paper roll. Moreover, although the user intends to insert the paper-roll leading end between the two guide plates, the paper-roll leading end may be positioned on the upper side of the upper guide plate since the guide plates are transparent. In such a case, the user needs to redo the insertion. In a case where guide plates are not transparent, determination of whether a paper-roll leading end is inserted between the two guide plates is not easy. In addition, since a paper-roll leading end needs to be inserted as evenly as possible, the user needs to carefully insert the paper-roll leading end. Furthermore, in a case where a paper-roll leading end is not evenly inserted, the paper-roll leading end is obliquely fed, causing a skew of the paper. Consequently, the operation may be redone, or a paper jam may occur.

Figure 3D:
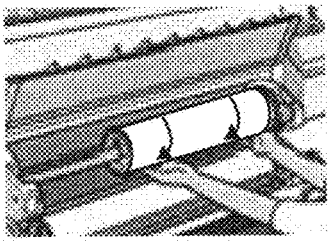
Figure 3E:
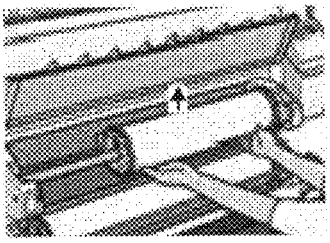

In the device include two stages of paper-roll setting units as illustrated in FIGS. 3D and 3E, in a case where a paper roll is set in the lower stage, and then a leading end of the paper roll is inserted between the guide plates in a state in which a paper roll is already set in the upper stage, it is more difficult to see the guide plates since the paper roll is already set in the upper stage. Such a situation causes setting of the paper roll to be more difficult, and oblique insertion of the paper to occur more easily.

On the other hand, in the paper feeding device 90 having a configuration for detecting a leading end of a paper roll according to one embodiment, a sensor detects a step of the leading end of the paper roll to detect the leading end, and the paper is conveyed to a paper feeding unit. The paper feeding unit feeds paper of a paper roll. The paper feeding unit is, for example, the conveyance roller pair 6 or the conveyance path 9 illustrated in FIG. 2.

Figure 4A:
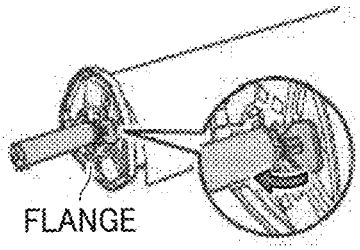
FIGS. 4A through 4F are diagrams illustrating a method for setting a paper roll on a spool.
Figure 4B:
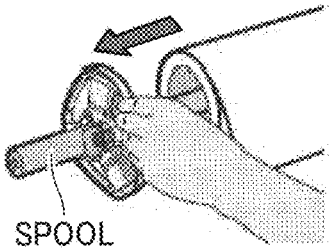
Figure 4C:
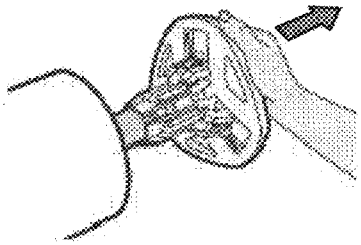
Figure 4D:
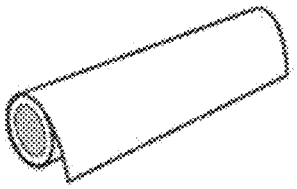
Figure 4E:
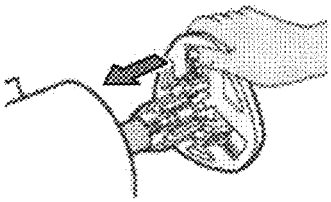
Figure 4F:
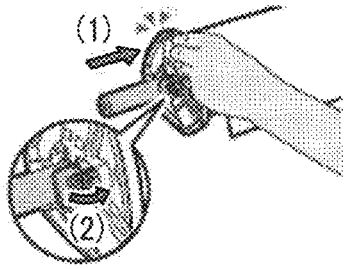

FIGS. 4A through 4F are diagrams illustrating one example of a case in which a paper roll is to be set on a spool. FIGS. 4A through 4C illustrate a case in which an old paper roll is removed, and FIGS. 4D through 4F illustrate a case in which a new paper roll is set. As illustrated in FIGS. 4A through 4C, flanges are arranged on both end portions of a spool. After the flanges are removed, the old paper roll is removed from the spool. Subsequently, as illustrated in FIGS. 4D through 4F, the spool is inserted into the new paper roll, and the flanges are set. More particularly, first, a lock lever of the left flange is raised (FIG. 4A), and the left flange is removed from the spool (FIG. 4B). Then, both of the right flange and the spool are pulled out from the paper roll or a paper tube (FIG. 4C). A new paper roll is ready (FIG. 4D). Then, the flange with the spool is inserted from the right side of the paper roll until the flange touches the paper roll (FIG. 4E). Herein, the paper roll is oriented as illustrated. The flange is slowly inserted with the paper roll being horizontally placed. The paper roll should not be vertically placed to prevent the paper roll from undergoing impact by falling. Lastly, the left flange is slowly inserted ((1) in FIG. 4F) such that impact is not generated, and the lock lever is lowered ((2) in FIG. 4F).

The example case in FIGS. 4A through 4C has been described using the old paper roll. However, in a case where no paper remains, a paper core that had been provided inside the paper roll is removed from the spool. A paper roll has a paper core that is provided inside the paper roll. The paper roll is set in the paper feeding device with a spool inserted inside the paper roll. Moreover, for example, the use of the flanges can rotate the paper roll in response to the rotation of the spool. However, such an example is not limited to the use of the flange.

The spool may be referred to as a spool shaft or simply referred to as a shaft. The spool has, for example, a cylindrical shape the inside of which may or may not be hollow. A configuration of the spool is not particularly limited, and can be selected appropriately. Although the spool is basically not in contact with the paper core, a configuration in which the spool contacts the paper core is not excluded.

Figure 5:
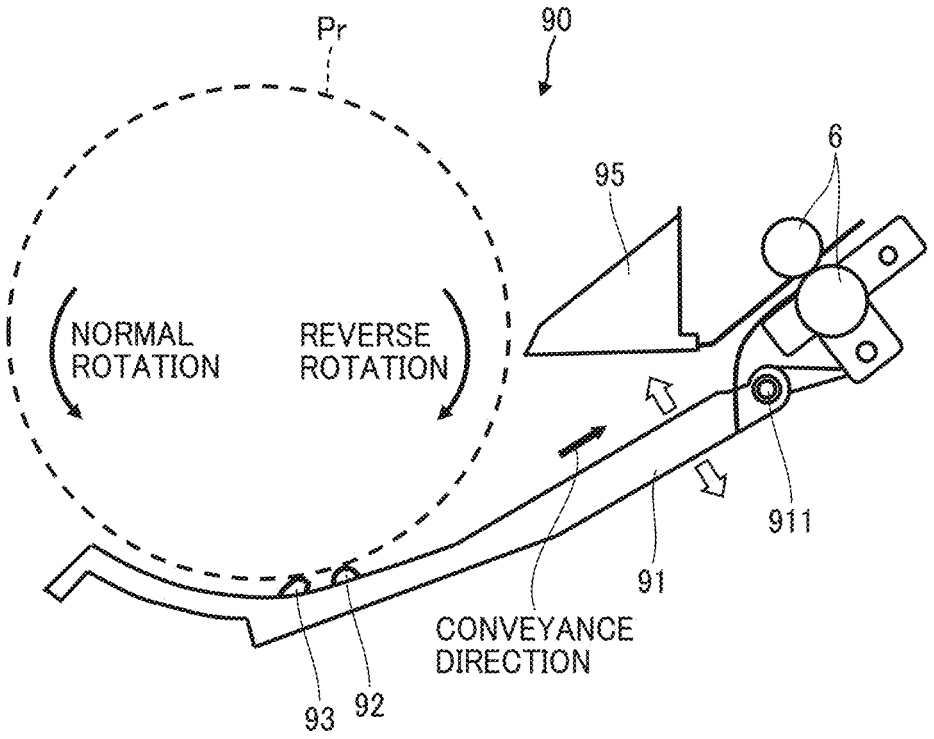
FIG. 5 is a side view illustrating a configuration example of a main portion of a paper feeding device according to one embodiment.

FIG. 5 is a side view illustrating a configuration example of a main portion of the paper feeding device 90 according to one embodiment. The paper feeding device 90 includes at least an arm 91, a roller 92, a sensor 93, and the conveyance roller pair 6 as a conveyance unit. The paper feeding device 90 can also include an inlet guide plate 95. In FIG. 5, a broken line indicates a position of a paper roll Pr when a user sets the paper roll Pr in the paper feeding device 90. The paper roll Pr is rotatably held by a module component with respect to a paper roll center (axis).

The arm 91 (guide plate) serving as a support member for the paper roll Pr is rotatable about a rotation center 911. The arm 91, in one rotation center 911, is pressed toward the paper roll by a spring. Thus, the arm 91 contacts an outer diameter of the paper roll even if a diameter of the paper roll changes. In FIG. 5, an outlined arrow indicates a rotation direction of the arm 91. Moreover, the arm 91, in the other rotation center 911, includes the roller 92 and the sensor 93. Since the arm 91 is pressed toward the paper roll, the roller 92 and the sensor 93 are supported so as to contact a surface of the paper roll Pr.

The arm 91 functions as a guide plate that guides paper of the paper roll Pr in a conveyance direction. The arm 91 has a portion (an end portion side) on which the paper roll Pr is to be set. Such a portion can be formed (e.g., in an arc shape) along an outer diameter of the paper roll Pr, so that the paper roll Pr can be held (prevented from falling) when a user sets the paper roll Pr. The arm 91 also functions as the paper-roll receiving rack 8 illustrated in FIG. 2. The arm 91 as the support member doubles as the guide member for guiding the paper roll, thereby reducing the number of components and preventing an increase in costs.

The roller 92 and the sensor 93 are arranged so as to substantially face the paper roll center (so as to be opposite the axial center of the paper roll) regardless of a diameter of the paper roll. The roller 92 is arranged in a position different from a position of the sensor 93 in a circumferential direction of the paper roll Pr, and the roller 92 and the sensor 93 are arranged to be offset by each other in the circumferential direction of the paper roll Pr. The sensor 93 can detect a step (a paper thickness) of a leading end of the paper roll Pr. Particularly, for example, the sensor 93 has detection accuracy with which a step of a leading end of the paper roll Pr can be detected.

The inlet guide plate 95 guides paper peeled from the paper roll Pr in a conveyance direction. In the configuration example illustrated in FIG. 5, the arm 91 serving as the guide plate guides the paper on an upstream side in the paper conveyance direction at the time of a paper feeding operation (at the time of normal rotation of the paper roll Pr), whereas the inlet guide plate 95 guides the paper on a downstream side.

Figure 6:
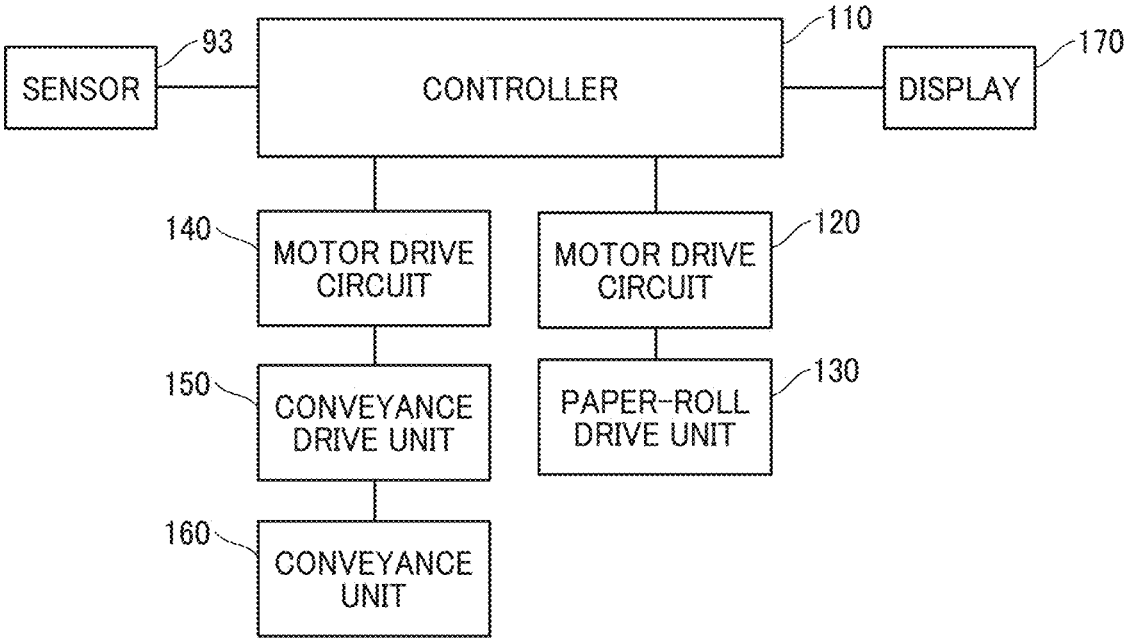
FIG. 6 is a functional block diagram illustrating a functional example of the paper feeding device according to the embodiment.

Next, a description is given of control of functions of the paper feeding device 90. FIG. 6 is a functional block diagram illustrating a functional example of the paper feeding device 90 according to the embodiment. A controller 110 comprehensively controls the paper feeding device 90. Although FIG. 6 illustrates a functional block example in which the controller 110 controls the sensor 93, motor drive circuits 120 and 140, and the display 170, other functional blocks are omitted. A function of the controller 110 may be executed by the controller 100 (see FIG. 2) that comprehensively controls the image forming apparatus 80.

The controller 110 includes, for example, a central processing unit (CPU), a random access memory (RAM), and a read only memory (ROM). The CPU executes various programs to perform a calculation process and to comprehensively control the paper feeding device 90 based on a control program. The RAM is a volatile recording medium so that information is read from and written in the RAM. The RAM functions as a work area when the CPU executes a program. The ROM is a non-volatile read only recording medium in which various programs and control programs are stored.

The motor drive circuit 120 drives a motor based on the control by the controller 110 to drive a paper-roll drive unit 130. The paper-roll drive unit 130 rotates the paper roll in a normal direction or a reverse direction. An example of the paper-roll drive unit 130 is a paper-roll rotation motor. The motor drive circuit 140 drives a motor based on the control by the controller 110 to drive a conveyance drive unit 150. The conveyance drive unit 150 drives a conveyance unit 160 that conveys paper. The conveyance unit 160 corresponds to, for example, the conveyance roller pair 6. The display 170 displays an operation state of the paper feeding device 90.

Figure 7A:
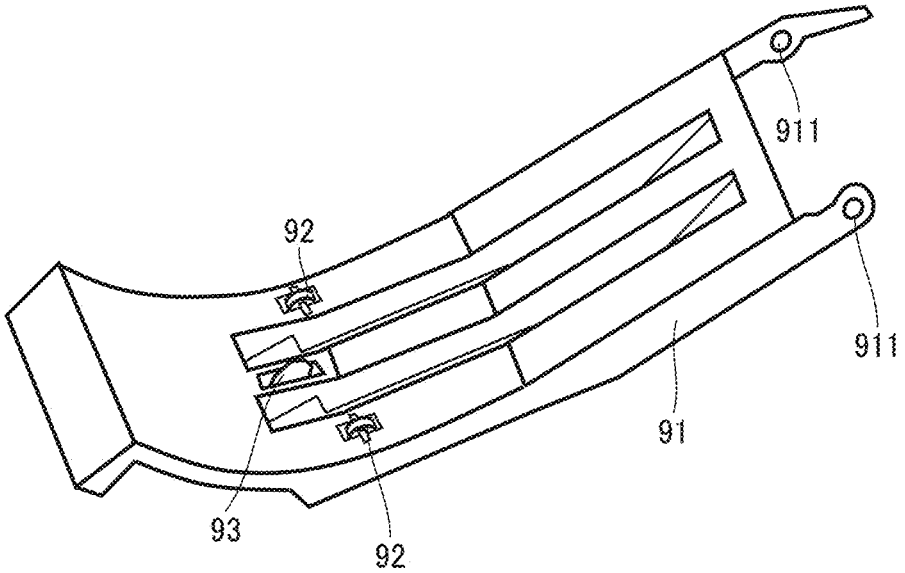
FIGS. 7A through 7C are diagrams illustrating configuration examples of an arm and a sensor according to the embodiment.
Figure 7B:
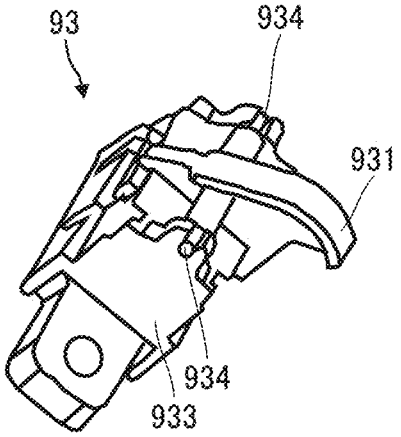
Figure 7C:
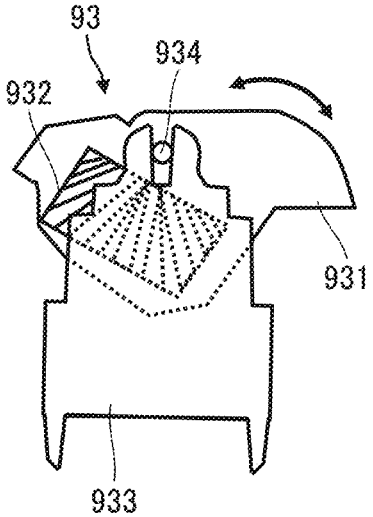

Next, a configuration example of the arm 91 as a support member and an example of a leading end detection operation are described. FIGS. 7A through 7C illustrate a configuration example of the arm 91 according to the embodiment. FIG. 7A is a perspective view illustrating one example of the arm 91, FIG. 7B is a schematic view illustrating the sensor 93, and FIG. 7C is a side view illustrating one example of a side plate and an actuator 931 of the sensor 93.

The arm 91 is arranged such that the roller 92 and the sensor 93 are respectively arranged on an upstream side and a downstream side in a paper conveyance direction in an operation (reverse rotation) in which the sensor 93 detects a leading end of the paper roll.

As for the sensor 93, for example, an encoder sensor in which slits 932 are arranged in the actuator 931 is used. The sensor 93 can also be referred to a leading end detection sensor. The actuator 931 is arranged between two side plates 933 that form a casing of the sensor 93, and a shaft 934 is fitted into bearings of the side plates 933. Thus, the actuator 931 is rotated about the shaft 934. For example, the actuator 931 has a shape that is asymmetric about the shaft 934, as illustrated in FIG. 7C.

The sensor 93 includes a light emitting unit and a light receiving unit. The sensor 93 counts the number of light beams that pass the slits 932 of the actuator 931 to detect a leading end of the paper roll Pr (i.e., the number of signal waveforms are counted). The light beams herein are light from light emitting unit to the light receiving unit. The sensor 93 has, for example, a resolution of about 5 m/pulse, so that a step in an amount of paper thickness can be detected.

In the configuration example illustrated in FIGS. 7A through 7C, two rollers 92 are arranged, and the sensor 93 is arranged between the two rollers 92. Such arrangement of the sensor 93 between the rollers 92 can reliably press lifting of a leading end of the paper roll. Thus, the leading end can be reliably detected without instability of an output of the sensor 93 due to paper thickness, paper elasticity, or paper curling. The leading end of the paper roll may have partial damage such as a scratch. Even in such a case, since the roller 92 and the sensor 93 are displaced from each other in the circumferential direction, the scratch is less likely to be caught in both of the roller 92 and the sensor 93, and thus false detection does not tend to occur. In the following description, two or more rollers 92 can be referred to as a roller unit 92.

Figure 8A:
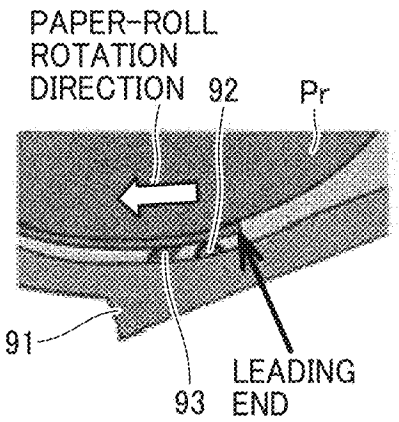
FIGS. 8A through 8C are diagrams illustrating an operation example in which a leading end of a paper roll is detected.
Figure 8B:
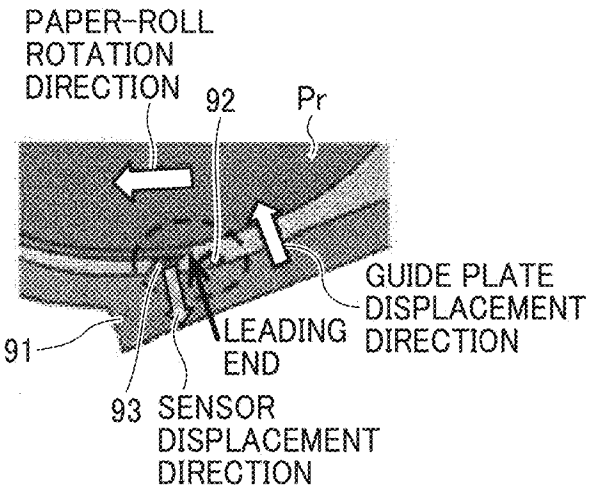
Figure 8C:
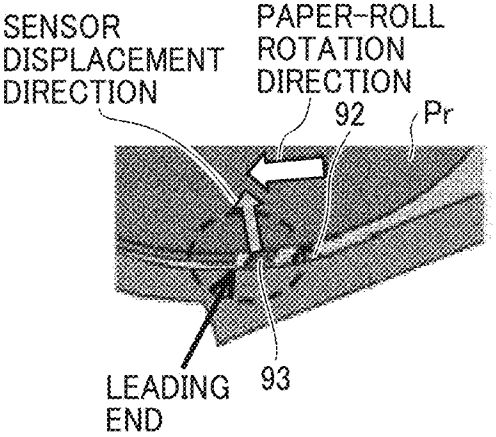
Figure 9A:
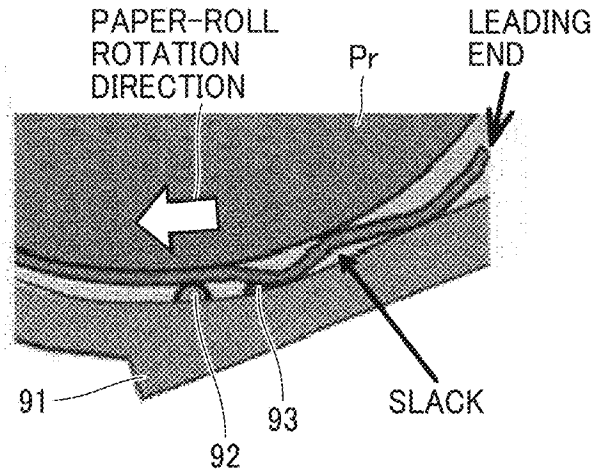
FIGS. 9A and 9B are diagrams illustrating differences that depend on relative positions of a roller and a sensor.
Figure 9B:
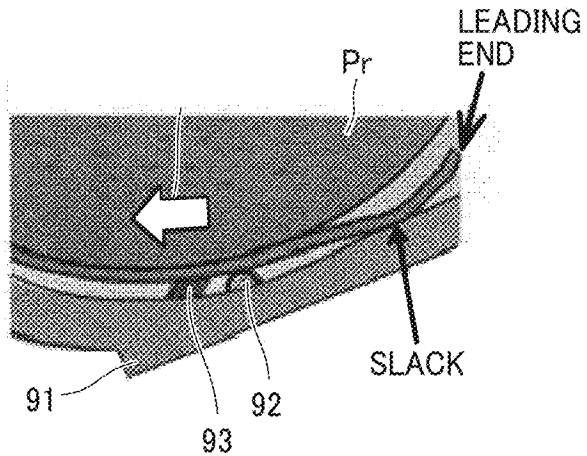

FIGS. 8A through 8C are diagrams illustrating an operation example in which a leading end of a paper roll Pr is detected. FIGS. 9A and 9B are diagram illustrating differences that depend on relative positions of the roller 92 and the sensor 93. FIGS. 8A through 8C illustrate a process in which a leading end of the paper roll Pr passes the roller 92 and the sensor 93. FIG. 8A illustrates a state before the leading end of the paper roll Pr passes the roller 92, and FIG. 8B illustrates a state in which the leading end of the paper roll Pr has passed the roller 92 but before passing the sensor 93. FIG. 8C illustrates a state in which the leading end of the paper roll Pr has passed the sensor 93. FIG. 9A illustrates a case in which the roller 92 is arranged on a downstream side with reference to the sensor 93 in a leading-end detection operation, whereas FIG. 9B illustrates a case in which the roller 92 is arranged on an upstream side with respect to the sensor 93 in a leading-end detection operation. FIGS. 9A and 9B illustrate differences in generation of slack in the paper.

The sensor 93 and the roller 92 are arranged to be offset in the vicinity of each other (offset in a circumferential direction of the paper roll). Since the roller 92 is arranged upstream of the sensor 93, the roller 92 can press a leading end of the paper roll Pr until immediately before detection of the leading end of the paper roll Pr by the sensor 93 (FIG. 9B). Accordingly, as illustrated in FIG. 9B, the sensor 93 can detect a step (paper thickness) of a surface of the paper roll Pr as a leading end in a state in which the leading end closely contacts the surface of the paper roll Pr. Thus, the sensor 93 can reliably detect the leading end of the paper roll Pr without instability of an output of the sensor 93 (a detection result provided by the sensor 93) due to paper thickness, paper elasticity, or paper curling.

Although the roller 92 is arranged upstream of the sensor 93 in the example according to the present embodiment, a paper-roll leading end can be detected even if the roller 92 is arranged downstream of the sensor 93 (FIG. 9A). However, the upstream arrangement of the roller 92 with respect to the sensor 93 is more preferred since the roller 92 can be pressed against lifting of the paper-roll leading end until immediately before detection of the paper-roll leading end. In addition, the arrangement of the sensor 93 between the two rollers 92 as illustrated in FIGS. 7A through 7C can more reliably press lifting of the leading of the paper roll than a case in which a single roller 92 is arranged.

Figure 10A:
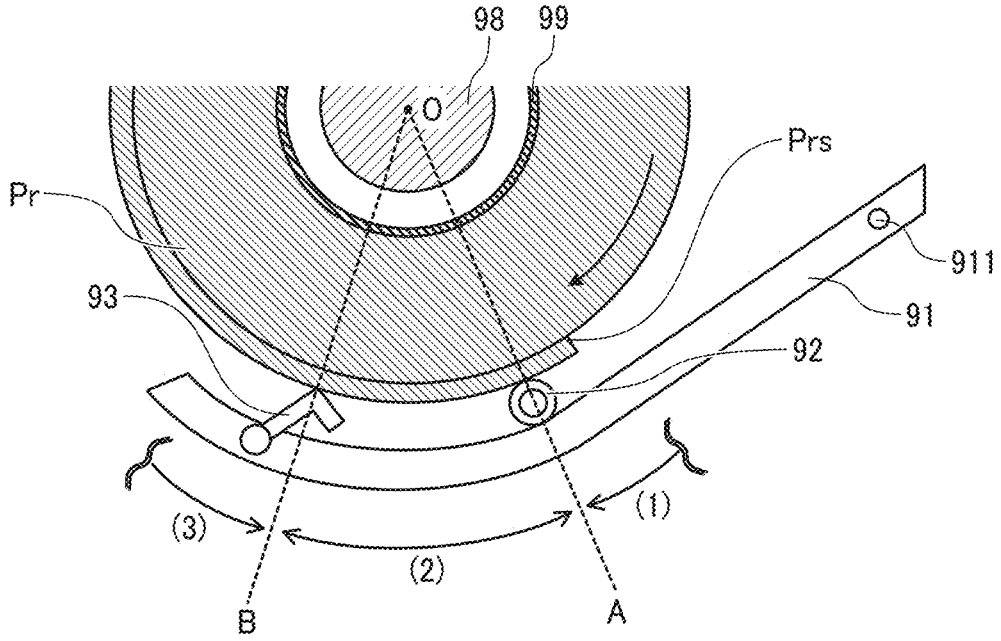
FIG. 10A is a diagram illustrating one example of relative positions of a roller, a sensor, and a paper-roll leading end.
Figure 10B:
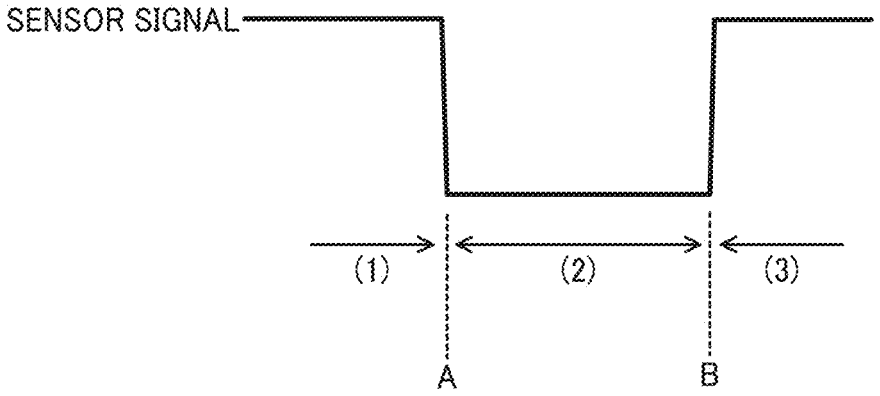
FIG. 10B is a diagram illustrating one example of a sensor signal waveform.

Next, one example of a signal to be acquired by the sensor 93 is described. FIG. 10A is a diagram illustrating relative positions of the roller 92 and the sensor 93, the arm 91 on which the roller 92 and the sensor 93 are arranged, and a paper-roll leading end Prs. FIG. 10B illustrates one example of a signal waveform acquired by the sensor 93 illustrated in FIG. 10A.

In the example illustrated in FIG. 10A, the roller 92 and the sensor 93 are arranged in different positions in a circumferential direction of the paper roll Pr, and the roller 92 and the sensor 93 are arranged to be offset by each other in the circumferential direction of the paper roll, as similar to FIGS. 4A through 4F and 8A through 8C. In FIG. 10A, the axial center (a rotation axis) of the spool 98 is indicated by a reference letter O, and the roller 92 and the sensor 93 are arranged toward the axial center of the spool 98. Moreover, in a leading end detection operation, the roller 92 is arranged on an upstream side with respect to the sensor 93.

In FIG. 10A, areas (1) through (3) are divided based on a position of the paper-roll leading end Prs. The area (1) is an area where the paper-roll leading end Prs is present on an upstream side with respect to the roller 92. The area (2) is an area where the paper-roll leading end Prs is present on a downstream side with respect to the roller 92 and an upstream side with respect to the sensor 93. The area (3) is an area where the paper-roll leading end Prs is present on a downstream side with respect to the sensor 93.

As illustrated in FIG. 10B, a value of a sensor signal changes when a position of the paper-roll leading end Prs is moved from the area (1) to the area (2), and a value of the sensor signal changes when a position of the paper-roll leading end Prs is changed from the area (2) to the area (3). In the example illustrated herein, the value of the sensor signal in the area (1) and the value of the sensor signal in the area (3) are the same or close to each other.

Figure 11A:
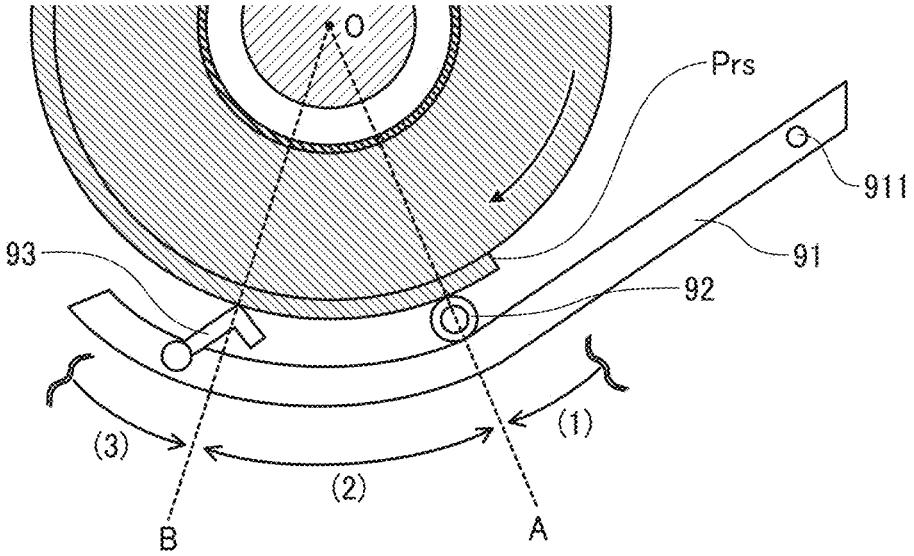
FIGS. 11A through 11C are diagrams illustrating one example of movements of a roller, a sensor, and an arm in a case where a position of a paper-roll leading end is changed.

Next, generation of a signal waveform as illustrated in FIG. 10B is described with reference to FIGS. 11A through 11C that illustrate one example of movements of the roller 92, the sensor 93, and the arm 91 in a case where a position of the paper-roll leading end Prs is changed. FIG. 11A illustrates an example in which the paper-roll leading end Prs is moving in the area (1) as similar to the example illustrated in FIG. 10A. In the area (1), a sensor signal does not change and remains constant or substantially constant.

Figure 11B:
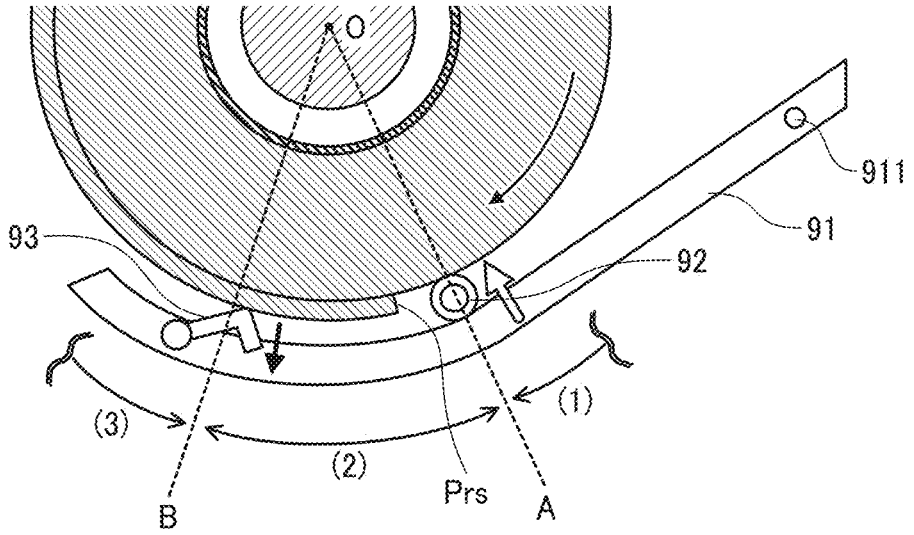

FIG. 11B illustrates an example in which the paper-roll leading end Prs is moving in the area (2). When the paper-roll leading end Prs is moved beyond the area (1), in other words, when the paper-roll leading end Prs passes the roller 92, the arm 91 is rotated toward the paper roll Pr by an amount of paper thickness of the paper roll Pr. Such a situation is schematically illustrated using a white arrow in FIG. 11B. The rotation of the arm 91 toward the paper roll Pr shortens a distance between the arm 91 and the paper roll Pr, and the sensor 93 is changed by an amount of the shortened distance. Such a situation is schematically illustrated using a black arrow in FIG. 11B. Such a change in the sensor 93 can be expressed that a distance between a root portion (a circle portion illustrated in FIG. 11B) of the sensor 93 and the paper roll Pr is shortened, or that an angle of a detection portion (an L-shaped portion illustrated in FIG. 11B) of the sensor 93 is changed (decreased). Thus, in the area (2), a value of a sensor signal becomes small as illustrated in FIG. 10B. However, a signal waveform in which a value of a sensor signal becomes large can be provided depending on a type of sensor. Moreover, in the area (2), when the rotation of the arm 91 stops, a sensor signal becomes constant or substantially constant up to the area (3).

Figure 11C:
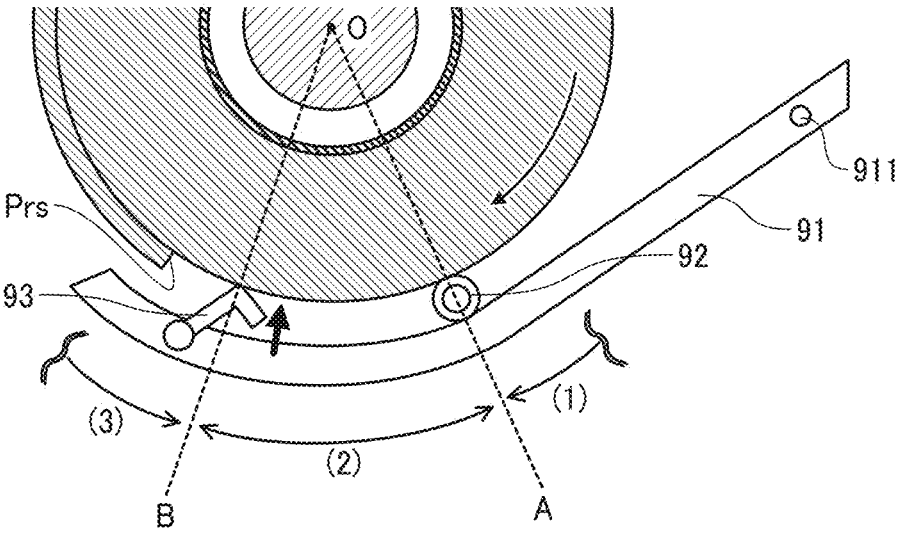

FIG. 11C illustrates an example in which the paper-roll leading end Prs is moving in the area (3). When the paper-roll leading end Prs is moved beyond the area (2), in other words, when the paper-roll leading end Prs passes the sensor 93, an angle of a detection portion (an L-shaped portion illustrated in FIG. 11C) of the sensor 93 increases by an amount of paper thickness of the paper roll Pr. Such a state is schematically illustrated using a black arrow in FIG. 11C. In the area (3), since the arm 91 is not rotated, a distance between a root portion (a circle portion in FIG. 11C) of the sensor 93 and the paper roll Pr does not change. The sensor 93 in the area (3) has a shape similar to a shape of the sensor 93 in the area (1). That is, it can be expressed that a distance between the paper roll Pr and the sensor 93 in the area (1) is the same as a distance between the paper roll Pr and the sensor 93 in the area (3). Thus, as illustrated in FIG. 10B, a value of the sensor signal in the area (3) and a value of the sensor signal in the area (1) are similar or close to each other.

Figure 12:
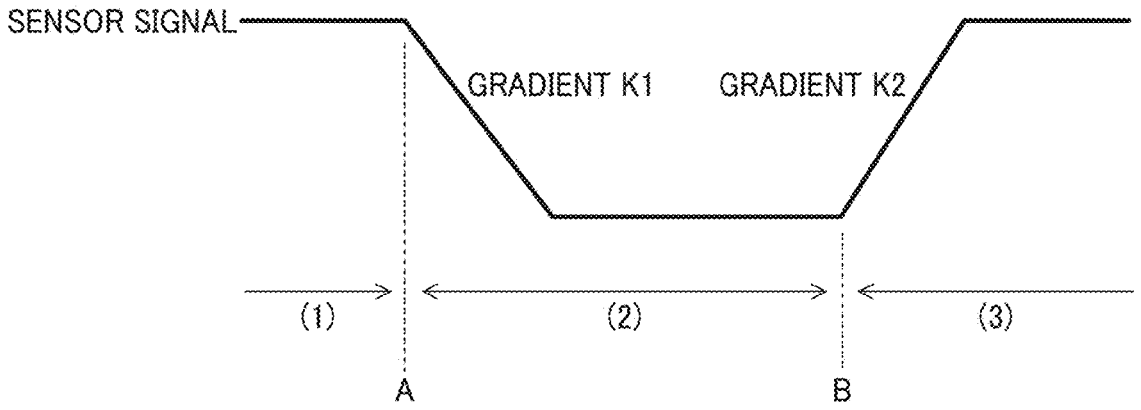
FIG. 12 is a diagram illustrating one example of the waveform of the sensor signal in FIG. 10B.

Next, a waveform of the sensor signal illustrated in FIG. 10B is described in detail. FIG. 12 is a diagram illustrating a boundary of the areas (1) through (3) for the waveform of the sensor signal illustrated in FIG. 10B. As illustrated in FIG. 12, a waveform of the sensor signal has gradients in a boundary between the areas (1) and (2) and a boundary between the areas (2) and (3). In each of the boundaries between the areas as illustrated in FIG. 12, a value of the sensor signal continuously changes, instead of a discontinuous change.

In the present embodiment, the presence or absence of a leading end of the paper roll can be detected based on detection of gradients K1 and K2 of the graph illustrated in FIG. 12. The gradient K1 of the graph represents a change in output strength of a sensor signal, with respect time, when a paper-roll leading end passes the roller 92. The gradient K2 of the graph represents a change in output strength of a sensor signal, with respect time, when the paper-roll leading end passes the sensor 93. In other words, as illustrated in FIG. 12, the gradient K1 of the sensor signal when a paper-roll leading end Prs is moved from the area (1) to the area (2) and the gradient K2 of the sensor signal when the paper-roll leading end Prs is moved from the area (2) to the area (3) are detected, so that the paper-roll leading end Prs can be detected.

As for the graph in FIG. 12, a change in output strength of the sensor signal with respect to time is illustrated. However, a change in output strength of the sensor signal with respect to distance can be illustrated. A gradient of the graph indicating a change in output strength of the sensor signal with respect to time can be simply expressed as a gradient of the sensor signal for the sake of simplicity.

Herein, a gradient of the sensor signal when a paper-roll leading end passes the roller 92 is referred to as the gradient K1, whereas a gradient of the sensor signal when the paper-roll leading end passes the sensor 93 is referred to as the gradient K2. In the example described here, the gradient K1 is a negative value and the gradient K2 is a positive value. However, the gradients K1 and K2 are not limited thereto. As described below, the gradient K1 may a positive value, and the gradient K2 may be a negative value, depending on a type of the sensor.

In the waveform of the sensor signal illustrated in FIG. 12, the sensor signal has a gradient. Such a sensor signal having a gradient is described with reference to FIGS. 13A through 15D. FIGS. 13A through 13D are diagrams illustrating movement of a paper-roll leading end Prs in a time series from when the paper-roll leading end Prs reaches a position indicated by a broken line A illustrated in FIG. 11A, that is, when the paper-roll leading end Prs reaches a position of the roller 92, to when the paper-roll leading end Prs is moved to a position B illustrated in FIG. 11B. In other words, FIGS. 13A through 13D are diagrams illustrating a case in which the paper-roll leading end Prs reaches an end portion of the area (1) and then moves to the area (2).

As illustrated in FIGS. 13A through 13D, when the paper-roll leading end Prs passes the roller 92, a distance between the roll-paper leading end Prs and the roller 92 gradually changes with rotation of the roller 92. When the paper-roll leading end Prs passes the roller 92, for example, a distance between the paper roll Pr and the roller 92 is changed from a distance illustrated in FIG. 13A to a distance illustrated in FIG. 13D via distances illustrated in FIGS. 13B and 13C. Accordingly, the arm 91 is rotated, for example, a state illustrated in FIG. 13A to a state illustrated in FIG. 13D via states illustrated in FIGS. 13B and 13C. The movement of the roller 92 and the arm 91 are schematically indicated by a white arrow.

Figure 13A:
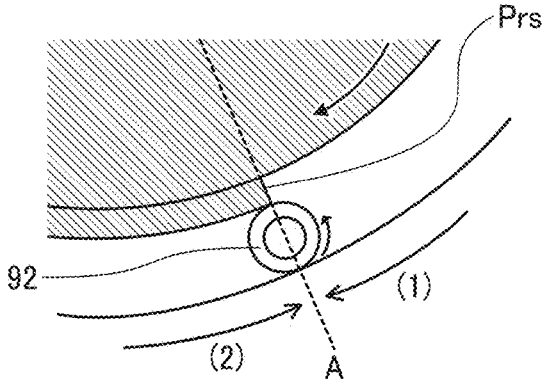
FIGS. 13A through 13D are diagrams illustrating one example of movements of the roller and the arm in a case where a position of the paper-roll leading end is changed.
Figure 13B:
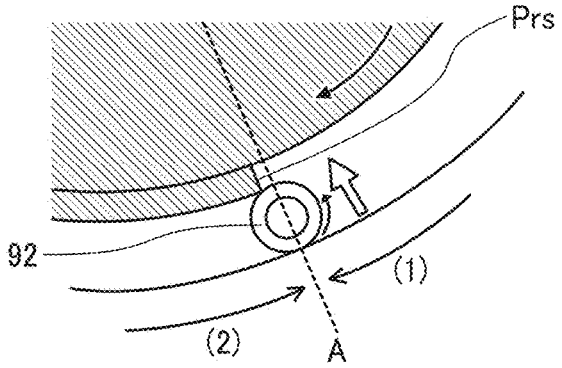
Figure 13C:
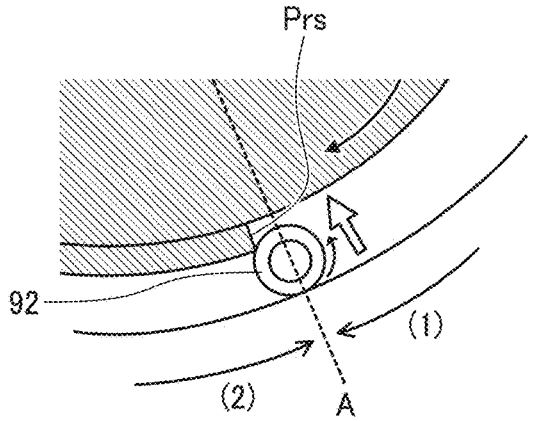
Figure 13D:
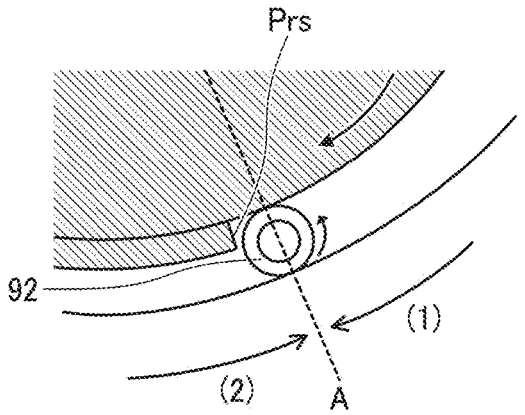
Figure 14A:
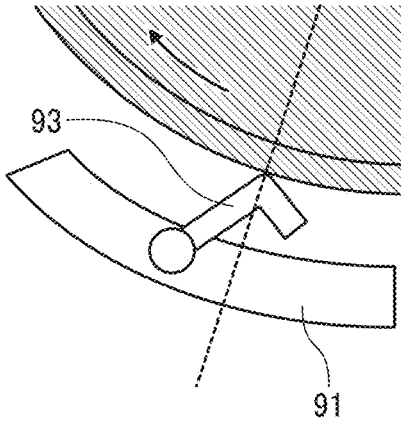
FIGS. 14A through 14D are diagrams illustrating one example of a movement of the sensor in a case where a position of the paper-roll leading end is changed as illustrated in FIGS. 13A through 13D.
Figure 14B:
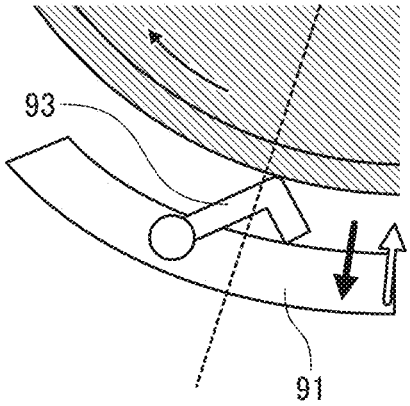
Figure 14C:
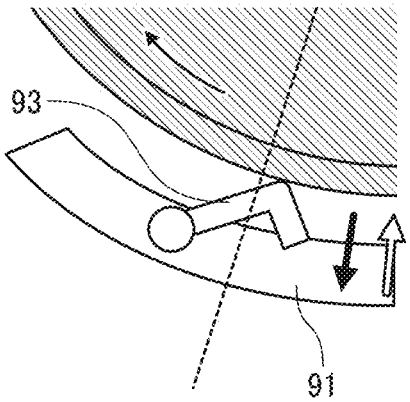
Figure 14D:
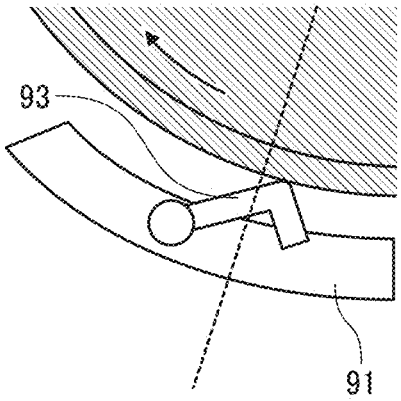

The movement of the sensor 93 herein is illustrated in FIGS. 14A through 14D corresponding to FIGS. 13A through 13D. FIGS. 14A through 14D and FIGS. 13A through 13D are in the same time series. Since the arm 91 moves as illustrated in FIGS. 13A though 13D, a state of the sensor 93 gradually changes, for example, from a state illustrated in FIG. 14A to a state illustrated in FIG. 14D via states illustrated in FIGS. 14B and 14C. For example, it can be expressed that a distance between a root portion (a circle portion in each of FIGS. 14A through 14C) of the sensor 93 and the paper roll Pr is gradually reduced, or an angle of a detection portion (an L-shaped portion in each of FIGS. 14A through 14C) of the sensor 93 is gradually decreased. Accordingly, when the paper-roll leading end Prs passes the roller 92, a sensor signal has the gradient K1 as illustrated in FIG. 12.

Figure 15A:
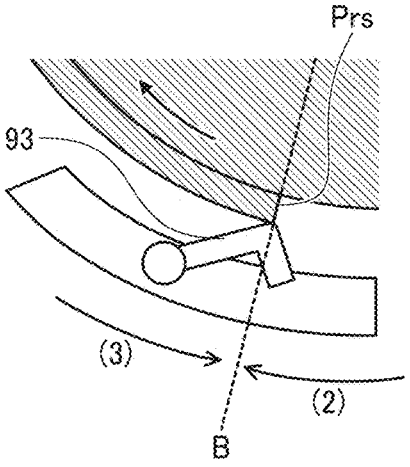
FIGS. 15A through 15D are diagrams illustrating one example of a movement of the sensor in a case where a position of the paper-roll leading end is changed from FIGS. 14A through 14D.

FIGS. 15A through 15D are diagrams illustrating movement of the paper-roll leading end Prs in a time series from when the paper-roll leading end Prs reaches a position indicated by a broken line B illustrated in FIG. 11B, that is, when the paper-roll leading end Prs reaches a position of the sensor 93, to when the paper-roll leading end Prs is moved to a position illustrated in FIG. 11C. In other words, FIGS. 15A through 15D are diagrams illustrating a case in which the paper-roll leading end Prs reaches an end portion of the area (2) and then moves to the area (3). FIG. 15A is a diagram illustrating a state after the state illustrated in FIG. 14D.

Although positions of the broken lines B illustrated in FIGS. 11A through 11C and positions of the broken lines B illustrated in FIGS. 15A through 15D slightly differ from each other, a result is not affected. The broken line B illustrated in each of FIGS. 11A through 11C represents a line passing through a contact point of the sensor 93 in a case where the paper-roll leading end Prs is positioned in the area (1), whereas the broken line B illustrated in each of FIGS. 15A through 15D represents a line passing through a contact point of the sensor 93 in a case where the paper-roll leading end Prs is positioned in the area (2).

Figure 15B:
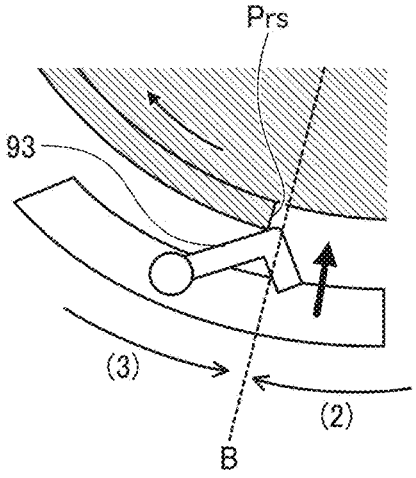
Figure 15C:
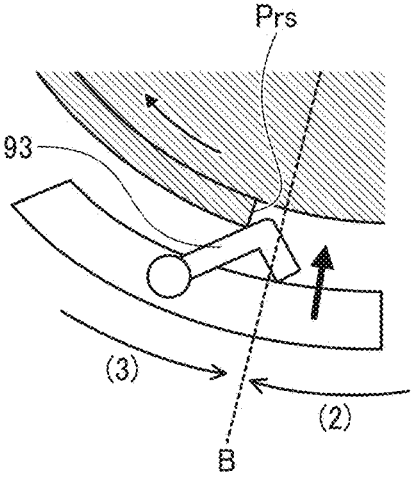
Figure 15D:
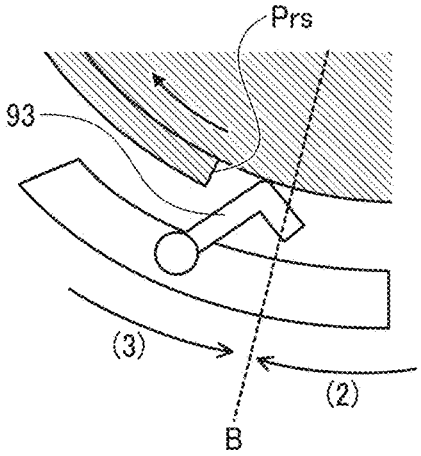

As illustrated in FIGS. 15A through 15D, when the paper-roll leading end Prs passes the sensor 93, a state of the sensor 93 gradually changes, for example, from a state illustrated in FIG. 15A to a state illustrated in FIG. 15D via states illustrated in FIGS. 15B and 15C. Accordingly, when the paper-roll leading end Prs passes the sensor 93, the sensor signal has the gradient K2 as illustrated in FIG. 12. Since the sensor 93 according to the present embodiment has detection accuracy with which a step of a paper-roll leading end can be detected, the sensor 93 can detect the gradients K1 and K2.

Figure 16:
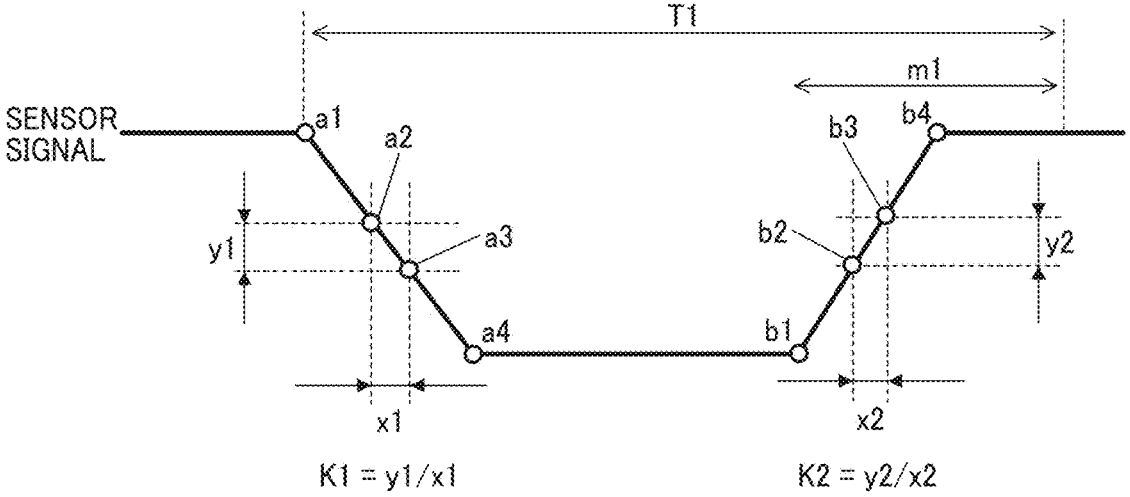
FIG. 16 is a diagram illustrating a detail of the sensor signal waveform illustrated in FIG. 12.

Next, the sensor signal illustrated in FIG. 12 is described in detail with reference to FIG. 16. FIG. 16 is a diagram that is addition of description to the diagram illustrated in FIG. 12. In an example illustrated in FIG. 16, a sensor signal is changed from a point a1 to a point a4 when the paper-roll leading end Prs passes the roller 92. Herein, optional points a2 and a3 between the points a1 and a4 are selected, so that a gradient K1 can be determined. For example, a sensor signal may be changed from the point a2 to the point a3 by x1 and y1, where x is a horizontal axis and y is a vertical axis in FIG. 16. A gradient in such a case is a gradient K1 that is determined by $K1=y1/x1$. The gradient K1 is not particularly limited. If a value of the gradient K1 falls within a predetermined range, it may be conceivable that a gradient is detected. Alternatively, a plurality of points may be selected to determine a plurality of gradients, and then an average may be calculated as a gradient.

In the example illustrated in FIG. 16, the sensor signal is changed from a point b1 to a point b4 when the paper-roll leading end Prs passes the sensor 93. Herein, optional points b2 and b3 between the points b1 and b4 are selected, so that a gradient K2 can be determined. For example, a sensor signal may be changed from the point b2 to the point b3 by x2 and y2, where x is a horizontal axis and y is a vertical axis in FIG. 16. A gradient in such a case is a gradient K2 that is determined by $K2=y2/x2$. As similar to the above, the gradient K2 is not particularly limited. If a value of the gradient K2 falls within a predetermined range, it may be conceivable that a gradient is detected. Alternatively, a plurality of points may be selected to determine a plurality of gradients, and then an average may be calculated as a gradient. In the example illustrated in FIG. 16, signs of the gradients K1 and K2 are opposite to each other.

Accordingly, the gradient K1 of the sensor signal when the paper-roll leading end passes the roller 92 and the gradient K2 of the sensor signal when the paper-roll leading end passes the sensor 93 are detected, so that the presence or absence of the paper-roll leading end can be detected. In the present embodiment, moreover, detection of both the gradients K1 and K2 can enhance accuracy in detecting the presence or absence of the paper-roll leading end.

As illustrated in FIG. 16, the gradient K1 of the sensor signal when the paper-roll leading end passes the roller 92 and the gradient K2 of the sensor signal when the paper-roll leading end passes the sensor 93 are preferably detected within a predetermined time T1. In this case, false detection due to roughness on a surface of the paper roll can be reduced. The time T1 can be selected appropriately. However, the time T1 can be preferably set as follows.

$$T1=L/V+m1 \text{ [s]},$$

where L (mm) is a circumferential distance from the roller 92 to the sensor 93, V (mm/s) is a leaner velocity of the paper-roll leading end, and m1 (s) is a setting margin time. Accordingly, not only false detection due to roughness on a surface of the paper roll can be reduced, but also omission of detection of the paper-roll leading end can be reduced.

In a case where a paper-roll leading end is not detected although a paper roll or a spool has made one rotation since the beginning of the leading-end detection operation, the paper roll or the spool is preferably rotated more to repeat the detection operation. Accordingly, detection accuracy can be further enhanced. In this case, the number of times to repeat the detection operation is preferably set. Such setting can prevent the detection operation from being continuously repeated.

As expressed in the above equation, the time T1 can be optionally set. Moreover, the setting margin time m1 (s) is not particularly limited, and can be set appropriately. For example, the setting margin time m1 can be set in consideration of a sensor type and a paper thickness of a paper roll. However, a relation between the setting margin time m1 and the time T1 is m1<T1.

In the present embodiment, determination of whether a paper-roll leading end is present is made by, for example, the controller 110. As described below, in addition to the determination of the presence or absence of the paper-roll leading end, the controller 110 may detect a position of the paper-roll leading end. A position of the paper-roll leading end in such a case is a position of the paper roll in a circumferential direction.

In the detection example described above, the presence of the paper-roll leading end is determined if the gradients K1 and K2 are detected within the predetermined time T1. However, the present embodiment is not limited thereto. As described below, a paper roll or a spool is made multiple rotations to repeat a detection operation. Thus, even if a gradient K1 or K2 in an nth rotation of the paper roll or the spool is not detected, the presence of a paper-roll leading end can be determined if a gradient K1 or K2 in an n+1th rotation of the paper or the spool is detected.

Figure 17:
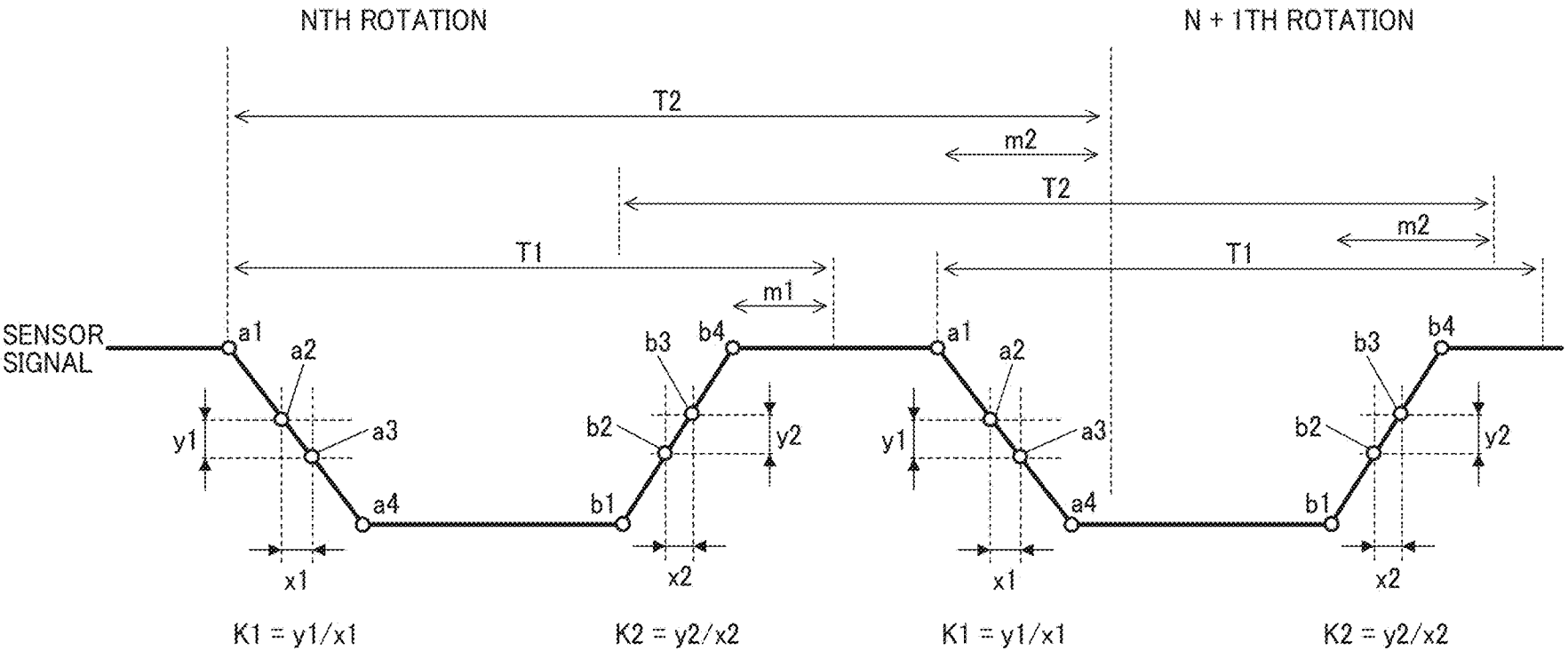
FIG. 17 is a diagram illustrating one example of a sensor signal waveform in a case where a detection operation is repeated.

The sensor signal illustrated in FIG. 12 is described in detail with reference to FIG. 17 that illustrates an example in which a paper roll or a spool is made multiple rotations to repeat a detection operation. In FIG. 17, a signal waveform in an nth rotation of the paper roll or the spool and a signal waveform in an n+1th rotation of the paper roll or the spool are illustrated, where n is an integer of 1 or greater, for example, n is 1.

In the aforementioned detection example, the presence of the paper-roll leading end is determined if the gradients K1 and K2 are detected within the time T1 in an nth rotation. For example, if two or more rollers 92 are disposed in a roll axial direction as illustrated in FIG. 7A, the gradient K1 or K2 does not tend to be detected in a state in which a paper leading end has been cut diagonally.

In the example herein, after gradients K1 and K2 are detected, determination of whether the gradient K1 is detected again within a predetermined time T2 is made. If the gradient K1 is detected again, the presence of a paper-roll leading end can be determined. Thus, detection accuracy can be further enhanced. The predetermined time T2 (s) is time acquired by addition of a setting margin time m2 (s) to time for one rotation of a paper roll or a spool. For example, if a gradient K1 is detected in an nth rotation of the paper roll or the spool, determination of whether the gradient K1 is detected in an n+1th rotation is made.

Similarly, atter the gradients K1 and K2 are detected, determination of whether the gradient K2 is detected again within a predetermined time T2 is made. If the gradient K2 is detected again, the presence of the paper-roll leading end can be determined. Accordingly, detection accuracy can be further enhanced. The gradient K1 may not tend to be detected. In such a case, determination of whether the gradient K2 is detected again within the predetermined time T2 after detection of the gradient K2 is preferably made.

Particularly, after detection of the gradients K1 and K2 is repeated multiple times, the determination of whether the gradient K1 or K2 is detected again within the predetermined time T2 is more preferably made. In this case, detection accuracy can be further enhanced.

Such examples are processes that are performed in steps S21 through S25, S28, and S29 in the flowchart described below with reference to FIG. 19.

The setting margin time m2 (s) is not particularly limited, and can be selected appropriately. Similar to the aforementioned setting margin time m1, the setting margin time m2 can be set in consideration of, for example, a paper thickness of the paper roll and a type of the sensor. However, a relation between the setting margin time m2 and the predetermined time T2 is m2<T2.

A supplemental description is given of the determination of whether the gradient K1 is detected even in an n+1th rotation of the paper roll or the spool if the gradient K1 is detected in an nth rotation of the paper roll or the spool. For example, if a gradient is detected in an nth rotation of the paper roll or the spool and the detected gradient is a predetermined value or more, it can be determined that a gradient K1 is detected. Similarly, in an n+1th rotation of the paper roll or the spool, if a gradient is detected and the detected gradient is a predetermined value or more, it can be determined that the gradient K1 is detected. The predetermined value used herein can be selected appropriately. For example, if a detected gradient has an absolute value of 4 or greater, it can be determined that the gradient K1 is detected. It is conceivable that the gradient K1 is detected again within the predetermined time T2 after the gradient K1 is detected. Similarly, as for the gradient K2, if a detected gradient has an absolute value of a predetermined value or more, it can be determined that the gradient K2 is detected. For the gradient K2, before determination of the absolute value, a sign of the gradient is checked to determine that the sign differs from a sign of the gradient K1.

The determination of whether the gradient K1 is detected again within the predetermined time T2 after detection of the gradient K1 can be made using a method for examining a gradient ratio, in addition to the above description. If a gradient K1 in an nth rotation of the paper roll or the spool is set to K1 (n) and a gradient K1 in an n+1th rotation is set to K1 (n+1), K1 (n) and K1 (n+1) may not be precisely equal. It can be conceivable that the gradient K1 is detected again within the predetermined time T2 after detection of the gradient K1 as long as a ratio of K1 (n) to K1 (n+1) falls within a predetermined range. Although there may be an exception, it can be conceivable that K1 (n) and K1 (n+1) are substantially equal if, for example, K1 (n)/K1 (n+1) is 1.0 or more and 1.2 or less where K1 (n)≥K1 (n+1). It can be conceivable that K1 (n) and K1 (n+1) are substantially equal if K1 (n)/K1 (n+1) is 0.8 or more and less than 1.0 where K1 (n)<K1 (n+1). The same applies to the gradient K2. It can be conceivable that K2 (n) and K2 (n+1) are substantially equal if K2 (n)/K2 (n+1) is 1.0 or more and 1.2 or less where K2 (n)≥K2 (n+1). It can be conceivable that K2 (n) and K2 (n+1) are substantially qual if K2 (n)/K2 (n+1) is 0.8 or more and less than 1.0 where K2 (n)<K2 (n+1).

In the present embodiment, even if only the gradient K2 is detected, determination of whether a paper-roll leading end is present can be made. In such a case, the gradient K2 of the sensor signal when a paper-roll leading end passes the sensor 93 is detected. When the gradient K2 is detected in an nth rotation of the paper roll or the spool, determination of whether the gradient K2 is detected again in an n+1th rotation is made. If the gradient K2 is successively detected in the predetermined number of rotations of the paper roll or the spool, the presence of the paper-roll leading end is determined. Accordingly, even if a gradient K1 does not tend to be detected, a paper-roll leading end can be detected. The predetermined number of rotations can be appropriately selected.

Moreover, for example, in a case where two or more rollers 92 are disposed in a roll axial direction as illustrated in FIG. 7A, a gradient K1 may not tend to be detected if a leading end has been cut diagonally. In this case, an operation for detecting the gradients K1 and K2 is repeated for the predetermined number of times, and then only the gradient K2 is detected, so that detection accuracy can be enhanced.

Figure 18:
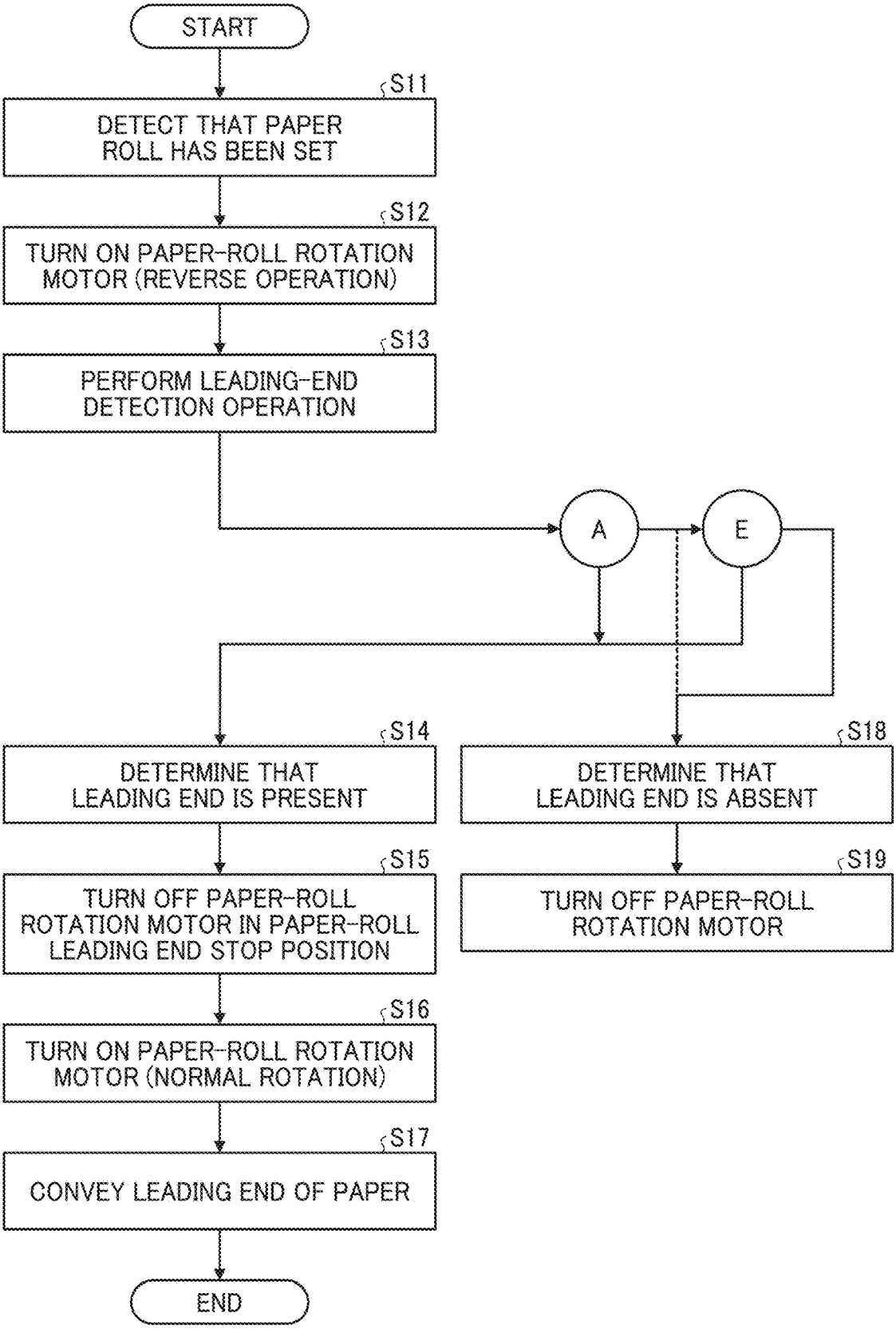
FIG. 18 is a flowchart illustrating one example of a process from paper-roll setting to a paper conveyance operation.

Next, one example of an operation from which a paper roll is set to which a paper conveyance operation is performed is described. FIG. 18 is a flowchart illustrating an operation example in which a paper roll is set in the paper feeding device 90 according to one embodiment.

In step S11, the controller 110 detects that a paper roll Pr has been set in the paper feeding device 90 (e.g., based on a result of detection by the spool detection sensor 1). In step S12, the controller 110 controls the motor drive circuit 120 to control the paper-roll drive unit 130 such the paper roll Pr is reversely rotated. Herein, the paper-roll rotation motor (the paper-roll drive unit 130) rotates the paper roll Pr in a direction in which the paper roll Pr is rewound by a reverse operation. In step S13, the sensor 93 performs a leading-end detection operation.

A reference letter "A" in FIG. 18 represents a procedure to be performed in the leading-end detection operation in step S13. In the leading-end detection operation in step S13, the procedure A described with reference to FIG. 19 is performed. The procedure A in FIG. 18 proceeds to either step 14 that is performed if a paper-roll leading end is detected or a procedure E that is described with reference to FIG. 20. The procedure E in FIG. 18 proceeds to either step 14 which is performed if a paper-roll leading end is detected or step S18 that is performed if a paper-roll leading end is not detected.

In step S14, the sensor 93 detects a paper-roll leading end, and then the process proceeds to step S15. In step S15, the motor drive circuit 120, based on the control by the controller 110, turns off the paper-roll rotation motor in a leading end stop position. In step S16, the motor drive circuit 120, based on the control by the controller 110, turns on the paper-roll rotation motor to convey the paper-roll leading end in a conveyance direction by normal rotation. In step S17, the motor drive circuit 140 rotates the conveyance unit 160 to convey the paper-roll leading end to the apparatus.

In the procedure E, if the paper-roll leading end is not detected (NO in step S18), the process proceeds to step S19. In step S19, the motor drive circuit 120, based on the control by the controller 110, turns off the paper-roll rotation motor. Subsequently, the controller 110 performs a process as necessary. For example, the controller 110 controls the display 170 to display a waring message.

Next, the procedure A illustrated in FIG. 18 is described with reference to FIG. 19. An example of the procedure A illustrated in FIG. 19 is performed in the leading-end detection operation in step S13 illustrated in FIG. 18. First, in step S21, the controller 110 sets the number of leading-end detection times N to zero. Subsequently, in step S22, the controller 110 determines whether a gradient K1 has been detected. If the gradient K1 has been detected (YES in step S22), the process proceeds to step S23. In step S23, the controller 110 determines whether a gradient K2 has been detected within a time T1. If the gradient K2 has been detected (YES in step S23), the process proceeds to step S24. In step S24, the controller 110 increases the number of leading-end detection times (N) by +1.

The determination of whether the gradient K2 has been detected within the time T1 can be made using, for example, the concept described with reference to FIG. 16. The process in step S22 may be referred to as determination of whether a sensor displacement output (K1) has been detected.

Subsequently, in step S25, the controller 110 determines whether the number of leading-end detection times (N) is a setting value "a" or more. The setting value "a" is a value indicating the number of times that is set for determination of whether a leading end is present. The setting value "a" is an integer of 1 or greater. In a case where detection reliability is intended to be enhanced, the setting value "a" is increased. FIG. 21 is a table illustrating codes that are used in the flowcharts.

If the number of leading-end detection times is the setting value "a" or more (YES in step S25), the process proceeds to step S14 in which the controller 110 determines that the paper-roll leading end has been detected. In other words, in step S14, the controller 110 determines that the paper-roll leading end is present. Subsequently, the process proceeds to the main flowchart illustrated in FIG. 18. The process in step S14 is illustrated in both of FIGS. 18 and 19 for the sake of clarity.

The processes in steps S21 through S25 and S14 have been described using an example in which the presence of a paper-roll leading end is determined since the gradient K1 is detected and then the gradient K2 is detected within a time T1, where the setting value "a" is 1.

In step S25, if N<a (i.e., the number of leading-end detection times N<the setting value "a"), that is, NO in step S25, the leading-end detection operation continues (steps S28 and S29). Herein, in this example, processes in steps S28 and S29 are performed. In step S28, the controller 110 determines whether the gradient K1 has been detected again within a time T2 after detection of the gradient K1. The process in step S28 is performed to determine whether the gradient K1 has been detected again within the time T2 as described above with reference to FIG. 17, so that detection accuracy can be enhanced.

If the controller 110 determines that the gradient K1 has been detected again within the time T2 (YES in step S28), the process proceeds to step S29. In step S29, the controller 110 determines whether the gradient K2 has been detected within the time T1 after detection of the gradient K1. If the controller 110 determines that the gradient K2 has been detected (YES in step S29), the process returns to step S24 in which the number of leading-end detection times (N) is increased by +1. Subsequently, the process in step S25 is performed again. If the number of leading-end detection times is the setting value "a" or more (YES in step S25), the presence of the paper-roll leading end is determined in step S14. Then, the process returns to the main flowchart illustrated in FIG. 18. Accordingly, execution of the processes in steps S25, S28, and S29 can further enhance the detection accuracy.

Figure 19:
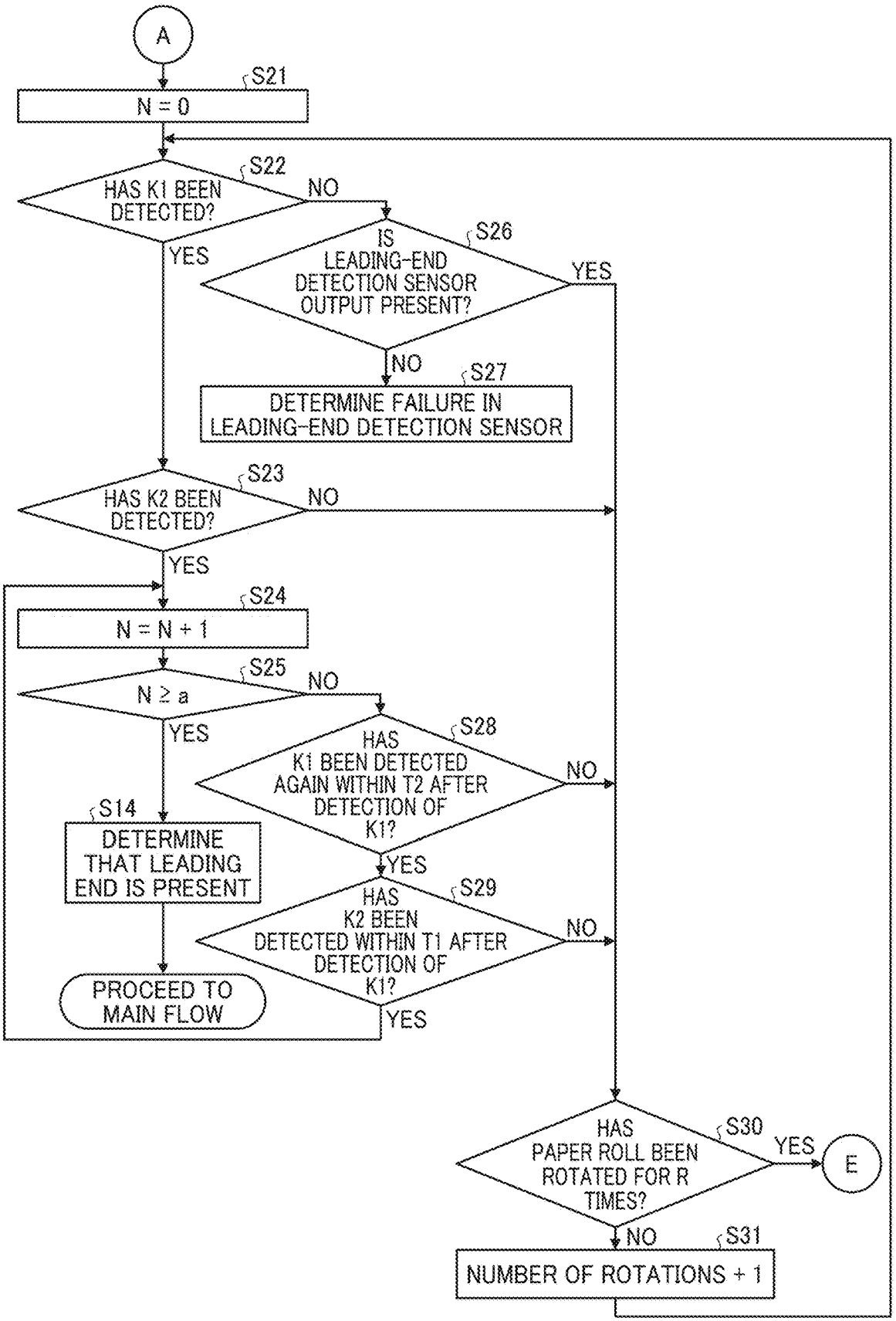
FIG. 19 is a flowchart illustrating a process to be performed in a procedure A illustrated in FIG. 18.

In FIG. 19, if the gradient K1 has not been detected (NO in step S22), the process proceeds to step S26. In step S26, the controller 110 determines whether an output of the leading-end detection sensor (the sensor 93) is present. If the output of the leading-end detection sensor is not present (NO in step S26), the process proceeds to step S27. In step S27, the controller 110 determines that a failure in the leading-end detection sensor has occurred.

As for the process in step S26, for example, the controller 110 determines whether there is an output of the leading-end detection sensor for a predetermined time. The predetermined time is preferably, for example, time for one rotation of the paper roll or the spool or longer. Accordingly, false detection can be reduced.

If the output of the leading-end detection sensor is present (YES in step S26), that is, if the gradient K1 has not been detected and the output of the leading-end detection sensor is present, the process proceeds to step S30. In step S30, the controller 110 determines the number of rotations of the paper roll. Herein, the controller 110 determines whether the paper roll has been rotated R times, where R is a value that is set for the number of rotations that the paper roll is to be made until a leading end is detected as stated in FIG. 21. Although the number of rotations of the paper roll is determined herein, the number of rotations of the spool may be determined. If the number of rotations of the paper roll is smaller than R (NO in step S30), the process proceeds to step S31. In step S31, the controller 110 increases the number of rotations by 1. Then, in step S22, the controller 110 again determines whether the gradient K1 has been detected.

In the processes of steps S22, S26, and S30, an output of the leading-end detection sensor is present although the gradient K1 is not detected, and thus it is assumed that a failure in the leading-end detection sensor has not occurred. Since the gradient K1 is not detected for any reason, detection of the gradient K1 is attempted by repeatedly rotating the paper roll. Such a process is performed multiple times, thereby reducing a case in which a paper-roll leading end is not detected despite the presence of the paper-roll leading end.

Figure 20:
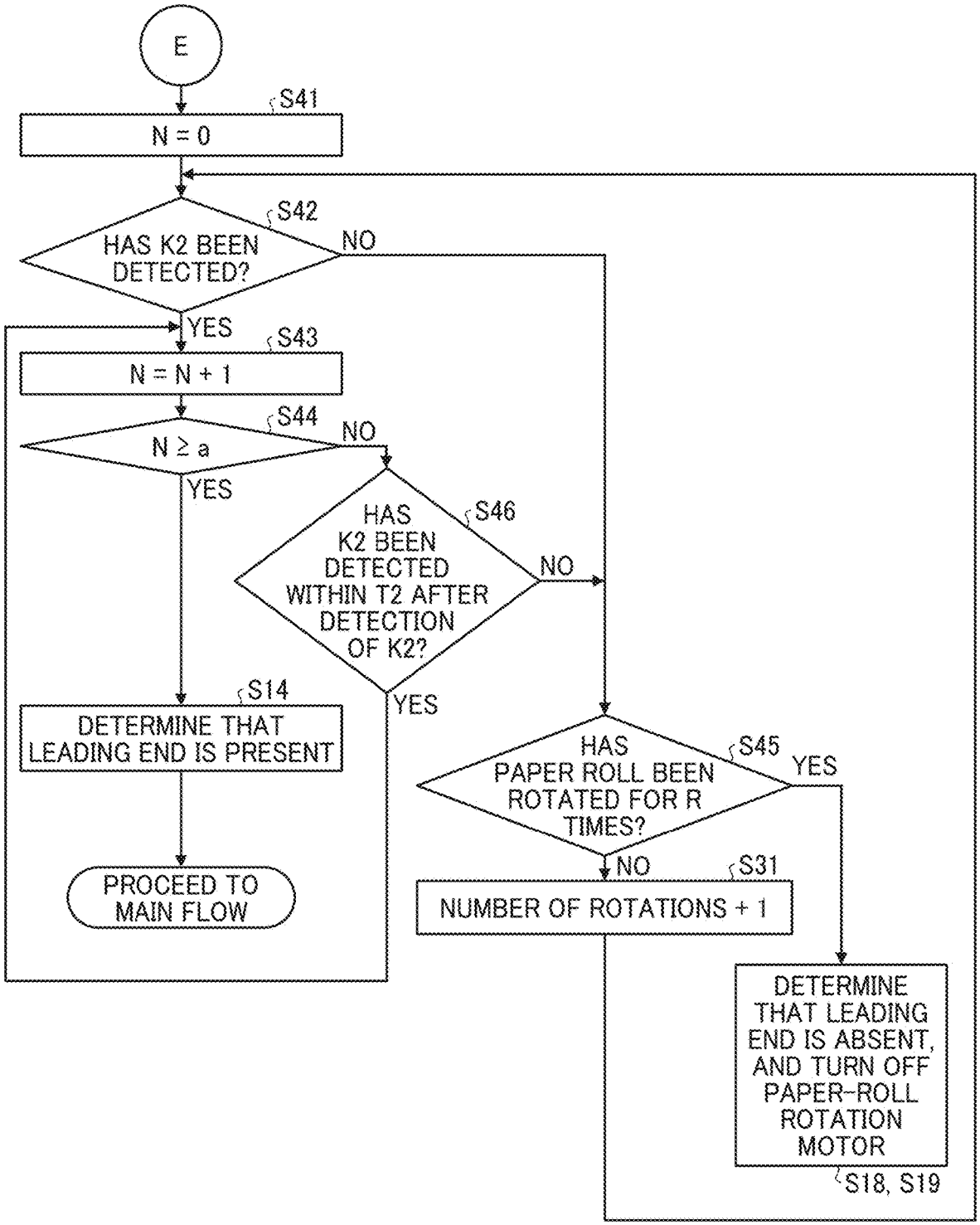
FIG. 20 is a flowchart illustrating a process to be performed in a procedure E illustrated in FIG. 19.

If the number of rotations of the paper roll is R (YES in step S30), the process proceeds to the procedure E illustrated in FIG. 20. If the gradient K1 has not been detected again within the time T2 (NO in step S28), or the gradient K2 has not been detected within the time T1 (NO in step S29), in other words, even if each of the gradients K1 and K2 is not detected, the process proceeds to step S30 and then proceeds to the procedure E illustrated in FIG. 20. If the paper-roll leading end is not detected in the procedure A, the process proceeds to the procedure E.

FIG. 20 is a flowchart illustrating one example of the procedure E. In step S41, the controller 110 sets the number of leading-end detection times N to zero. Subsequently, in step S42, the controller 110 determines whether a gradient K2 has been detected. The process in step S42 may be referred to as determination of whether a sensor displacement output (K2) has been detected.

If the gradient K2 has been detected (YES in step S42), the process proceeds to step S43. In step S43, the controller 110 increases the number of leading-end detection times (N) by 1. Subsequently, in step S44, the controller 110 determines whether the number of leading-end detection times is a setting value "a" or more. The setting value "a" is a value indicating the number of times that is set for determination of whether a leading end is present, as mentioned above. If the number of leading-end detection times is the setting value "a" or more (YES in step S44), the process proceeds to step S14 in which the controller 110 determines that the paper-roll leading end has been detected. In other words, in step S14, the controller 110 determines the presence of the paper-roll leading end. Subsequently, the process proceeds to the main flowchart illustrated in FIG. 18. The process in step S14 is illustrated in both of FIGS. 20 and 18 for the sake of clarity.

In step S44, the setting value "a" is preferably 2 or greater. The process in step S46 is preferably performed at least once. That is, the controller 110 preferably determines whether the gradient K2 has been detected when the paper roll or the spool makes multiple rotations. In step S44, if the gradient K2 is detected in an nth rotation of the paper roll or the spool, the controller 110 determines whether the gradient K2 is detected again in an n+1th rotation of the paper roll or the spool. If the gradient K2 is successively detected in the predetermined number of rotations of the paper roll or the spool, the presence of the paper-roll leading end is preferably determined. In this case, the paper-roll leading end can be detected with higher accuracy, thereby preventing, for example, roughness that is not a paper-roll leading end from being falsely recognized as a gradient K2.

In step S46, the controller 110 determines whether the gradient K2 has been detected again within the predetermined time T2 after detection of the gradient K2. This process represents that if a gradient K2 is detected in an nth rotation of the paper roll or the spool, determination of whether the gradient K2 is detected again in an n+1th rotation is made (see FIG. 17).

If the gradient K2 has not been detected (NO in step S42), the process proceeds to step S45. In step S45, the controller 110 determines the number of rotations of the paper roll. Herein, the controller 110 determines whether the paper roll has been rotated R times, where R is a value similar to the above. If the number of rotations of the paper roll is less than R (NO in step S45), the process proceeds to step S31. In step S31, the controller 110 increases the number of rotations by 1. Then, in step S42, the controller 110 again determines whether the gradient K2 has been detected.

If the number of rotations of the paper roll is R or more (YES in step S45), the process proceeds to step S18 in which the controller 110 determines that the absence of the paper-roll leading end. Then, in step S19, the controller 110 turns off the paper-roll rotation motor. The processes in steps S18 and S19 are illustrated in FIGS. 20 and 18 for the sake of clarity.

Even if the gradient K2 has not been detected (NO in step S46), the process proceeds to step S45. Then, in steps S18 and 19, the absence of the paper-roll leading end is determined, and the paper-roll rotation motor is turned off, respectively.

The processes in steps S22, S26, and S30 in FIG. 19 are performed, and the processes in steps S42 and S44 in FIG. 20 are further performed. Preferably, the process in step in S46 in FIG. 20 is also performed. With such processes, the presence or absence of the paper-roll leading end can be detected based on only the gradient K2 even if the gradient K1 is not detected. Moreover, the process in step S46 can enhance detection accuracy.

In the present embodiment, a spool is simply set in a holder of the paper feeding device, so that a paper-roll leading end can be automatically detected with good accuracy. In the present embodiment as described above, a gradient K1 of a sensor signal when a paper-roll passes a roller and a gradient K2 of the sensor signal when the paper-roll passes a leading-end detection sensor are detected, so that the presence or absence of the paper-roll leading end can be determined. If the paper-roll leading end is detected, it can be determined that the paper roll has been set. Thus, a member such as a reflective sensor is not necessary. Hence, detection of whether the paper roll has been set can be performed without increasing the number of components.

In the present embodiment as described below, a case in which a process that is performed if a paper roll is set is performed despite the absence of the paper roll can be prevented. Conventionally, setting of a spool in a holder is detected, and a paper feed screen is displayed on a display (an operation unit). In a case where a paper roll is not set and only a spool is set, the paper cannot be fed. This causes extra work such as closing of the paper feed screen to be done. In such a case, if a paper-feeding start button is mistakenly pressed on the paper feed screen, not only a device continues to operate until the device determines a paper-feeding failure, but also an amount of extra work to be done by an operator (may also be referred to as a user) is increased. Examples of the extra work include opening of a cover to stop the device, and recovery of the device from the stop.

According to the present embodiment, not only a state in which a paper roll is not set can be automatically detected with good accuracy without a larger number of components, but also a case in which a process that is performed if a paper roll is set is performed despite the absence of the paper roll can be prevented.

Next, an operation for detecting an empty spool according to the present embodiment is described. For example, in the paper feeding device 90 which feeds paper from a paper roll, when a spool is set, such setting of the spool is detected by a sensor and a paper feed screen is displayed on the display 170 (also referred to as an operation unit or a display panel), On the paper feed screen, a screen for checking a paper type (a setting can be changed as needed), and buttons such as a paper-feeding start button and a paper-feeding cancel button are displayed. If the paper-feeding start button is pressed, an automatic paper-feeding operation is performed. In the automatic paper-feeding operation, for example, a paper-roll leading end is detected, and the paper-roll leading end is conveyed to a paper-feeding unit.

In such a paper feeding device, a spool without a paper roll is also referred to as an empty spool. An operation for detecting an empty spool is an operation for detecting (may also be referred to as an operation for determining) whether a spool that has been set is an empty spool. In other words, an operation for detecting an empty spool is, for example, an operation for determining whether a paper roll is provided on a spool that has been set, and determining that an empty spool is present in the device if the paper roll is not provided on the spool.

In general, an empty spool may be intended to be placed in a paper roll holder although paper cannot be fed. For example, although paper cannot be fed, an empty spool is intended to be placed in a paper feeding device as there is no space in which the spool is placed. In the related-art technique, in a case where a spool on which a paper roll is not set is set in a paper feeding device, a process that is performed if a paper roll is set may be performed despite the absence of the paper roll. In such a case, an operator needs to cancel the process, causing extra work and extra time to the operator. In addition to such issues, the operator needs to stop the device and recover the device.

According to the related-art technique, even if an empty spool is placed in a paper roll holder, a paper feed screen is displayed and a paper-feeding start button is displayed. Consequently, the operator needs to cancel the process by pressing a paper-feeding cancel button. In a case where a paper-feeding start button is pressed with an empty spool being set, a malfunction occurs. An example of the malfunction includes continuation of the operation until the device can recognize a paper-feeding failure. In a case where the paper-feeding start button is pressed, a user (including the operator) needs to deal with extra work such as opening of the cover to stop the operation of the device, and extra time is consumed. Moreover, in a case where the cover is opened to stop the operation of the device, an operation for recovering the device is necessary. This causes additional work and consumes additional time.

In addition, the related-art technique has issues such as a larger number of components to detect that the paper roll is not set, and detection accuracy that cannot be enhanced. For example, there is a method for detecting either a paper roll or a spool shaft by using a reflective sensor. The paper roll or the spool shaft is detected based on a difference between a reflectance of a surface of the paper roll and a reflectance of a surface of the spool shaft. However, such a method not only causes an increase in cost by an increase in the number of components due to the addition of the sensor, but also causes false detection due to outside light.

Moreover, the determination that the paper roll is not set on the spool can be made if an output from a sensor is absent in a position in which the sensor does not contact a spool surface. Although such determination is considered to be effective, vibration of a guide plate for supporting the sensor may be detected. Consequently, enhancement of detection accuracy is demanded. Thus, there is an increasing demand for enhancement of accuracy in detecting that the paper roll is not set.

In the present embodiment, an empty spool detection operation is performed with respect to a spool that has been set in the paper feeding device to solve such issues. The controller of the present embodiment not only determines whether a paper-roll leading end is present based on a sensor signal of a leading-end detection sensor, but also determines whether a paper roll is provided on a spool. Accordingly, the use of such a controller can prevent a paper-feeding operation from being falsely performed in a case where a paper roll is not provided on the spool, and can prevent a user from doing extra work and consuming extra time.

Moreover, in the present embodiment as described below, the spool has a recessed portion or a raised portion, so that accuracy in detecting an empty spool can be enhanced. In the present embodiment, a case in which a paper roll is not set on a spool can be automatically detected with good accuracy in an efficient manner. In addition, an empty spool can be detected without an increase in the number of components.

A time at which an empty spool detection operation is performed with respect to the spool which has been set in the paper feeding device can be selected appropriately. However, an example of the time is when a spool is placed on a paper roll holder. If a spool detection sensor 1 detects the spool, an empty spool detection operation is preferably performed.

Figure 22A:
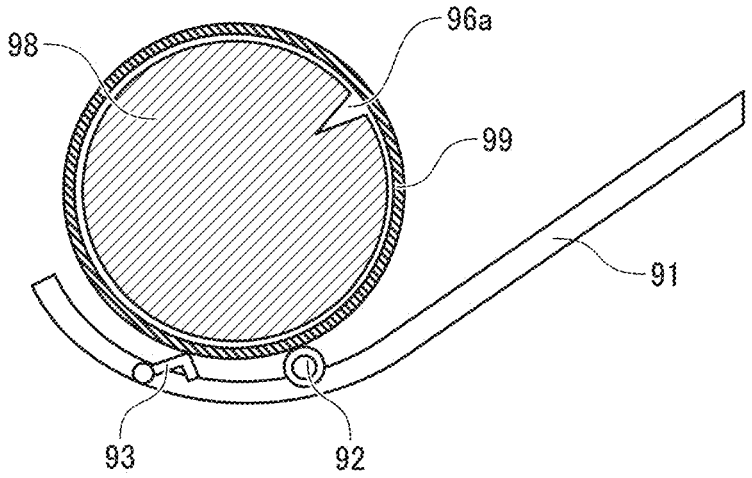
FIGS. 22A and 22B are diagrams each illustrating one example in which a paper core without a paper roll is set.
Figure 22B:
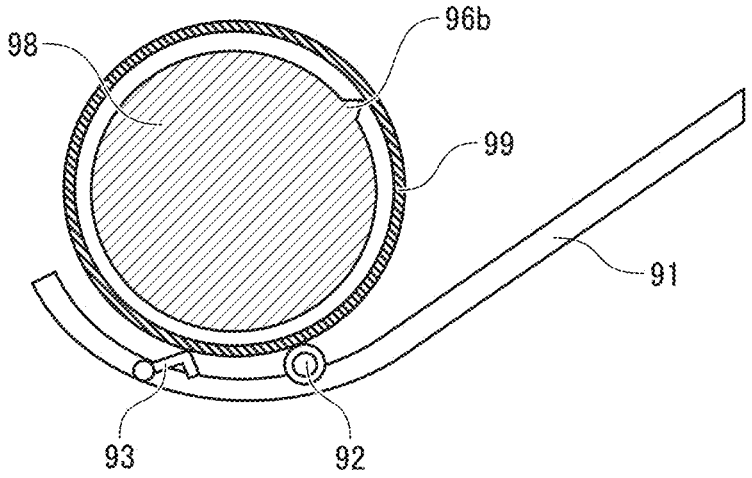
Figure 28:
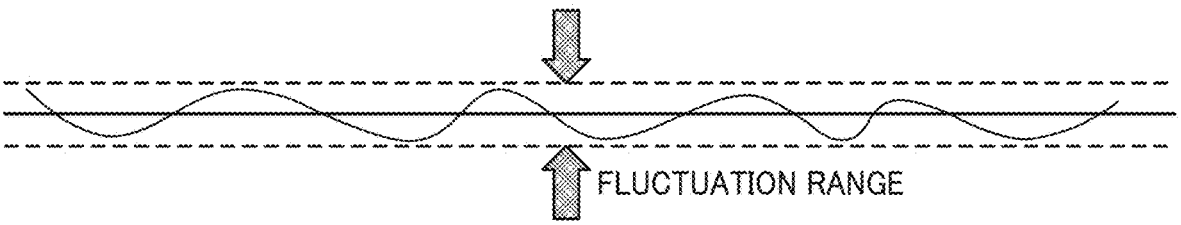
FIG. 28 is a diagram illustrating an output example of a sensor signal in a case where the roller and the sensor are in contact with a surface of the paper core.

FIGS. 22A and 22B are diagrams each illustrating a state in which a paper core 99 for a paper roll is in contact with the roller 92 and the sensor 93. For example, a spool 98 is fitted inside the paper core 99. When paper wound around the paper core 99 is used up, the roller 92 disposed on the arm 91 contacts the paper core 99, and the sensor 93 also contacts the paper core 99, thereby detecting the paper core 99. In such a case, the sensor 93 detects roughness on a surface of the paper core 99, and a result of the detection is output as an output of the sensor 93. When the sensor 93 contacts the surface of the paper core 99, a sensor signal is output, for example, as illustrated in FIG. 28.

The spool 98 in the present embodiment has a surface the one portion of which has a recessed portion 96*a* or a raised portion 96*b*. FIG. 22A illustrates an example in which the spool 98 has the recessed portion 96*a*, whereas FIG. 22B illustrates an example in which the spool 98 has the raised portion 96*b*. The arrangement of the recessed portion 96*a* or the raised portion 96*b* on the spool 98 can enhance accuracy in detecting an empty spool. The raised portion 96*b* may be in contact with the paper core 99 or may not be in contact with the paper core 99.

Figure 23A:
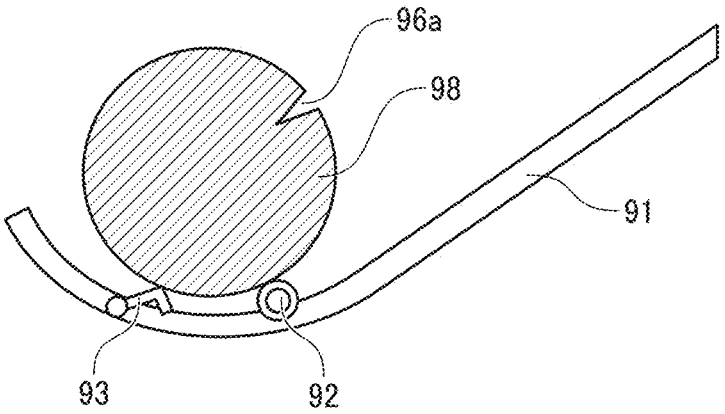
FIGS. 23A and 23B are diagrams each illustrating one example in which a spool in an empty spool state is set.
Figure 23B:
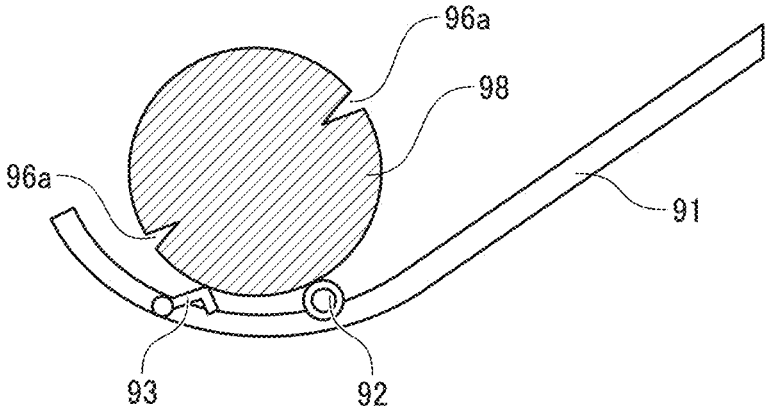

FIGS. 23A and 23B are diagrams each illustrating a state in which a spool 98 is set without a paper roll Pr on the spool 98. That is, each of FIGS. 23A and 23B illustrates an example state in which an empty spool is set. The spool 98 is placed, for example, in a paper roll holder. As illustrated in FIGS. 23A and 23B, the sensor 93 contacts the spool 98, so that the spool 98 is detected. The sensor 93 detects a surface of the spool 98, and a result of the detection is output as an output of the sensor 93. FIG. 23A illustrates an example in which the spool 98 has one recessed portion 96*a*, and FIG. 23B illustrates an example in which the spool 98 has two recessed portions 96*a*.

Figure 24A:
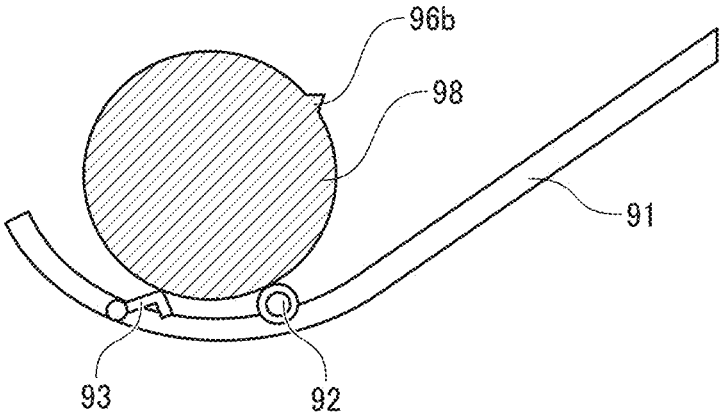
FIGS. 24A and 24B are diagrams each illustrating another example in which a spool in an empty spool state is set.
Figure 24B:
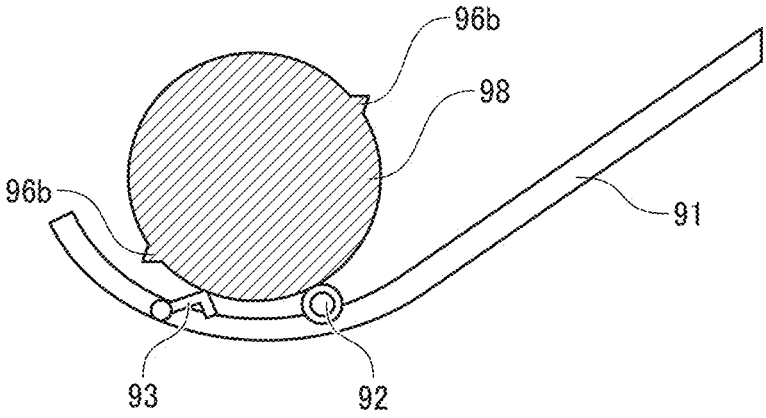

FIGS. 24A and 24B are diagrams each illustrating a state in which a spool 98 is set without a paper roll Pr on the spool 98, as similar to FIGS. 23A and 23B. That is, each of FIGS. 24A and 24B illustrates an example state in which an empty spool is set. FIG. 24A illustrates an example in which the spool 98 has one raised portion 96*b*, and FIG. 24B illustrates an example in which the spool 98 has two raised portions 96*b*.

The arrangement, the shape, and the number of the recessed portions 96*a* and the raised portions 96*b* can be changed appropriately, and are not limited to those illustrated. Moreover, although the rotation center 911 is omitted in FIGS. 22A through 24B, the arm 91 can be rotated such that the roller 92 and the sensor 93 are arranged toward the axial center of the spool 98 as described above.

FIGS. 25A through 26B are schematic diagrams each illustrating an example of relative positions of the recessed portion 96*a* or the raised portion 96*b* of the spool 98, the roller 92, and the sensor 93. The reference numeral 96 in FIGS. 25A through 26B represents the recessed portion 96*a* or the raised portion 96*b*, and the recessed portion 96*a* or the raised portion 96*b* can be referred to as a recessed or raised portion 96 if a description is given without distinction. A surface of the spool 98 can have a roughness portion that is not intentionally arranged. Such a roughness portion may be simply referred to as roughness, and the roughness is distinguished from the recessed or raised portion 96. In FIGS. 25A through 26B, an example of a flange 4 is illustrated, but is not limited thereto.

Figure 25A:
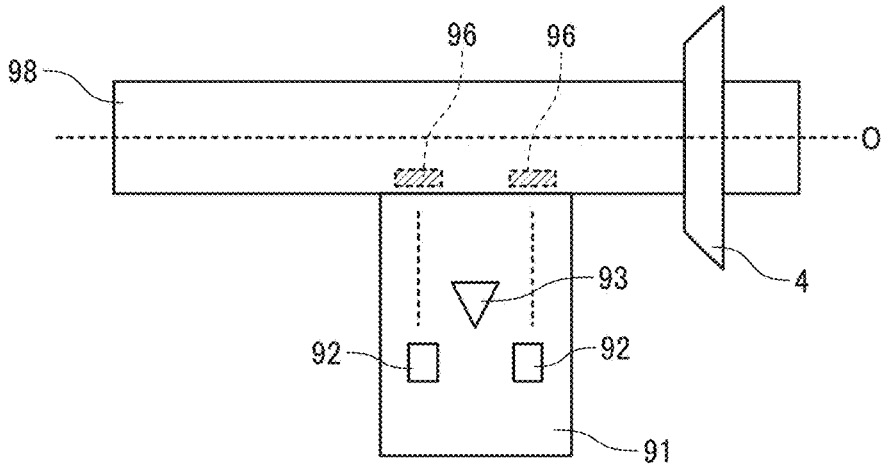
FIGS. 25A through 25C are diagrams each illustrating one example of relative positions of a recessed or raised portion, the roller, and the sensor.

FIG. 25A illustrates an example in which the spool 98 has two recessed or raised portions 96, and the arm 91 includes two rollers 92. The recessed or raised portions 96 are arranged on the spool 98 so as to be in positions in which the recessed or raised portions 96 contact the respective rollers 92 when the spool 98 is rotated in an empty spool state. When the spool 98 is rotated, one recessed or raised portion 96 contacts one roller 92, and the other recessed or raised portion 96 contacts the other roller 92. A broken line in a paper-surface vertical direction in each of FIGS. 25A through 26B schematically represents a movement direction of the recessed or raised portion 96. A broken line O in each of FIGS. 25A through 26B schematically represents a rotation axis of the spool 98.

In a case where the spool 98 is rotated in an empty spool state, the recessed or raised portion 96 (e.g., the recessed portion 96*a*) contacts the roller 92, causing events illustrated in FIGS. 13A through 13D, for example. Consequently, a sensor signal, for example, having a gradient approaching an area (2) from an area (1) in FIG. 12 is output. Moreover, the recessed portion 96*a* has an area approaching the bottom of the recessed portion 96*a*, and an area departing from the bottom of the recessed portion 96*a*. In the area approaching the bottom of the recessed portion 96*a*, for example, events in order of FIGS. 13A through 13D occur. On the other hand, in the area departing from the bottom of the recessed portion 96*a*, for example, events in reverse order of FIGS. 13A through 13D occur. In the area departing from the bottom of the recessed portion 96*a*, a sensor signal, for example, having a gradient approaching an area (3) from the area (2) in FIG. 12 is detected. Accordingly, a sensor signal to be output when the roller 92 passes the recessed portion 96*a* is, for example, a sensor signal as illustrated in FIG. 12. Thus, a sensor signal having no bottom portion or a small bottom portion in the area (2) is output.

The raised portion 96*b* can be considered similar to the recessed portion 96*a*. In the raised portion 96*b*, a sensor signal having a gradient opposite to the recessed portion 96*a* is output. The expression "the recessed or raised portion 96 contacts the roller 92" can be expressed as "the recessed or raised portion 96 passes the roller 92". One example of a sensor signal when the spool 98 has the recessed or raised portion 96 is described below with reference to FIGS. 29 through 32.

In the example illustrated in FIG. 25A, when the rollers 92 contacts the recessed or raised portions 96, the two recessed or raised portions 96 and the two rollers 92 are arranged in relative positions so as to contact each other on the respective lines. Since there are two recessed or raised portions 96*d*, and such relative positions are arranged, false detection can be reduced.

Figure 25B:
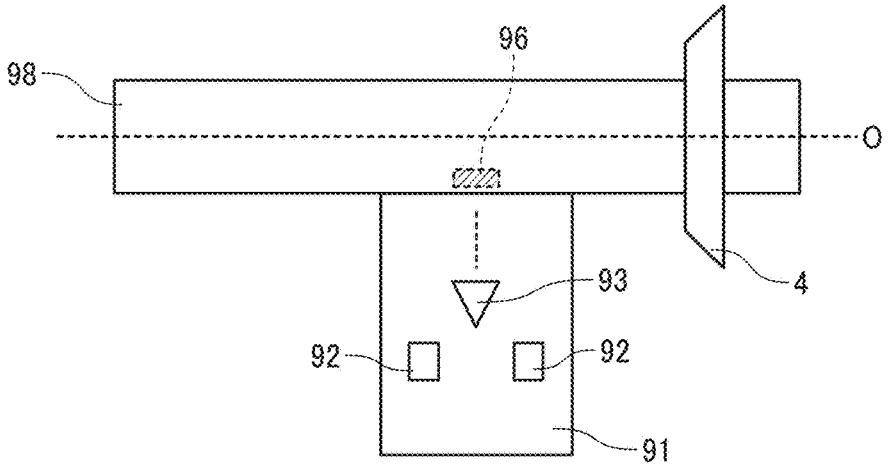

In FIG. 25B illustrates an example in which a spool 98 has one recessed or raised portion 96. In the example illustrated in FIG. 25B, the recessed or raised portion 96 is arranged on the spool 98 such that the recessed or raised portion 96 is positioned to contact the sensor 93 when the spool 98 is rotated in an empty spool state.

The example in FIG. 25B can be considered similar to the example illustrated in FIG. 25A. In FIG. 25B, since the recessed or raised portion 96 contacts (passes) the sensor 93, for example, events illustrated in FIGS. 15A through 15D occur. In the recessed portion 96*a*, for example, events in order of FIGS. 15A through 15D occur in an area approaching the bottom of the recessed portion 96*a*. On the other hand, in an area departing from the bottom of the recessed portion 96*a*, for example, events in reverse order of FIGS. 15A through 15D occur. The raised portion 96*b* can be considered similar to the recessed portion 96*a*. Thus, in the raised portion 96*b*, a sensor signal having a gradient opposite to the recessed portion 96*a* is output.

Figure 25C:
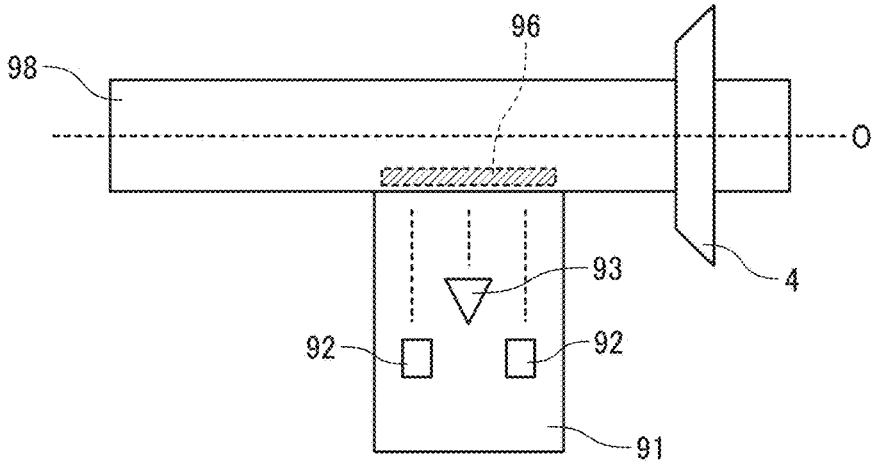

FIG. 25C illustrates an example in which a spool 98 has one recessed or raised portion 96. In the example illustrated in FIG. 25C, the recessed or raised portion 96 is arranged on the spool 98 such that the recessed or raised portion 96 is positioned to contact the roller 92 and the sensor 93 when the spool 98 is rotated in an empty spool state. Moreover, the recessed or raised portion 96 in the example illustrated in FIG. 25C has a wider width than the aforementioned examples. In other words, a length of the spool 98 in a rotation axis direction is greater.

In the example illustrated in FIG. 25C, for example, the recessed or raised portion 96 contacts the roller 92 after the recessed or raised portion 96 contacts the sensor 93. That is, a time at which the recessed or raised portion 96 contacts the sensor 93 differs from a time at which the recessed or raised portion 96 contacts the roller 92. Accordingly, not only when the recessed or raised portion 96 passes the sensor 93, but also when the recessed or raised portion 96 passes the roller 92, outputs of the recessed or raised portion 96 are detected. Since the two outputs of sensor signals are detected using one recessed or raised portion 96, false detection can be prevented.

Figure 26A:
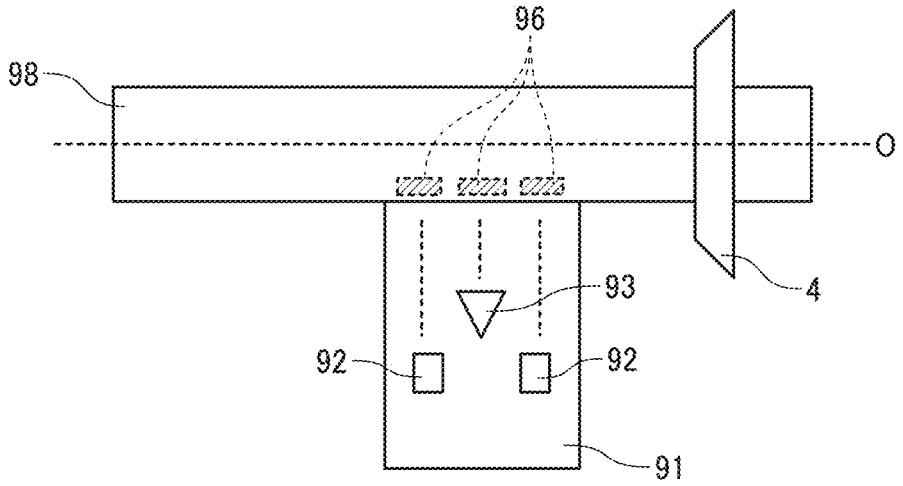
FIGS. 26A and 26B are diagrams each illustrating a modified example of relative positions of the recessed or raised portion, the roller, and the sensor.
Figure 26B:
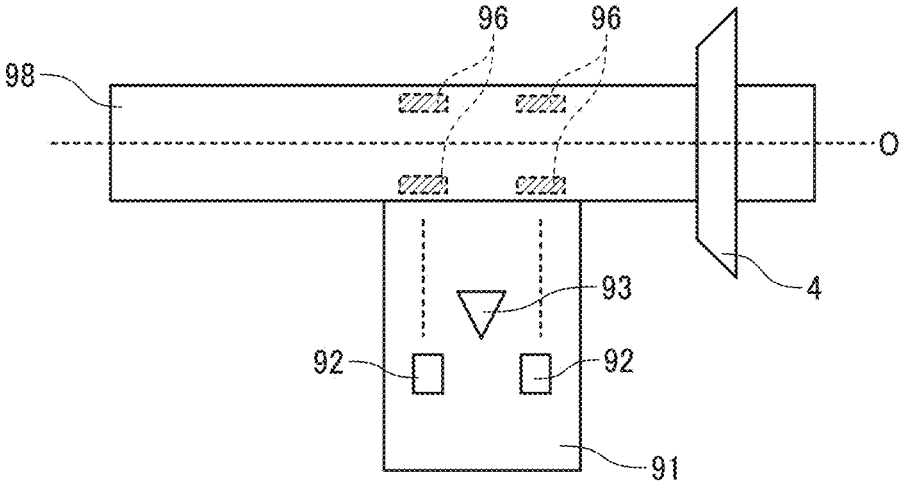

FIGS. 26A and 26B are diagram illustrating modified examples in which arrangement of the recessed or raised portion 96 and the number of recessed or raised portions 96 are changed. The recessed or raised portion 96 illustrated in FIG. 25C can be separated as illustrated in FIG. 26A. The number of recessed or raised portions 96 can be increased as illustrated in FIG. 26B. However, such an increase causes more manufacturing work to be done.

Figure 27A:
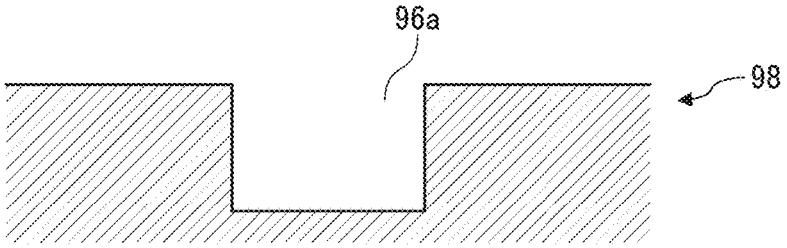
FIGS. 27A and 27B are diagrams each illustrating one example of a recessed portion.
Figure 27B:
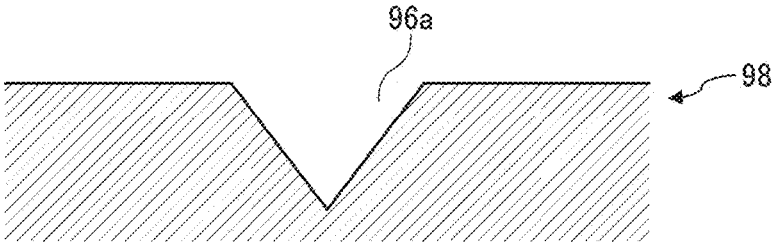
Figure 27C:
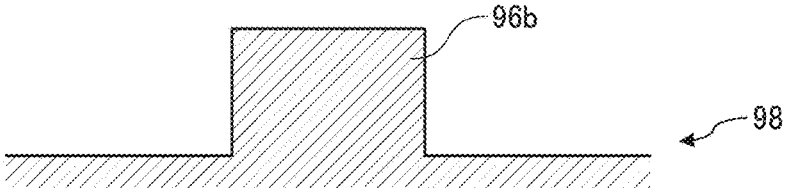
FIGS. 27C and 27D are diagrams each illustrating one example of a raised portion.
Figure 27D:
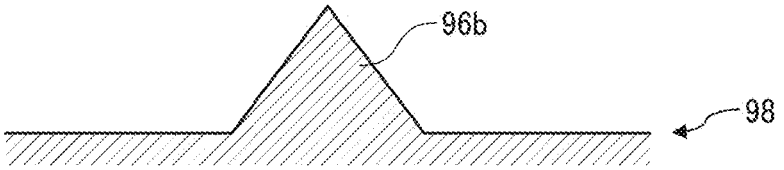

FIGS. 27A and 27B are diagrams each illustrating one example of the recessed portion 96*a*, and FIGS. 27C and 27D are diagrams each illustrating one example of the raised portion 96*b*. Shapes of the recessed portion 96*a* and the raised portion 96*b* can be selected appropriately. For example, the recessed portion 96*a* and the raised portion 96*b* can have shapes the heights of which discontinuously change as illustrated in FIGS. 27A and 27C respectively, or the recessed portion 96*a* and the raised portion 96*b* can have shapes the heights of which continuously change as illustrated in FIGS. 27B and 27D respectively. The shapes illustrated in FIGS. 27B and 27D are preferred in consideration of a situation in which the recessed portion 96*a* or the raised portion 96*b* is caught in the roller 92 or the sensor 93. In addition, a depth of the recessed portion 96*a* and a height of the raised portion 96*b* are not particularly limited. For example, a gradient of a sensor signal when the roller 92 or the sensor 93 passes the recessed or raised portion 96 preferably has a shape that is a gradient K1max or more and/or gradient K2max or more of a sensor signal when a leading end having the maximum applicable paper thickness is detected.

Next, an output example of a sensor signal, particularly, an example of a gradient of the sensor signal is described. FIG. 28 illustrates an output example of the example illustrated in FIGS. 22A and 22B. In FIG. 28, an output example of a sensor signal of a surface of the paper core 99 is illustrated. The output example in FIG. 28 is provided in a case where the spool 98 is rotated with the paper core 99 of the paper roll being in contact with the roller 92 and the sensor 93 as illustrated in each of FIGS. 22A and 22B.

As illustrated in FIG. 28, a signal is not constant and fluctuates to some extent since the surface of the paper core 99 has roughness or waviness. A fluctuation range is smaller than an output strength in an amount of a paper step. A vertical magnitude in the sensor signal is also referred to as an output strength. The fluctuation range can be referred to as fluctuations in output strength.

Figure 29A:
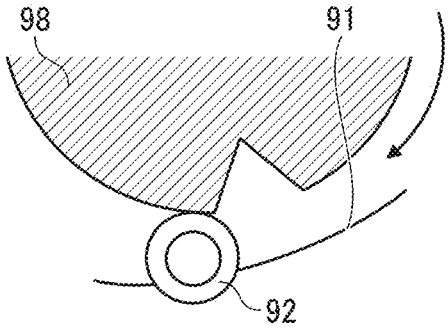
FIGS. 29A through 29D are diagrams illustrating one example of movements when the roller passes the recessed portion.
Figure 29B:
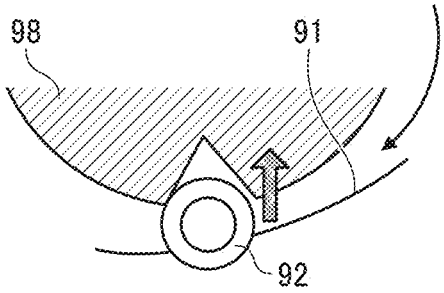
Figure 29C:
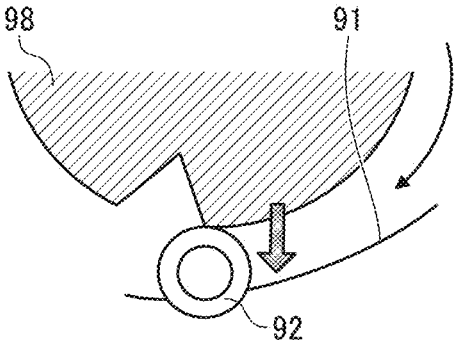
Figure 29D:
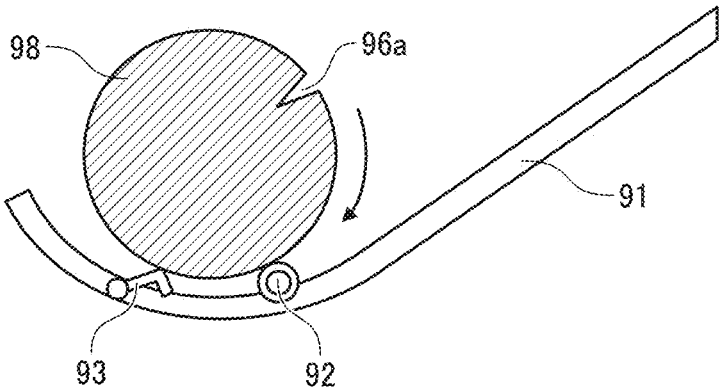

FIGS. 29A through 29D are diagrams schematically illustrating movements of the roller 92 and the arm 91 when the roller 92 passes the recessed portion 96*a*. FIG. 29D is similar to FIG. 23A, and schematically illustrates the recessed portion 96*a* and arrangement of members including the roller 92. FIGS. 29A through 29C are diagrams chronologically illustrating movements when the roller 92 passes the recessed portion 96*a*.

The diagrams in FIGS. 29A through 29C are illustrated in a chronological order. FIG. 29A illustrates a state before the roller 92 passes the recessed portion 96*a*. FIG. 29B illustrates a state when the roller 92 moves toward the bottom of the recessed portion 96*a*. A black arrow in FIG. 29B schematically indicates movement of the roller 92 and the arm 91. Since the roller 92 moves toward the bottom of the recessed portion 96*a*, the arm 91 approaches the spool 98. FIG. 29C illustrates a state when the roller 92 moves out of the bottom of the recessed portion 96*a*. Since the conveyance path 9 moves out of the bottom of the recessed portion 96*a*, the arm 91 moves away from the spool 98.

Figure 30A:
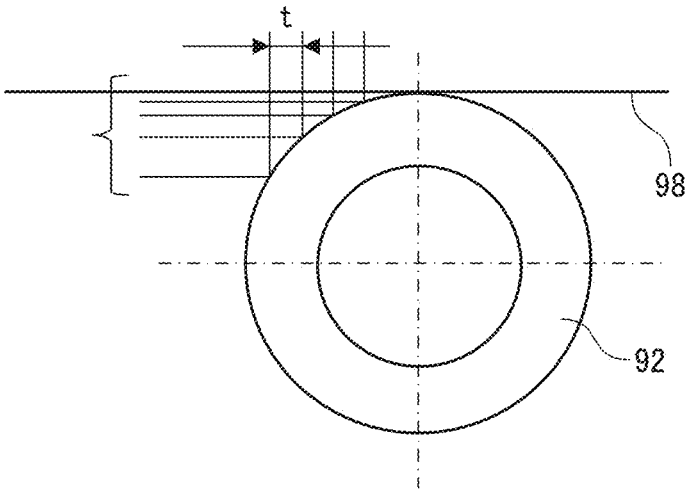
FIGS. 30A through 30C are diagrams respectively illustrating an example in which the roller contacts the spool, an output example of a sensor signal when the roller passes the recessed portion, and an example of a gradient of the sensor signal illustrated in FIG. 30B.
Figure 30B:
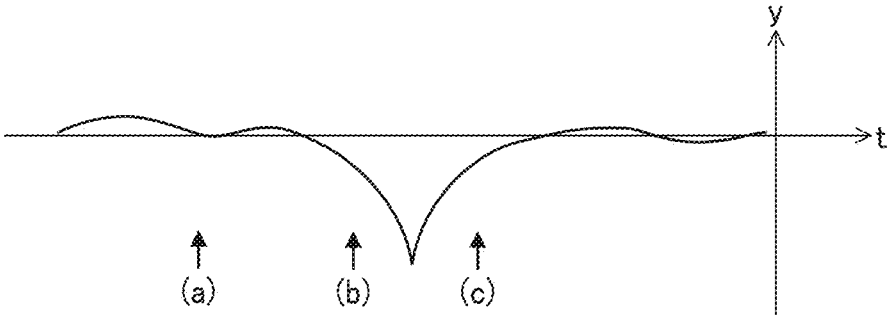
Figure 30C:
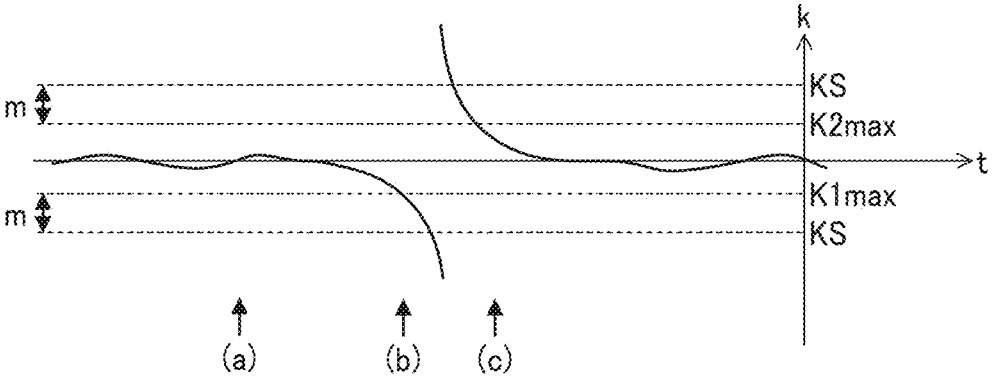

FIGS. 30A through 30C are diagrams illustrating an output example of a sensor signal and an example of a gradient of the sensor signal for the example illustrated in FIGS. 29A through 29C. FIG. 30A illustrates an example of contact of the roller 92 with the spool 98. Since a side or a cross-section of the roller 92 has a circular shape, a degree of change in sensor signal value per unit time when the roller 92 passes the recessed portion 96*a* becomes greater as the roller 92 becomes closer to the bottom of the recessed portion 96*a*, and becomes smaller as the roller 92 becomes farther from the bottom of the recessed portion 96*a*. FIG. 30B illustrates an example of an output of a sensor signal when the roller 92 passes the recessed portion 96*a*, and FIG. 30C illustrates an example of a gradient of a sensor signal when the roller 92 passes the raised portion 96*b*.

Accordingly, an output example of the sensor signal when the roller 92 passes the recessed portion 96*a* has a curved valley shape as illustrated in FIG. 30B. If a gradient of the sensor signal herein is plotted, a change in the gradient is provided as illustrated in FIG. 30C. The reference codes with parentheses (a), (b), and (c) in FIGS. 30B and 30C correspond to FIGS. 29A, 29B, and 29C. Moreover, a vertical axis in FIG. 30B indicates an output of a sensor signal, and such an output of the sensor signal is illustrated as an output strength y. A vertical axis in FIG. 30C indicates a gradient k of a sensor signal. In each of FIGS. 30B and 30C, a time axis is plotted from left to right for the sake of convenience. However, each of FIGS. 30B and 30C is not limited thereto. A time axis may be plotted from right to left.

In FIG. 30C, reference codes KS, K1max, and K2max are illustrated, and these codes indicate setting values. The setting values and a detected gradient are compared, so that the recessed portion 96*a* can be detected. The reference code K1max represents a gradient of a sensor signal when the roller 92 passes a leading end having a maximum applicable paper thickness. The reference code K2max represents a gradient of a sensor signal when the sensor 93 passes a leading end having a maximum applicable paper thickness. The gradients K1max and K2max are determined beforehand. The reference code KS represents a setting value acquired by addition of a margin m to the gradient K1max. The margin m is added for consideration of sensor variation.

In FIG. 30C, the setting value KS is acquired by addition of the margin m to the gradient K2max. Although it is conceivable that one value is set as a setting value KS, a setting value KS can be split into a value for the gradient K1max and a value for the gradient K2max. However, since it is conceivable that absolute values of the gradients K1max and K2m are close to each other, one value can be set as a setting value KS as long as the one value is acquired by addition of a certain margin m to the gradient K1max or K2max. Alternatively, a value acquired by addition of a predetermined margin m to an absolute value of a gradient K1max, and a value acquired by addition of the predetermined margin m to an absolute value of a gradient K2max may be compared, and the value greater than other may be set as a setting value KS.

In FIG. 30C, the setting value KS is expressed as "KS" even in an area in which the gradient k is negative. The setting value KS in the negative area is expressed as "KS" for the sake of convenience, and may be expressed as "−KS". A determination of whether a detected gradient is greater than the setting value KS can be made, for example, based on comparison between an absolute value of the detected gradient and an absolute value of the setting value KS. In some cases, the description below is given based on the premise that absolute values are compared. For example, in the example illustrated in FIG. 30C, the setting value KS is greater than the gradient K1max. It is said that since the setting value KS and the gradient K1max are compared using absolute values, the setting value KS is greater than the gradient K1max.

The foregoing example has been described using the recessed portion 96*a*. However, the foregoing example may be applied to the raised portion 96*b*. In such a case, when the raised portion 96*b* passes the roller 92, an output of the sensor has a positive or negative sign that is reversed with respect to the case using the recessed portion 96*a*.

Moreover, an output of a sensor when the recessed portion 96*a* passes the sensor 93 has a sign opposite to a sign of an output of a sensor when the recessed portion 96*a* passes the roller 92. That is, a waveform is raised in the upper side (the positive side) in the output example illustrated in FIG. 30B.

Figure 31:
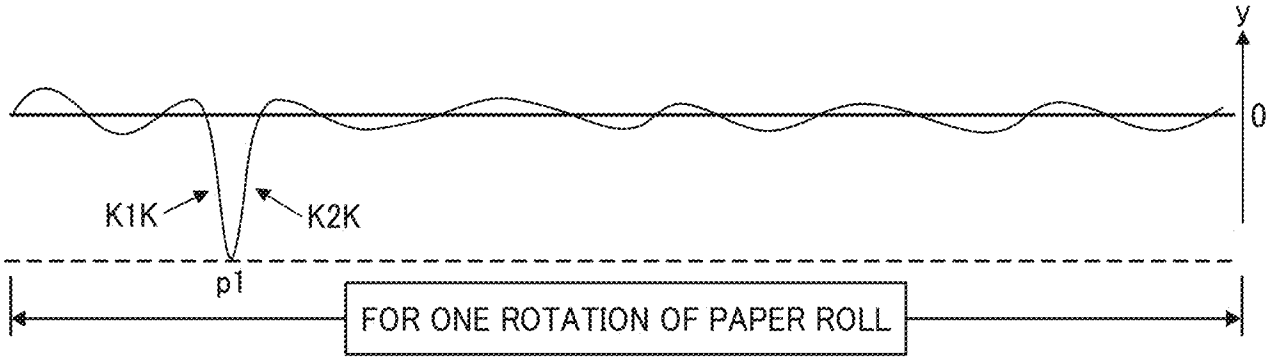
FIG. 31 is a diagram illustrating an output example of a sensor signal in a case where an empty spool is detected and the spool has one recessed portion.

FIG. 31 illustrates another output example of a sensor signal in a case where the recessed portion 96*a* is detected, and is a diagram illustrating an output example of a sensor signal of a spool surface (in a case where one recessed portion arranged). FIG. 31 illustrates an output example of the examples illustrated in FIGS. 23A and 25A. In the example illustrated in FIG. 25A, since the spool 98 is rotated with the sensor 93 being in contact with a surface of the spool 98, roughness or waviness on the spool 98 causes an output to fluctuate in a fluctuation range as illustrated in FIG. 31.

As illustrated in FIG. 31, in a case where the spool 98 is rotated in an empty spool state, a peak p1 is output when the recessed portion 96*a* on the spool 98 passes the roller 92. The peak p1 is a peak corresponding to the recessed portion 96*a*. The controller 110 can detect the recessed portion 96*a* based on a sensor signal from the sensor 93. If the controller 110 detects the recessed portion 96*a*, the controller 110 determines that the spool 98 is an empty spool.

In the example illustrated in FIG. 31, if a gradient of an area K1K is greater than a setting value KS (e.g., the reference code (b) in FIG. 30C), the controller 110 can determine that the recessed portion 96*a* is present, and can determine that the spool 98 is an empty spool. As described above, the comparison is preferably made using absolute values. Moreover, in the example illustrated in FIG. 31, if a gradient of an area K2K is greater than the setting value KS (e.g., the reference code (c) in FIG. 30C), the controller 110 can determine that the recessed portion 96*a* is present, and can determine that the spool 98 is an empty spool.

The presence of the recessed portion 96*a* is determined based on a condition such as a first condition that a gradient of an area K1K is greater than a setting value KS, a second condition that a gradient of an area K2K is greater than the setting value KS, and a third condition that both of the first and second conditions are satisfied. A condition to be used herein can be selected appropriately. If a condition that any one of the first and second conditions is satisfied is selected, omission of the detection can be reduced. If the third condition is selected, false detection can be reduced.

The example illustrated in FIG. 31 illustrates a case in which the recessed portion 96*a* passes the roller 92. However, in a case where the recessed portion 96*a* passes the sensor 93, a sign of a sensor output is the opposite of the sensor output when the recessed portion 96*a* passes the roller 92.

Moreover, in the example illustrated in FIG. 31, time for detection of an empty spool is set to time for one or more circumferences of a paper roll (time for which a paper roll makes one or more rotations). Accordingly, with such setting in which time for detection of an empty spool is set to time for one or more rotations of a paper roll, an empty spool can be reliably detected.

In the present embodiment, since the detection of an empty spool and the detection of a paper-roll leading end can be performed at the same time, a spool 98 as a determination target can be rotated for time for one or more rotations of a paper roll, so that not only the presence or absence of a paper-roll leading end can be determined, but also determination of whether a paper roll is provided on the spool 98 can be made. Such an operation is preferred.

Figure 32:
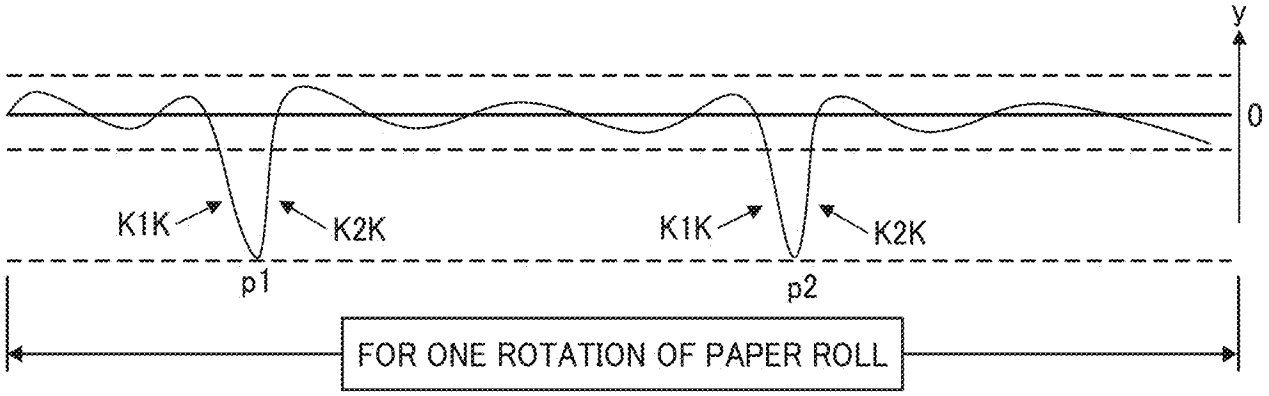
FIG. 32 is a diagram illustrating an output example of a sensor signal in a case where an empty spool is detected and the spool has two recessed portions.

FIG. 32 is a graph illustrating an output example of a sensor signal of a spool surface (an example in which two recessed portions are arranged). FIG. 32 illustrates an output example of the example illustrated in FIG. 23B. The example illustrated in FIG. 32 is an example in which two raised portions 96*b* are detected when detection is performed for one rotation of a paper roll. FIG. 32 illustrates an output example when detection is performed with respect to, for example, the case illustrated in FIG. 25C or 26B.

In FIG. 32, peaks p1 and p2 are output. Herein, since the two raised portions 96*b* are considered to have the same shape (or substantially the same shape), the peaks p1 and p2 have the same shape (or substantially the same shape). In a case where a plurality of recessed portions 96*a* is present, the controller 110 can determine that the recessed portion 96*a* has been detected if any one of gradients may be greater than a setting value KS, or if a plurality of gradients is greater than the setting value KS.

The aforementioned example has been described using an example of the recessed portion 96*a*. However, the aforementioned example can be applied to the raised portion 96*b*. Since the raised portion 96*b* has an area ascending to the top of a raised portion and an area descending from the top of the raised portion, a sensor output of the raised portion 96*b* is the opposite of a sensor output of the recessed portion 96*a*.

In a case where a plurality of recessed or raised portions 96 is arranged on the spool 98, the recessed or raised portions 96 are preferably spaced a certain distance apart (equally spaced apart) in a circumferential direction. FIG. 32 illustrates a case in which the recessed portions 96*a* are spaced a certain distance apart in a circumferential direction. With such arrangement, a more distinctive output can be acquired, and accuracy in detecting an empty spool can be enhanced.

Figure 33A:
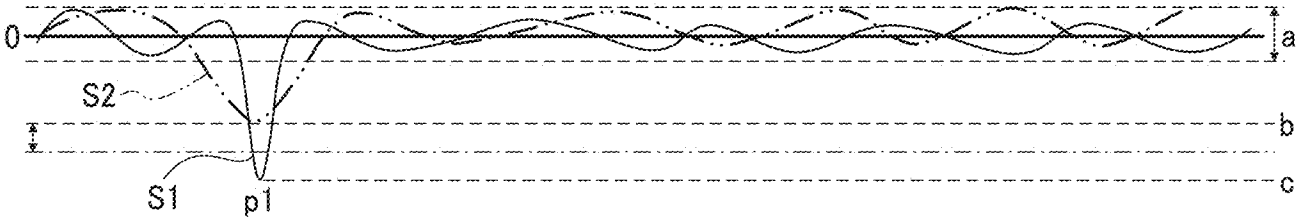
FIG. 33A is a diagram illustrating an output example of a sensor signal in a case where an empty spool is detected where there is one recessed portion on the spool, and an output example of a sensor signal in a case where a paper roll having the maximum applicable paper thickness is detected.
Figure 33B:
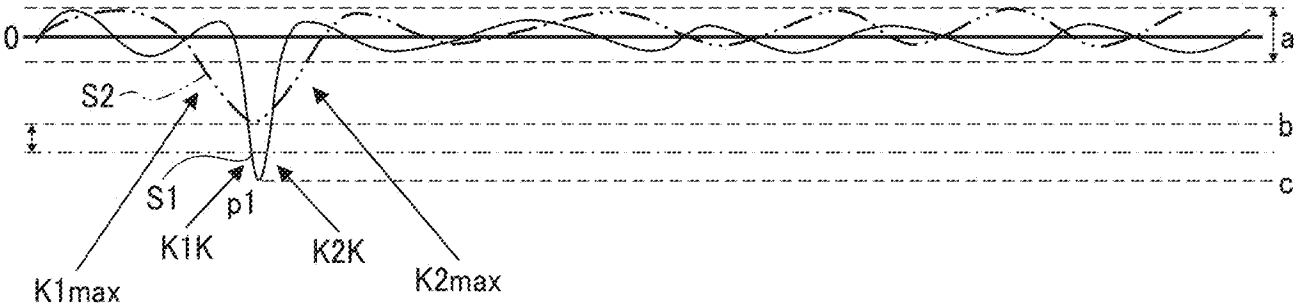
FIG. 33B is a supplementary diagram to the diagram illustrated in FIG. 33A.

FIGS. 33A and 33B each illustrate an output example of a sensor signal of a spool surface. FIG. 33A illustrates an output example (a waveform S1 indicated by a solid line) when detection is performed on a spool 98 having one recessed portion 96*a*, and an output example (a waveform S2 indicated by a broken line) when detection is performed on a paper roll having a maximum applicable paper thickness. The waveform S1 is the same as a waveform illustrated in FIG. 31. FIG. 33B is a graph illustrating which portions of gradients are gradients K1max and K2max with respect to the graph illustrated in FIG. 33A.

A shape of each of the recessed portion 96*a* and the raised portion 96*b* can be selected appropriately. However, in a sensor signal of the sensor 93, each of the recessed portion 96*a* and the raised portion 96*b* preferably has a shape that is defined such that a gradient of a sensor signal is greater than a gradient of a sensor signal when a leading end having a maximum applicable paper thickness is detected. In this case, in the sensor signal, the recessed portion 96*a* and the raised portion 96*b* are detected more easily, and the recessed portion 96*a* and the raised portion 96*b* can be determined more easily, thereby preventing false detection.

Accordingly, each of the recessed portion 96*a* and the raised portion 96*b* may have such a shape. In such a case, if the controller 110 detects a gradient greater than the gradient of the sensor signal when the leading end having the maximum applicable paper thickness is detected, the controller 110 determines that the spool 98 is an empty spool (i.e., the spool 98 is not provided with a paper roll). For example, since a gradient of the K1K area in the peak p1 illustrated in FIG. 33B is similar to FIG. 30C and is greater than the gradient K1max, the controller 110 can determine that the recessed portion 96*a* has been detected.

The foregoing example is further described. In a sensor signal of the sensor 93, gradients K1max and K2max are determined beforehand, where the gradient K1max is a gradient of a sensor signal when a leading end having a maximum applicable paper thickness passes the roller 92, and the gradient K2max is a gradient of a sensor signal when a leading end having a maximum applicable paper thickness passes the sensor 93. In a sensor signal acquired by rotation of the spool 98 as a determination target, if the controller 110 detects a gradient the absolute value of which is greater than the gradient K1max among gradients having the same sign as the gradient K1max, and/or the controller 110 detects a gradient the absolute value of which is greater than the gradient K2max among gradients having the same sign as the gradient K2max, the controller 110 preferably determines that the spool 98 is not provided with a paper roll (the spool 98 is an empty spool). Accordingly, the empty spool can be detected with good accuracy.

The foregoing example is described again using a suitable example. In a sensor signal acquired by rotation of the spool 98 as a determination target, the controller 110 can preferably determine that the spool 98 is not provided with a paper roll (the spool 98 is an empty spool) if the controller 110 detects that a gradient the absolute value of which is greater than a setting value KS, where the setting value KS is a value acquired by addition of a predetermined tolerance to an absolute value of the gradient K1max, or a value acquired by addition of a predetermined tolerance to an absolute value of the gradient K2max, whichever is greater. Accordingly, sensor variation can be considered, and an empty spool can be detected with better accuracy.

The predetermined tolerance corresponds to the aforementioned margin m. The predetermined tolerance can be referred to as a predetermined value, a tolerance amount, or a predetermined amount. The tolerance (the predetermined value) is adjusted appropriately depending on specifications of a sensor to be used. For example, a sensor by which 20 pulses are output with respect to a paper thickness of 0.1 mm may be used. In such a case, if a variation corresponding to 0.05 mm is assumed, an amount of 10 pulses, that is, 50% of an absolute value of a gradient K1max, can be set to a tolerance (a predetermined value).

Each of FIGS. 33A and 33B illustrates an example in which, in a sensor signal of the sensor 93, a shape of each of the recessed portion 96*a* and the raised portion 96*b* is defined such that an output strength of a sensor signal is greater than an output signal of a sensor signal when a leading end having a maximum applicable paper thickness is detected. Herein, a description is given of an example in which the recessed or raised portion 96 is a recessed portion 96*a*.

In the present embodiment, in a sensor signal of the sensor 93, the recessed portion 96*a* or the raised portion 96*b* preferably has a shape that is defined such that an output strength of a sensor signal is greater than an output strength of a sensor signal when a leading end having a maximum applicable paper thickness is detected. In this case, the controller 110 preferably determines that a paper roll is not provided on the spool 98, if the controller 110 detects an output strength greater than an output strength of a sensor signal when a leading end having a maximum applicable paper thickness is detected. Accordingly, false detection can be prevented.

In each of FIGS. 33A and 33B, an output strength of a sensor signal when a leading end having a maximum applicable paper thickness is indicated by a reference code b, whereas an output strength of a sensor signal when the recessed portion 96*a* passes the roller 92 is indicated by a reference code c. As illustrated in each of FIGS. 33A and 33B, the output strength c is greater than the output strength b. If such an output strength c is detected, that is, an output strength greater than the output strength b is detected, the controller 110 can determines that the recessed portion 96*a* has been detected, and determine that the spool 98 is an empty spool.

In a case where the recessed or raised portion 96 is a recessed portion 96*a*, values of the output strengths b and c increase from the base (zero in each of FIGS. 33A and 33B) toward a negative direction as illustrated in each of FIGS. 33A and 33B. Thus, in a case where the output strengths b and c are compared, the comparison can be made using absolute values of the output strengths b and c, although the present embodiment is not particularly limited thereto. Alternatively, positive and negative signs of the output strengths of the sensor signals may be reversed, and comparison of the both output strengths can be made using positive values. In a case where the recessed or raised portion 96 is a raised portion 96*b*, since positive and negative signs of output strengths b and c are reversed, comparison is made using absolute values of the output strengths b and c if the output strengths b and c are compared.

In each of FIGS. 33A and 33B, a fluctuation range (fluctuations in output strength) when a surface of the paper core 99 is detected is indicated by a reference code a. The fluctuation range a in each of FIGS. 33A and 33B is similar to the fluctuation range illustrated in FIG. 28. In a case where shapes of the recessed portion 96*a* and the raised portion 96*b* are to be set, a fluctuation range is preferably considered. An example of the fluctuation range is fluctuations in sensor sensitivity. In addition, in a case where shapes of the recessed portion 96*a* and the raised portion 96*b* are to be set, a paper thickness is preferably considered. For example, shapes of the recessed portion 96*a* and the raised portion 96*b* are preferably set in consideration of a degree of difference to be generated between the output strengths b and c.

In the output examples in FIGS. 33A and 33B, a peak of a leading end of paper and a peak p1 of the recessed portion 96*a* are set in the same position. However, the present invention is not limited thereto. In other words, although a peak of a leading end of paper and a peak p1 of the recessed portion 96*a* are set to be in the same position in a horizontal axis direction, the arrangement is not limited thereto. The positions of the peaks may be displaced.

Figure 34:
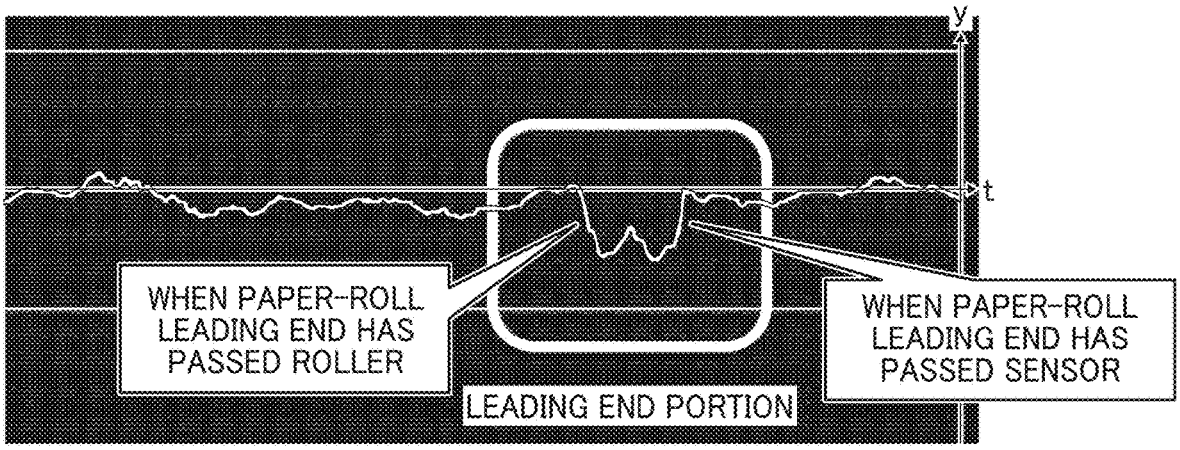
FIG. 34 is a diagram illustrating an output example of a sensor in a case where a leading end of a paper roll is detected.

FIG. 34 is a diagram for supplemental description, and illustrates an example of a signal waveform in a case where a paper-roll leading end is detected. In FIG. 34, a change in waveform when the paper-roll leading end has passed the roller 92, and a change in waveform when the paper-roll leading end has passed the sensor 93 are illustrated. The paper-roll leading end can be detected based on a gradient of the sensor signal. In the example illustrated in FIG. 34, a vertical axis represents an output strength y of a sensor signal, and a horizontal axis represents a time t.

If the controller 110 determines that the spool 98 is an empty spool, a subsequent process can be selected appropriately. For example, if the spool 98 is an empty spool, preferably, a paper feed screen is not displayed. If the paper feed screen is not displayed, a user can be saved from having to cancel paper feeding such as a press of a paper-feeding cancel button. Moreover, the user can be prevented from mistakenly pressing a paper-feeding start button, and a malfunction such as a case in which an operation continues until the device recognizes a paper-feeding failure can be prevented. Thus, the user can be saved from having to perform labor or consume time for which, for example, the user opens a cover of the device and stops the operation of the device.

Accordingly, the paper feeding device 90 includes a spool detection sensor 1, and the display 170. The spool detection sensor 1 detects that the spool 98 is arranged on a spool bearing base 5, and the display 170 displays a paper feed screen. If the spool detection sensor 1 detects that the spool 98 has been arranged, the controller 110 rotates the spool 98 to determine whether a paper roll is provided on the spool 98 before the paper feed screen is displayed on the display 170. If the controller 110 determines that the paper roll is not provided on the spool 98, the controller 110 controls the display 170 such that the paper feed screen is not displayed.

Moreover, if the controller 110 determines that a paper roll is not provided on the spool 98, a warning message can be displayed on the display 170. Such display of the warning message can notify a user accordingly. Thus, the paper feeding operation can be prevented from being mistakenly performed.

As described above, the arrangement of the recessed or raised portion 96 and the number of the recessed or raised portions 96 can be changed appropriately. Preferably, for example, a recessed or raised portion 96 is arranged in a position to contact the roller 92, and also a recessed or raised portion 96 is arranged in a position to contact the sensor 93. Even if a surface of a paper roll has large scratch, such arrangement of the recessed or raised portions 96 can prevent an event of false detection by which the spool 98 is detected as an empty spool despite the presence of a paper roll on the spool 98.

That is, preferably, the recessed portion 96*a* or the raised portion 96*b* is arranged in a position to contact the leading-end detection sensor 93, and also the recessed portion 96*a* or the raised portion 96*b* is arranged in a position to contact the roller 92 when a spool 98 is arranged in the paper feeding device 90 and rotated without a paper roll and a paper core 99 on the spool 98. The controller 110 preferably determines that the paper roll is not provided on the spool 98 based on detection of both of a gradient of a sensor signal when the roller 92 passes the recessed portion 96*a* or the raised portion 96*b* and a gradient of a sensor signal when the leading-end detection sensor 93 passes the recessed portion 96*a* or raised portion 96*b*. The both of the gradients are detected when the spool 98 is rotated.

Figure 35:
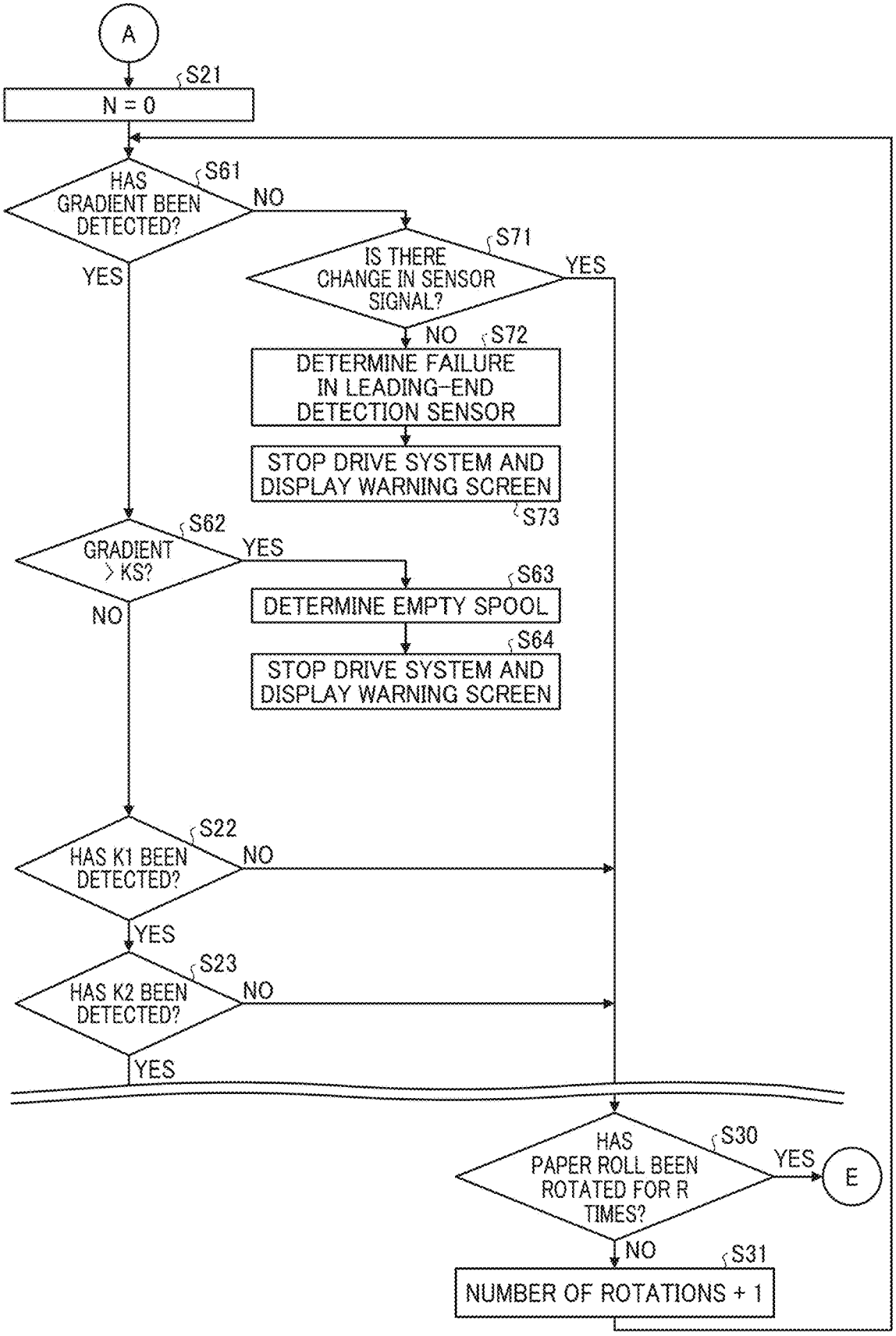
FIG. 35 is a flowchart illustrating one example of a procedure in which a paper-roll leading end detection operation and an empty-spool detection operation are performed.

Next, a description is given of one example of the process that takes into consideration of the foregoing example. FIG. 35 is a flowchart illustrating one example of the procedure A illustrated in FIG. 18. In the present embodiment, detection of a paper-roll leading end and detection of an empty spool can be performed at the same time.

As illustrated in FIG. 35, in step S61, the controller 110 first determines whether a gradient has been detected from a sensor signal. If a gradient has not been detected in a sensor signal at the time of rotation of a paper roll by automatic paper-feeding (NO in step S61), the process proceeds to step S71. If a sensor output is constant for a given amount of time (NO in step S71), the process proceeds to step S72. In step S72, the controller 110 determines a failure in the leading-end detection sensor. Subsequently, in step S73, the controller 110 stops the operation. The controller 110 preferably stops a drive system, and displays a warning screen in step S73. Since processes in steps S30 and S31 in FIG. 35 are similar to those in FIG. 19, descriptions thereof are omitted.

The determination of whether a gradient has been detected in step S61 is not particularly limited. For example, the determination can be made based on whether the detected gradient is greater than a predetermined value. The predetermined value herein can be selected appropriately in consideration of sensor variations.

If a gradient is detected in a sensor signal at the time of rotation of a paper roll by automatic paper-feeding (YES in step S61), the process proceeds to step S62. In step S62, the controller 110 compares the detected gradient with a setting value KS. The comparison between the detected gradient and the setting value KS can be made as described above. Some examples are given herein. In one example, the controller 110 may determine whether the detected gradient having an absolute value that is greater than the setting value KS has been detected, In another example, the detected gradient may be compared with a gradient K1max or K2max (See FIG. 36 described below) instead of the setting value KS. As for the detected gradient, the controller 110 may determine whether an absolute value of the detected gradient is greater than a gradient K1max among measured values to be gradients having the same sign as the gradient K1max, or may determine whether an absolute value of the detected gradient is greater than a gradient K2max among measured values to be gradients having the same sign as the gradient K2max.

If the detected gradient is greater than the setting value KS (YES in step S62), the process proceeds to step S63. In step S63, the controller 110 determines that the spool 98 is an empty spool. Subsequently, in step S64, the controller 110 stops the operation. Preferably, in step S64, the controller 110 stops a drive system and display a warning screen. After the empty spool is determined in S63, the process returns to the flowchart illustrated in FIG. 18, and steps S18 and S19 are performed. The process in step S19 illustrated in FIG. 18, and the process in step S64 illustrated in FIG. 35 are the same. Such transition is indicated by a broken line in FIG. 18. If the empty spool is determined, execution of the procedure E is not necessary.

In steps S61 and S62, determination of whether a gradient is detected, and comparison between the detected gradient and the setting value KS are preferably performed for time for one or more rotations of the paper roll. In this case, determination of whether the spool 98 is an empty spool can be reliably made.

If the detected gradient is the setting value KS or less (NO in step S62), the process proceeds to step S22 in which the controller 110 determines that the spool 98 is not an empty spool, and determines whether a gradient K1 has been detected. If the gradient K1 has been detected (YES in step S22), the process proceeds to step S23 in which determination of whether a gradient K2 has been detected is made. Since the processes in steps S22 and S23 in FIG. 35 are similar to, for example, the processes in steps S22 and S23 in FIG. 19, descriptions are omitted.

Figure 36:
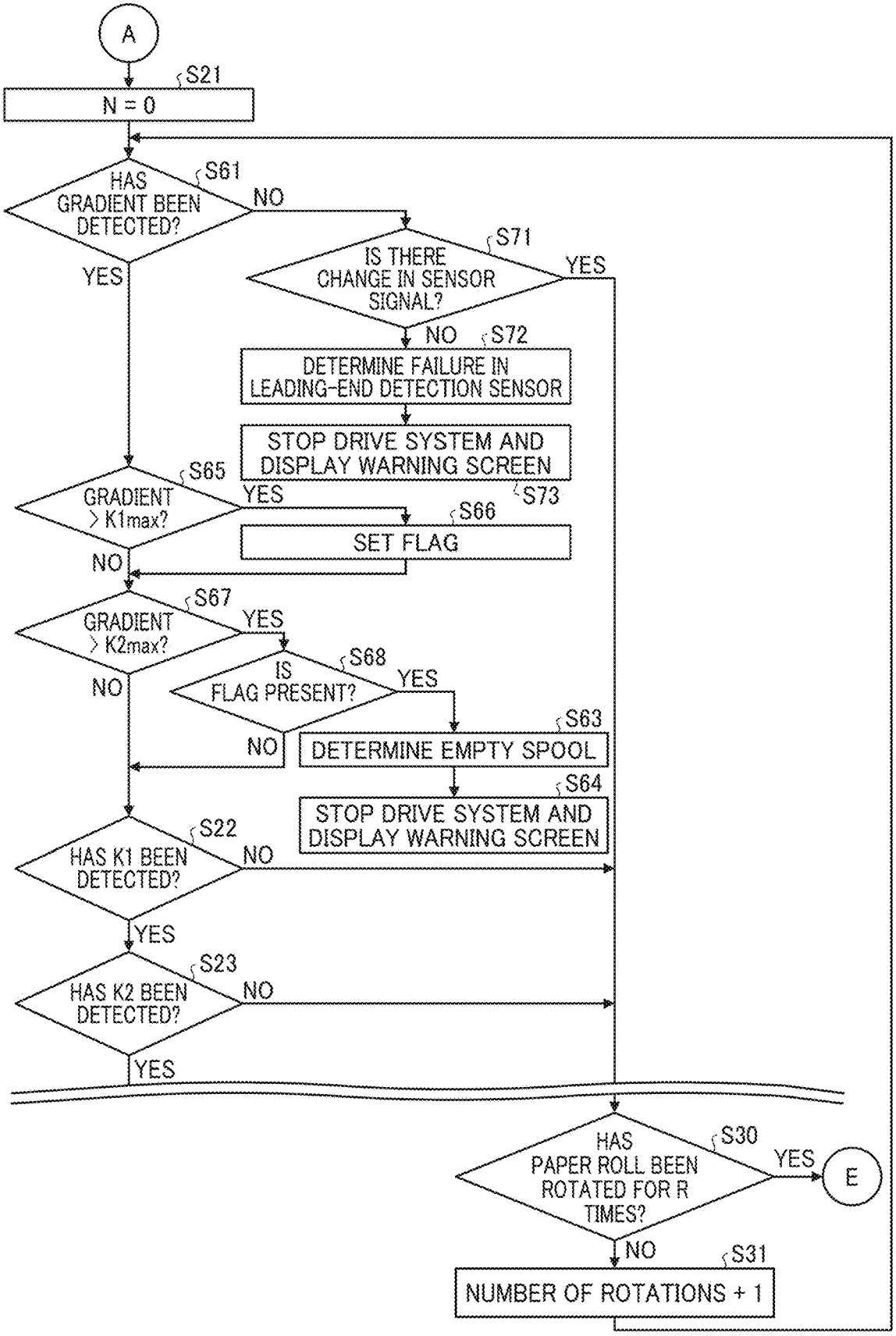
FIG. 36 is a flowchart illustrating another example of a procedure in which a paper-roll leading end detection operation and an empty-spool detection operation are performed.

FIG. 36 is a flowchart illustrating another example of the procedure A illustrated in FIG. 18. In FIG. 35, the detected gradient and the setting value KS are compared. In the example illustrated in FIG. 36, a detected gradient is compared with a gradient K1max and a gradient K2max. Herein, processes that differ from the above-described processes are mainly described, and descriptions of similar processes are omitted.

First, in step S61, the controller 110 determines whether a gradient has been detected from a sensor signal, similar to the above-described example. If the gradient has been detected in a sensor signal at the time of rotation of a paper roll by automatic paper-feeding (YES in step S61), the process proceeds to step S65 in which the detected gradient is compared with a gradient K1max. In step S65, the controller 110 not only determines whether the detected gradient has the same sign as the gradient K1max, but also determines whether an absolute value of the detected gradient is greater than the gradient K1max. If these conditions are satisfied (YES in step S65), the process proceeds to step S66. In step S66, the controller 110 sets a flag.

Subsequently, in step S67, the controller 110 compares the detected gradient with a gradient K2max regardless of whether the determination result in step S65 is YES or NO. In step S67, the controller 110 not only determines whether the detected gradient has the same sign as the gradient K2max, but also determines whether an absolute value of the detected gradient is greater than the gradient K2max. If these conditions are satisfied (YES in step S67), the process proceeds to step S68. In step S68, the controller 110 determines whether a flag is present. If the controller 110 determines the presence of flag (YES in step S68), that is, if the detected gradient is not only greater than the gradient K1max, but also greater than the gradient K2max, the controller 110 determines that the spool 98 is an empty spool in step S63. Subsequently, in step S64, the controller 110 stops the operation.

Accordingly, in the flowchart illustrated in FIG. 36, if the detected gradient is not only greater than the gradient K1max, but also greater than the gradient K2max, the controller 110 determines that the spool 98 is an empty spool Thus, an empty spool can be more reliably detected.

Therefore, a paper-roll leading end detection operation and an empty spool detection operation can be performed. The foregoing flowchart has been described using an example in which a gradient is used to make determination. However, in a case where an output strength is used to make determination, a change can be made appropriately. In FIG. 35, for example, the process in step S61 can be changed to determination of whether a predetermined output strength has been detected, and the process in step S62 can be changed to determination of whether the detected output strength is greater than an output strength b. The output strength b is an output strength of a sensor signal when a paper-roll leading end having the maximum applicable paper thickness is detected.

In the present embodiment, moreover, the roller 92 and the sensor 93 are disposed in offset positions. That is, the roller 92 and the sensor 93 are disposed in positions different from each other in a circumferential direction of the paper roll. Thus, even in a case where a surface of the paper roll partially has a scratch, a leading end of the paper roll can be detected. Moreover, such arrangement of the roller 92 and the sensor 93 in the offset positions can reduce false detection even in an empty spool detection operation.

The present embodiment has been described using the terms "detecting" and "sensing". However, the present embodiment is not limited by these terms, and these terms may be changed appropriately. For example, detecting and sensing may be used interchangeably. Alternatively, these words may be expressed using other words such as evaluating, identifying, and recognizing.

The present embodiment is directed to a paper feeding device that can automatically detect that a paper roll is not set on a spool in an efficient manner, and can prevent a case in which a process that is performed if a paper roll is set is performed despite the absence of the paper roll can be prevented The present embodiment can provide aspects below.

[Aspect 1]

A paper feeding device for feeding paper from a paper roll around which long paper is wound includes a support member on which a leading-end detection sensor and a roller are disposed, and a controller. The support member supports the leading-end detection sensor and the roller to contact a surface of the paper roll. The controller comprehensively controls the paper feeding device and acquires a sensor signal from the leading-end detection sensor. The paper roll includes a paper tube inside the paper roll, and is arranged in the paper feeding device with a spool inserted into the paper tube to rotate in response to rotation of the spool. The leading-end detection sensor and the roller are disposed toward an axial center of the spool. The roller is disposed in a position different from a position of the leading-end detection sensor in a circumferential direction of the paper roll. The leading-end detection sensor detects a step of a leading end of the paper roll. The spool has a recessed portion or a raised portion in one portion of a surface. The recessed portion or the raised portion is arranged in a position to contact the leading-end detection sensor or the roller when the spool is arranged in the paper feeding device and rotated without the paper roll and the paper tube on the spool. The controller, based on a sensor signal of the leading-end detection sensor, determines the presence or absence of a leading end of the paper-roll and determines whether the paper roll is provided on the spool.

[Aspect 2]

In the paper feeding device with the aspect 1, the controller determines the presence or absence of a leading end of the paper roll based on detection of a gradient K1 of a graph indicating, with respect to time, a change in output strength of a sensor signal when the leading end of the paper roll passes the roller, and a gradient K2 of a graph indicating, with respect to time, a change in output strength of a sensor signal when the leading end of the paper roll passes the leading-end detection sensor.

[Aspect 3]

In the paper feeding device with the aspect 2, in a sensor signal of the leading-end detection sensor, the recessed portion or the raised portion has a shape that is defined to have an output strength greater than an output strength of a sensor signal when a leading end having a maximum applicable paper thickness is detected. In a case where an output strength greater than an output strength of a sensor signal when a leading end having the maximum applicable paper thickness is detected is detected, the controller determines that the paper roll is not provided on the spool.

[Aspect 4]

In the paper feeding device with any of the aspects 1 through 3, in a sensor signal of the leading-end detection sensor, a gradient K1max and a gradient K2max are determined beforehand. The gradient K1max is a gradient of a sensor signal when a leading end having a maximum applicable paper thickness passes the roller, whereas the gradient K2max is a gradient of a sensor signal when a leading end having a maximum applicable paper thickness passes the leading-end detection sensor. The controller determines that the paper roll is not provided on the spool in a case where a gradient having an absolute value greater than the gradient K1max is detected among gradients having same sign as the gradient K1max, and/or a gradient having an absolute value greater than the gradient K2max is detected among gradients having same sign as the gradient K2max in a sensor signal acquired by rotation of the spool as a determination target.

[Aspect 5]

In the paper feeding device with the aspect 4, the controller determines that the paper roll is not provided on the spool in a case where a gradient having an absolute value greater than a value KS is detected in a sensor signal acquired by rotation of the spool as a determination target. The value KS is a value acquired by addition of a predetermined tolerance to an absolute value of the gradient K1max or a value acquired by addition of a predetermined tolerance to an absolute value of the gradient K2max, whichever is greater.

[Aspect 6]

In the paper feeding device with any of the aspects 1 through 5, the surface of the spool has two or more recessed portions or raised portions including the recessed portion or the raised portion.

[Aspect 7]

In the paper feeding device with any of the aspects 1 through 6, the controller rotates the spool as a determination target for time for one or more rotations of the paper roll to determine presence or absence of a leading end of the paper roll and to determine whether the paper roll is provided on the spool.

[Aspect 8]

The paper feeding device with any of the aspects 1 through 7, further includes a spool detection sensor and a display. The spool detection sensor detects that the spool is arranged on a spool bearing base, and the display displays a paper feed screen. In a case where the spool detection sensor detects that the spool has been arranged, the controller rotates the spool to determine whether the paper roll is provided on the spool before the paper feed screen is displayed on the display. In a case where the controller determines that the paper roll is not provided on the spool, the paper feed screen is not displayed on the display.

[Aspect 9]

In the paper feeding device with the aspect 8, in a case where the controller determines that the paper roll is not provided on the spool, the controller displays a warning message on the display.

[Aspect 10]

In the paper feeding device with any of the aspects 1 through 9, the recessed portion or the raised portion is arranged in each of a position in which the recessed portion or the raised portion contacts the leading-end detection sensor and a position in which the recessed portion or the raised portion contacts the roller, when the spool is arranged in the paper feeding device and rotated without the paper roll and the paper tube on the spool. The controller determines that the paper roll is not provided on the spool based on detection of both of a gradient of a sensor signal when the roller passes the recessed portion or the raised portion and a gradient of a sensor signal when the leading-end detection sensor passes the recessed portion or the raised portion, when the spool is rotated.

[Aspect 11]

An image forming apparatus includes the paper feeding device with any of the aspects 1 through 10.

[Aspect 12]

A paper feeding device includes: a bearing base to which a spool inserted into a paper roll, around which a paper is wound, is detachably attachable; a support including: a leading-end detection sensor to detect a leading end of the paper on the paper roll and output a sensor signal; and a roller disposed at a position in the support different from the leading-end detection sensor in a circumferential direction of the paper roll, to cause the leading-end detection sensor and the roller to contact a surface of the paper roll attached to the bearing base; and to cause the leading-end detection sensor and the roller to be directed toward an axial center of the spool; a motor to rotate the spool in a feeding direction to feed the paper and in a reverse direction opposite to the feeding direction; and circuitry to: acquire the sensor signal from the leading-end detection sensor to control a feeding of the paper; determine whether the leading-end detection sensor detects the leading end of the paper based on the sensor signal of the leading-end detection sensor; and determine whether the paper roll is on the spool based on the sensor signal of the leading-end detection sensor.

[Aspect 13]

In the paper feeding device according to aspect 12, the roller is disposed upstream from the leading-end detection sensor in the reverse direction in the support.

[Aspect 14]

In the paper feeding device according to aspect 12, at least one of the leading-end detection sensor or the roller is contactable a recess portion or a convex portion on a surface of the spool.

[Aspect 15]

In the paper feeding device according to aspect 12, the circuitry determines whether the leading-end detection sensor detects the leading end of the paper based on the sensor signal having: a gradient K1 indicating, with respect to time, a change in output strength of the sensor signal when the leading end of the paper passes the roller, and a gradient K2 indicating, with respect to time, a change in output strength of the sensor signal when the leading end of the paper passes the leading-end detection sensor.

[Aspect 16]

In the paper feeding device according to aspect 13, the circuitry determines that the paper roll is not on the spool when an output strength of the sensor signal output by the leading-end detection sensor is greater than a first output strength of the sensor signal output when the leading-end detection sensor detects the leading end of the paper having a maximum applicable paper thickness, and a second output strength of the sensor signal output when the leading-end detection sensor detects a recess or a convex portion on a surface of the spool is greater than the first output strength of the sensor signal.

[Aspect 17]

In the paper feeding device according to aspect 12, the circuitry: determines a gradient K1max beforehand; and determines that the paper roll is not on the spool when the leading-end detection sensor detects a gradient having an absolute value greater than the gradient K1max among gradients having same sign as the gradient K1max in the sensor signal acquired by rotating the spool in the reverse direction, where the gradient K1max is a gradient of the sensor signal when the leading end of the paper having a maximum applicable paper thickness passes the roller.

[Aspect 18]

In the paper feeding device according to aspect 17, the circuitry: determines a gradient K2max beforehand; and determines that the paper roll is not on the spool when the leading-end detection sensor detects a gradient having an absolute value greater than the gradient K2max among gradients having same sign as the gradient K2max in the sensor signal acquired by rotating the spool in the reverse direction, where the gradient K2max is a gradient of the sensor signal when the leading end of the paper having a maximum applicable paper thickness passes the leading-end detection sensor.

[Aspect 19]

In the paper feeding device according to aspect 18, the circuitry determines that the paper roll is not on the spool when the sensor signal has a gradient having an absolute value greater than a value KS acquired by rotating the spool in the reverse direction, where the value KS is one of a greater value acquired by adding a predetermined tolerance to an absolute value of the gradient K1max or a value acquired by adding a predetermined tolerance to the absolute value of the gradient K2max.

[Aspect 20]

In the paper feeding device according to aspect 12, the leading-end sensor detects two or more recesses or convex portions on the surface of the spool.

[Aspect 21]

In the paper feeding device according to aspect 12, the circuitry: rotates the spool in the reverse direction for a time taken for one or more rotations of the paper roll; determine whether the leading-end detection sensor detects the leading end of the paper; and determine whether the paper roll is on the spool.

[Aspect 22]

The paper feeding device according to aspect 12 further includes: a spool detection sensor to detect that the spool is arranged on the bearing base; and a display to display a paper feed screen, wherein the circuitry: rotates the spool in the reverse direction to determine whether the paper roll is on the spool before displaying the paper feed screen on the display when the spool detection sensor detects that the spool in on the bearing base, and do not display the paper feed screen on the display when the circuitry determines that the paper roll is not on the spool.

[Aspect 23]

In the paper feeding device according to aspect 22, the circuitry displays a warning message on the display when the circuitry determines that the paper roll is not on the spool.

[Aspect 24]

In the paper feeding device according to aspect 14, wherein the circuitry: causes the motor to rotate the spool in the reverse direction; causes the leading-end detection sensor to detect: a first gradient of the sensor signal when the roller passes the recess or the convex portion; and a second gradient of the sensor signal when the leading-end detection sensor passes the recess or the convex portion; and determines that the paper roll is not on the spool when the leading-end detection sensor detects both of the first gradient and the second gradient of the sensor signal, and the leading-end detection sensor detects two or more of recesses having the recess or the convex portions having the convex portion at positions on the spool respectively contacting the leading-end detection sensor and the roller.

[Aspect 25]

In the paper feeding device according to aspect 13, the support includes an arm rotatable about a rotation center and pressed toward the paper roll by a spring, and the arm includes: multiple rollers including the roller arranged in a width direction of the arm orthogonal to the feeding direction; and the leading-end detection sensor between the multiple rollers in the width direction.

[Aspect 26]

An image forming apparatus includes: the paper feeding device according to aspect 12; and an image forming unit to form an image on the paper fed by the paper feeding device.

Each of the functions of the described embodiments such as the controller 110 may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

The invention claimed is:

1. A paper feeding device comprising:

a bearing base to which a spool inserted into a paper roll, around which a paper is wound, is detachably attachable;

a support including:

a leading-end detection sensor configured to detect a leading end of the paper on the paper roll and output a sensor signal; and a roller at a position in the support different from the leading-end detection sensor in a circumferential direction of the paper roll, wherein the support is configured to cause the leading-end detection sensor and the roller to contact a surface of the paper roll attached to the bearing base; and cause the leading-end detection sensor and the roller to be directed toward an axial center of the spool;

a motor configured to rotate the spool in a feeding direction to feed the paper and in a reverse direction opposite to the feeding direction; and circuitry configured to:

acquire the sensor signal from the leading-end detection sensor to control a feeding of the paper;

determine whether the leading-end detection sensor detects the leading end of the paper based on the sensor signal of the leading-end detection sensor; and determine whether the paper roll is on the spool based on the sensor signal of the leading-end detection sensor.

2. A paper feeding device comprising:

a bearing base to which a spool inserted into a paper roll, around which a paper is wound, is detachably attachable;

a support including:

a leading-end detection sensor configured to detect a leading end of the paper on the paper roll and output a sensor signal; and a roller at a position in the support different from the leading-end detection sensor in a circumferential direction of the paper roll, wherein the support is configured to cause the leading-end detection sensor and the roller to contact a surface of the paper roll attached to the bearing base; and circuitry configured to:

acquire the sensor signal from the leading-end detection sensor to control a feeding of the paper; and determine whether the paper roll is on the spool based on the sensor signal of the leading-end detection sensor.

3. The paper feeding device according to claim 2, wherein the support is configured to cause the leading-end detection sensor and the roller to be directed toward an axial center of the spool.

4. The paper feeding device according to claim 2, further comprising a motor configured to rotate the spool in a feeding direction to feed the paper in a reverse direction opposite to the feeding direction.

5. The paper feeding device according to claim 2, wherein the circuitry is further configured to determine whether the leading-end detection sensor detects the leading end of the paper based on the sensor signal of the leading-end detection sensor.

6. An image forming apparatus comprising:

the paper feeding device according to claim 2; and an image forming unit configured to form an image on the paper fed by the paper feeding device.

7. The paper feeding device according to claim 2, wherein the roller is upstream from the leading-end detection sensor in a reverse direction in the support.

8. The paper feeding device according to claim 7, wherein the circuitry is further configured to determine that the paper roll is not on the spool in response to an output strength of the sensor signal output by the leading-end detection sensor being greater than a first output strength of the sensor signal output when the leading-end detection sensor detects the leading end of the paper having a maximum applicable paper thickness, and wherein a second output strength of the sensor signal output when the leading-end detection sensor detects a recess or a convex portion on a surface of the spool is greater than the first output strength of the sensor signal.

9. The paper feeding device according to claim 7, wherein the support includes an arm rotatable about a rotation center and pressed toward the paper roll by a spring, and the arm includes:

multiple rollers including the roller arranged in a width direction of the arm orthogonal to a feeding direction; and the leading-end detection sensor between the multiple rollers in the width direction.

10. The paper feeding device according to claim 2, wherein at least one of the leading-end detection sensor or the roller is contactable a recess portion or a convex portion on a surface of the spool.

11. The paper feeding device according to claim 10, wherein the circuitry is further configured to:

cause a motor to rotate the spool in a reverse direction;

cause the leading-end detection sensor to detect:

a first gradient of the sensor signal when the roller passes the recess portion or the convex portion; and a second gradient of the sensor signal when the leading-end detection sensor passes the recess portion or the convex portion; and determine that the paper roll is not on the spool in response to the leading-end detection sensor detecting both of the first gradient and the second gradient of the sensor signal, wherein the leading-end detection sensor is configured to detect two or more of recesses having the recess portion or convex portions having the convex portion at positions on the spool respectively contacting the leading-end detection sensor and the roller.

12. The paper feeding device according to claim 2, wherein the circuitry is further configured to determine whether the leading- end detection sensor detects the leading end of the paper based on the sensor signal having:

a gradient K1 indicating, with respect to time, a change in output strength of the sensor signal when the leading end of the paper passes the roller, and a gradient K2 indicating, with respect to time, a change in output strength of the sensor signal when the leading end of the paper passes the leading-end detection sensor.

13. The paper feeding device according to claim 2, wherein the circuitry is further configured to:

determine a gradient K1max; and determine that the paper roll is not on the spool in response to the leading-end detection sensor detecting a gradient having an absolute value greater than the gradient K1max among gradients having a same sign as the gradient K1max in the sensor signal acquired by rotating the spool in a reverse direction, wherein the gradient K1max is a gradient of the sensor signal when the leading end of the paper having a maximum applicable paper thickness passes the roller.

14. The paper feeding device according to claim 13, wherein the circuitry is further configured to:

determine a gradient K2max; and determine that the paper roll is not on the spool in response to the leading-end detection sensor detecting a gradient having an absolute value greater than the gradient K2max among gradients having a same sign as the gradient K2max in the sensor signal acquired by rotating the spool in a reverse direction, wherein the gradient K2max is a gradient of the sensor signal when the leading end of the paper having a maximum applicable paper thickness passes the leading- end detection sensor.

15. The paper feeding device according to claim 14, wherein the circuitry is further configured to determine that the paper roll is not on the spool in response to the sensor signal having a gradient having an absolute value greater than a value KS acquired by rotating the spool in the reverse direction, where the value KS is one of a greater value acquired by adding a predetermined tolerance to an absolute value of the gradient K1max or a value acquired by adding a predetermined tolerance to the absolute value of the gradient K2max.

16. The paper feeding device according to claim 2, wherein the leading-end detection sensor is configured to detect two or more recesses or convex portions on the surface of the spool.

17. The paper feeding device according to claim 2, wherein the circuitry is further configured to:

rotate the spool in a reverse direction for a time taken for one or more rotations of the paper roll;

determine whether the leading-end detection sensor detects the leading end of the paper; and determine whether the paper roll is on the spool.

18. The paper feeding device according to claim 2, further comprising:

a spool detection sensor to configured detect that the spool is on the bearing base; and a display configured to display a paper feed screen, wherein the circuitry is further configured to:

rotate the spool in a reverse direction to determine whether the paper roll is on the spool before displaying the paper feed screen on the display in response to the spool detection sensor detecting that the spool in on the bearing base, and not display the paper feed screen on the display in response to determining that the paper roll is not on the spool.

19. The paper feeding device according to claim 18, wherein the circuitry is further configured to display a warning message on the display in response to determining that the paper roll is not on the spool.

20. An image forming apparatus comprising:

the paper feeding device according to claim 1; and an image forming unit configured to form an image on the paper fed by the paper feeding device.

* * * * *